US011035127B2

(12) United States Patent
Joshi et al.

(10) Patent No.: US 11,035,127 B2
(45) **Date of Patent: *Jun. 15, 2021**

(54) BUILDING CLADDING COMPOSITIONS, SYSTEMS, AND METHODS FOR PREPARING AND ASSEMBLING SAME

(71) Applicant: James Hardie Technology Limited, Dublin (IE)

(72) Inventors: Amol Joshi, Chino Hills, CA (US); Brian McQuerrey, Rancho Cucamonga, CA (US); Hui Li, Fontana, CA (US); Noel A. Dones, Rancho Cucamonga, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/676,252

(22) Filed: Nov. 6, 2019

(65) Prior Publication Data

US 2020/0071935 A1 Mar. 5, 2020

Related U.S. Application Data

(63) Continuation-in-part of application No. 15/773,059, filed as application No. PCT/EP2016/082499 on Dec. 22, 2016, now Pat. No. 10,519,673.

(Continued)

(51) Int. Cl.
*E04B 1/70* (2006.01)
*E04F 13/08* (2006.01)

(Continued)

(52) U.S. Cl.
CPC ..... *E04F 13/0869* (2013.01); *E04B 1/665* (2013.01); *E04B 1/74* (2013.01); *E04C 2/26* (2013.01); *E04F 13/007* (2013.01)

(58) Field of Classification Search
None
See application file for complete search history.

(56) References Cited

U.S. PATENT DOCUMENTS 3,284,980 A * 11/1966 Dinkel ..... C04B 28/04 52/600
3,318,056 A 5/1967 Thompson (Continued)

FOREIGN PATENT DOCUMENTS

WO WO 2011/051818 A2 5/2011
WO WO 2015/036362 A1 3/2015

(Continued)

OTHER PUBLICATIONS

International Search Report and Written Opinion for corresponding PCT Application No. PCT/EP2016/082499 filed Dec. 22, 2016, dated Apr. 5, 2017, 13 pages.

(Continued)

*Primary Examiner* — Basil S Katcheves
(74) *Attorney, Agent, or Firm* — Knobbe, Martens, Olson & Bear, LLP

(57) ABSTRACT

A building system including a first water resistant layer secured to a building substrate, first and second building articles secured to the first water resistant layer and the building substrate such that sides of the building articles are positioned adjacent one another along an abutment line, and a second water resistant layer secured to portions of the first and second building articles along the abutment line to prevent liquid from traveling past the sides of the building articles to the first water resistant layer and the building substrate. In some embodiments, the building articles are fiber cement building articles. In some embodiments, the building articles include a plurality of integrally formed drainage channels and a plurality of spacer sections disposed (Continued)

between the drainage channels, each of the plurality of drainage channels defining an air gap comprising a liquid flow path.

14 Claims, 18 Drawing Sheets

Related U.S. Application Data

(60) Provisional application No. 62/387,599, filed on Dec. 23, 2015, provisional application No. 62/756,811, filed on Nov. 7, 2018, provisional application No. 62/903,445, filed on Sep. 20, 2019.

(51) Int. Cl.

| | |
|---|---|
| ***E04F 13/00*** | (2006.01) |
| ***E04B 1/74*** | (2006.01) |
| ***E04C 2/26*** | (2006.01) |
| ***E04B 1/66*** | (2006.01) |

(56) References Cited

U.S. PATENT DOCUMENTS

| | | | |
|---|---|---|---|
| 4,000,595 | A | 1/1977 | Fortescue |
| 5,953,883 | A | 9/1999 | Ojala |
| 6,355,333 | B1 | 3/2002 | Waggoner et al. |
| 6,594,965 | B2 | 7/2003 | Coulton |
| 6,804,922 | B1 | 10/2004 | Egan |
| 6,990,775 | B2 | 1/2006 | Koester |
| 7,181,888 | B1 | 2/2007 | Facaros |
| 7,472,523 | B2 | 1/2009 | Beck |
| 7,617,638 | B1 | 11/2009 | Slama et al. |
| 8,534,018 | B2 | 9/2013 | Walker |
| 8,555,581 | B2 | 10/2013 | Amend |
| 8,833,025 | B2 | 9/2014 | Krause |
| 9,140,064 | B2 | 9/2015 | Guthrie |
| 9,394,696 | B2 | 7/2016 | Norwood et al. |
| 9,963,887 | B2 | 5/2018 | Norwood et al. |
| 2002/0059886 | A1 | 5/2002 | Merkley et al. |
| 2004/0168615 | A1 | 9/2004 | Luo et al. |
| 2006/0053740 | A1 | 3/2006 | Wilson et al. |
| 2008/0104918 | A1 | 5/2008 | Gleeson et al. |
| 2009/0282762 | A1 | 11/2009 | Iske et al. |
| 2010/0175809 | A1 | 7/2010 | Jeremiah |
| 2010/0186305 | A1 | 7/2010 | Larimore |
| 2010/0251632 | A1 | 10/2010 | Chen et al. |
| 2010/0300026 | A1 | 12/2010 | Candiracci |
| 2011/0197530 | A1 | 8/2011 | Bahnmiller |
| 2011/0303123 | A1 | 12/2011 | Naji et al. |
| 2012/0167505 | A1 | 7/2012 | Krause |
| 2012/0297697 | A1 | 11/2012 | Schaefer |
| 2013/0125487 | A1* | 5/2013 | Power ..... E04B 2/707 52/302.3 |
| 2014/0000204 | A1* | 1/2014 | Wu ..... E04B 2/02 52/506.05 |
| 2014/0311073 | A1* | 10/2014 | Pool ..... E04C 2/26 52/309.17 |
| 2015/0096248 | A1 | 4/2015 | Tebo |
| 2016/0265220 | A1* | 9/2016 | Johnson ..... E04F 13/047 |
| 2018/0251988 | A1 | 9/2018 | Norwood et al. |
| 2019/0017279 | A1 | 1/2019 | Norwood et al. |

FOREIGN PATENT DOCUMENTS

| | | |
|---|---|---|
| WO | WO 2017/109142 A1 | 6/2017 |
| WO | WO 2018/138266 | 8/2018 |

OTHER PUBLICATIONS

Search Report and Written Opinion received in International Application No. PCT/US2019/060097, dated Apr. 1, 2020.

* cited by examiner

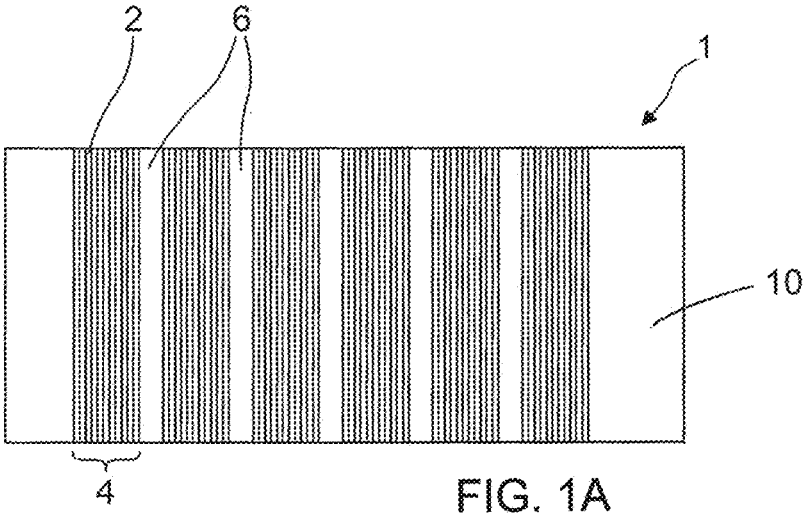
FIG. 1A
FIG. 1C
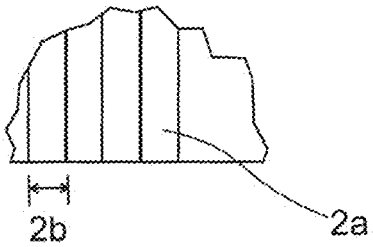
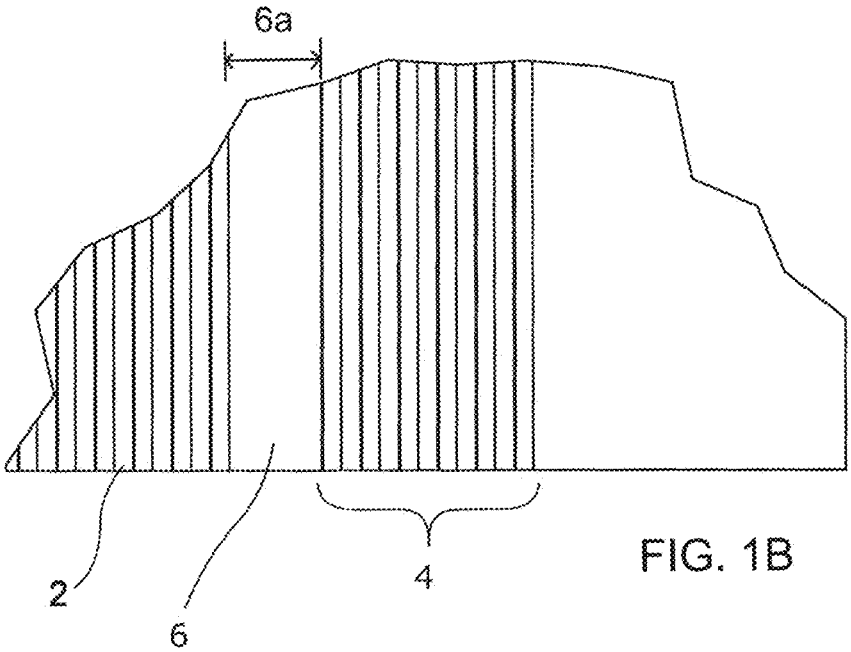
FIG. 1B

BUILDING CLADDING COMPOSITIONS, SYSTEMS, AND METHODS FOR PREPARING AND ASSEMBLING SAME

CROSS-REFERENCE TO RELATED APPLICATIONS

This application is a continuation-in-part of U.S. patent application Ser. No. 15/773,059, filed May 2, 2018, entitled "BUILDING CLADDING AND METHOD FOR PREPARING SAME," which is a U.S. National Phase of PCT International Application No. PCT/EP2016/082499, filed Dec. 22, 2016, entitled "BUILDING CLADDING AND METHOD FOR PREPARING SAME," which claims the benefit of U.S. Provisional Application Ser. No. 62/387,599, filed Dec. 23, 2015, all of which are hereby incorporated by reference in their entirety and for all purposes. This application also claims the benefit of U.S. Provisional Application Ser. No. 62/756,811, filed Nov. 7, 2018, entitled "INTEGRALLY WATERPROOF FIBER CEMENT COMPOSITE MATERIAL," and U.S. Provisional Application Ser. No. 62/903,445, filed Sep. 20, 2019, entitled "FIBER CEMENT ARTICLES WITH COUNTERFEIT DETECTION FEATURES," both of which are hereby incorporated by reference in their entirety and for all purposes.

BACKGROUND

Field

The present invention generally relates to cementitious building articles, methods for preparing same, and building systems incorporated cementitious building articles.

Description of the Related Art

Fiber cement articles are conventionally used as cladding materials to form the exterior and/or interior walls of a building by attaching the fiber cement article to a structural building frame.

A common building practice is to attach the fiber cement article to the structural building frame such that a rain screen system is formed whereby there is an air barrier between fiber cement article and the building frame. Usually, the building frame is enclosed by a weather resistant barrier in the form of a building or house wrap. The fiber cement article forms a first barrier to prevent the air and weather resistant barrier from getting wet whilst the second barrier or air gap between the fiber cement article and house wrap creates a capillary break which allows for drainage and evaporation. One method of creating the air gap is to employ the use of wood furring strips in the form of battens which are interspersed and secured vertically over the house wrap to the building frame. The fiber cement article is then secured to the furring strips. The furring strips function to set the fiber cement article apart from the building frame thereby establishing the air gap necessary to form the rain screen system.

The attachment of furring strips places an additional burden financially and in terms of complexity of installation. In addition to requiring the purchase of more materials for construction, installation of furring strips also requires special training and craftsmanship, such as for door and window area detail. In view of the foregoing, there is a need to provide a simplified system that has all of the advantages of the rain screen system, including high drainage efficiency, while reducing complexity of installation.

SUMMARY

In a first embodiment, the present disclosure provides a building system comprising: a first water resistant layer secured to a surface of a building substrate; a first building article comprising a front face, a rear face opposite the front face, and an edge member disposed contiguously between the front face and the rear face, wherein the edge member defines a first side of the first building article, wherein the first building article is secured to the first water resistant layer and the building substrate through the first weather resistant layer such that the rear face is in contact with the first water resistant layer; a second building article comprising a front face, a rear face opposite the front face, and an edge member disposed contiguously between the front face and the rear face, wherein the edge member defines a second side of the second building article, wherein the second building article is secured to the first water resistant layer and the building substrate through the first water resistant layer such that the rear face is in contact with the first water resistant layer; wherein the first and second building articles are secured to the first water resistant layer and the building substrate such that the first and second sides of the first and second building articles are positioned adjacent one another along an abutment line; and a second water resistant layer secured to portions of the front faces of the first and second building articles along the abutment line to prevent liquid from traveling past the first and second sides of the first and second building articles to the first water resistant layer and the building substrate.

In some embodiments, the first and second building articles comprise recessed portions extending along the first and second sides proximate to the abutment line, and wherein the second water resistant layer is positioned within the recessed portions of the first and second building articles. In some embodiments, the second water resistant layer comprises a thickness and the recessed portions of the first and second building articles each comprise a depth that is substantially equal to the thickness of the second water resistant layer such that, when the second water resistant layer is positioned within the recessed portions, a surface of the second water resistant layer is substantially planar with the front faces of the first and second building articles. In some embodiments, the recessed portions of the first and second building articles are tapered. In some embodiments, the second water resistant layer comprises a waterproof tape. In some embodiments, the building system further comprises a mesh layer secured to the front faces of the first and second building articles along the abutment line, wherein the mesh layer is positioned between the second water resistant layer and the front faces of the first and second building articles. In some embodiments, the second water resistant layer comprises a cementitious material. In some embodiments, the first water resistant layer comprises butyl tape. In some embodiments, the first water resistant layer is adhered to the building substrate. In some embodiments, the first and second building articles comprise fiber cement. In some embodiments, the first and second building articles each comprise a plurality of integrally formed drainage channels and a plurality of spacer sections disposed between the drainage channels, each of the plurality of drainage channels defining an air gap comprising a liquid flow path. In some embodiments, the plurality of integrally formed drainage channels and the plurality of spacer sections are disposed on the front faces of the first and second building articles.

In a second embodiment, the present disclosure provides a building system comprising: a building substrate; a first building article comprising a front face, a rear face opposite the front face, and an edge member disposed contiguously between the front face and the rear face, wherein the first building article is secured to the building substrate such that the rear face is positioned closer to the building substrate than the front face, and wherein at least one of the front and rear faces comprises a plurality of integrally formed drainage channels and a plurality of spacer sections disposed between the drainage channels, each of the plurality of drainage channels defining an air gap comprising a liquid flow path; a first building panel secured to the first building article and the building substrate such that the first building panel contacts the front face of the first building article; and a plurality of fasteners configured to secure the first building article and the first building panel to the building substrate.

In some embodiments, the plurality of drainage channels and the plurality of spacer sections are located on the front face of the first building article. In some embodiments, the first building article comprises fiber cement, and wherein the first building panel comprises fiber cement. In some embodiments, the building system further comprises: a second building article comprising a front face, a rear face opposite the front face, and an edge member disposed contiguously between the front face and the rear face, wherein the second building article is secured to the building substrate such that the rear face is positioned closer to the building substrate than the front face, and wherein at least one of the front and rear faces comprises a plurality of integrally formed drainage channels and a plurality of spacer sections disposed between the drainage channels, each of the plurality of drainage channels defining an air gap comprising a liquid flow path; and a second building panel secured to the second building article and the building substrate such that the second building panel contacts the front face of the second building article; wherein the plurality of fasteners are further configured to secure the second building article and the second building panel to the building substrate. In some embodiments, the first building panel comprises a first edge and the second building panel comprises a second edge, and wherein each of the first and second building panels are secured to a different one of the first and second building articles such that an express joint exists between the first and second edges of the first and second building panels. In some embodiments, the first building panel is an insulation panel. In some embodiments, the building system further comprises a mesh layer and a coating layer, wherein the insulation panel is positioned between the mesh layer and the first building article, and wherein the mesh layer is positioned between the coating layer and the insulation panel. In some embodiments, the building system further comprises a coating layer, wherein the insulation panel is positioned between the coating layer and the first and second building articles.

There is provided in one embodiment a cementitious building article comprising a front face and a rear face and an edge member intermediate to and contiguous to the front face and the rear face, wherein a plurality of drainage channels are integrally formed on the rear face of the cementitious building article.

In a further embodiment, there is provided a building system, comprising; a building substrate; a cementitious building article comprising a front face, a rear face and an edge member intermediate to and contiguous to the front face and the rear face, the rear face of the cementitious building article comprising a plurality of drainage channels integrally formed therein, wherein the cementitious building article is securable to the building substrate; and a weather resistant barrier locatable intermediate the building substrate and the cementitious building article such that the integrally formed drainage channels are adjacent the weather resistant barrier.

In one embodiment the cementitious building article is suitable for use as a cladding panel.

In another embodiment, a building system is described, wherein the building system comprises; a weather resistant barrier disposed external to a building substrate; and at least one wall cladding panel fixed to the weather resistant barrier and the building substrate such that the wall cladding panel is external to the weather resistant barrier, the at least one wall cladding panel comprising a substantially planar front face; a rear face comprising a plurality of substantially parallel drainage channels and a plurality of spacer sections disposed between the drainage channels; and an edge member disposed contiguously between the front face and the rear face.

In a further embodiment, the building system comprises a plurality of air gaps, each air gap being bounded by a portion of the weather resistant barrier and one of the drainage channels of the rear face. The configuration and arrangement of the air gaps along the wall cladding panel correspond to a preselected drainage efficiency wherein each air gap comprises a liquid flow path between the weather resistant barrier and the wall cladding panel. In one embodiment, the preselected drainage efficiency is greater than 90% when measured using ASTM E-2773.

It is to be understood that in certain embodiments, the configuration of each drainage channel, for example, the width and depth together with the frequency of drainage channels within the cementitious building article influences the configuration and arrangement of the air gaps along the wall cladding panel and consequently the drainage efficiency.

In another embodiment, a cementitious building article in the form of a wall cladding panel is described, wherein the wall cladding panel comprises a substantially planar front face, a rear face, and an edge member disposed contiguously between the front face and the rear face, the rear face comprises a plurality of substantially parallel drainage channels and a plurality of spacer sections disposed between the drainage channels, wherein the wall cladding panel has a first thickness at the spacer sections and wherein the thickness of the wall cladding panel at the drainage channels is smaller than the first thickness and wherein each drainage channel is configured to form a liquid flow path when a substantially planar building surface is placed adjacent to the rear face.

Conveniently, the cementitious building article or wall cladding panel is suitable for use in the building systems described herein.

In one embodiment, the configuration of the cementitious building article is such that the percentage of total surface area occupied by the plurality of drainage channels relative to the total surface area of the cementitious building article is between 18% and 75%±0.5%. In other embodiments, the percentage of total surface area occupied by the plurality of drainage channels relative to the total surface area of the cementitious building article may be between 18% and 50%±0.5%. In a further embodiment, the frequency of drainage channels in the plurality of drainage channels is between 8 and 16 drainage channels per lineal foot of the cementitious building article along a direction perpendicular to the orientation of the plurality of drainage channels. In some embodiments, the frequency of drainage channels in the plurality of drainage channels can be between 5 and 7 drainage channels per lineal foot of the cementitious building article along a direction perpendicular to the orientation of the plurality of drainage channels.

In one embodiment, the width of each drainage channel is substantially equivalent or greater than the depth of each drainage channel. In one embodiment, the ratio of the width of each drainage channel to the depth of each drainage channel is approximately 1:1. In a further embodiment, the ratio of the width of each drainage channel to the depth of each drainage channel is approximately 2:1. In other embodiments, the ratio of the width of each drainage channel to the depth of each drainage channel can be less than 2:1, or can be greater than 2:1, for example, 5:1, 8:1, 10:1 and so forth. In one embodiment, each drainage channel comprises a width of between approximately 0.5 mm (0.019 inches) and approximately 7.62 cm (3 inches). In a further embodiment, each drainage channel comprises a depth of between approximately 0.6 mm (0.023 inches) and approximately 5 mm (0.2 inches).

In one embodiment, the plurality of substantially parallel drainage channels are oriented vertically relative to ground level. In a further embodiment, the plurality of substantially parallel drainage channels are oriented horizontally relative to ground level. In another embodiment, the plurality of substantially parallel drainage channels are oriented at an angle between 0° and 90° relative to ground level.

In one embodiment two or more drainage channels are spaced apart from each other by a spacer section. In a further embodiment two or more drainage channels are grouped together in a group or series and each group or series of drainage channels are spaced apart from an each other by a spacer section. In one embodiment, the group or series of drainage channels comprise a series of six drainage channels grouped together. In a further embodiment the group or series of drainage channels comprises between two and six drainage channels within each group or series. In an alternate embodiment, the group or series of drainage channels comprises more than six drainage channels within each group or series. In one embodiment, each group of drainage channels is consistent from one group to the next group. In an alternate embodiment, the number of drainage channels within each group of drainage channels is variable between each group.

Conveniently, in a further embodiment, the or each drainage channel may comprise one or more of a triangular or v-shape, a squared or c-shape, a ribbed or an arcuate configuration. In yet another embodiment, the or each drainage channel may have a profile comprising a combination of more than one shape or configuration. In some aspects, a single cementitious building article may include drainage channels of different configurations.

In one embodiment, the arcuate configuration of each drainage channel can be such that the surface profile comprises at least a portion of a circle. In a further embodiment, the or each drainage channel has an arcuate configuration wherein the angle that is subtended by the arc is less than 180°. In a further embodiment, the squared or c-shape, or ribbed configuration of each drainage channel can be such that the surface profile comprises a base member parallel to the front face and two arms, each arm connecting the base member to a spacer section on the rear face of the of the cementitious building article. In a further embodiment of the invention the angle between the base member and arms of the c-shaped channel is approximately 90° forming a squared c-shaped channel. In a further embodiment, the angle between the base member and the arms of the c-shaped channel could be rounded, bevelled or chamfered to ease the angle from 90° to approximately 45°±20°. In one embodiment, the triangular or v-shape configuration of each drainage channel can be such that the surface profile comprises two side members which terminate at one end of the channel and extend outwardly therefrom forming a v-shape in cross-section.

In a further embodiment, the or each drainage channel may comprise a funneled configuration wherein the or each drainage channel is slightly widened at one or other or both ends of the drainage channel.

In one embodiment the wall cladding panel can comprise a single contiguous fiber cement substrate.

In one embodiment, the weather resistant material is in the form of synthetic material which provides a weather resistant barrier, such as, for example a building or house wrap.

In a further embodiment, the at least one wall cladding panel is fixed to the weather resistant barrier and the building substrate by one or more mechanical fasteners, each mechanical fastener extending through a spacer section of the rear face, the weather resistant barrier, and at least a portion of the building substrate.

In one embodiment, the building system comprises a plurality of wall cladding panels, each wall cladding panel being fixed to the weather resistant barrier and the building substrate.

In another embodiment, a method of mounting a wall cladding panel to a building substrate having a weather resistant barrier mounted thereon is described. The method comprises obtaining a first wall cladding panel comprising a substantially planar front face, a rear face comprising a plurality of substantially parallel drainage channels and a plurality of spacer sections disposed between the drainage channels, and an edge member disposed contiguously between the front face and the rear face, wherein each drainage channel is configured to form a liquid flow path when a substantially planar building surface is placed adjacent to the rear face. The method further comprises placing the first wall cladding panel adjacent to the building substrate such that the rear face is parallel to and abutting the weather resistant barrier, and fixing the first wall cladding panel through the weather resistant barrier to the building substrate to form a plurality of liquid flow paths, each liquid flow path comprising an air gap bounded by a portion of the weather resistant barrier and one of the drainage channels of the rear face.

Fixing the wall cladding panel through the weather resistant barrier to the building substrate can comprise driving one or more mechanical fasteners through the front face, a spacer section of the rear face, the weather resistant barrier, and at least a portion of the building substrate. The method can further comprise fixing a second wall cladding panel through the weather resistant barrier to the building substrate to form a plurality of liquid flow paths, the second wall cladding panel comprising a substantially planar front face and a rear face comprising a plurality of substantially parallel drainage channels, wherein the second wall cladding panel is disposed adjacent to and either above or below the first wall cladding panel, and at least one of the plurality of liquid flow paths formed by the second wall cladding panel is contiguous with one of the plurality of liquid flow paths formed by the first wall cladding panel.

One advantage of the cementitious building articles disclosed herein is that the design and position of the drainage channels allow the cementitious building article to be installed onto a structural building frame without the need for furring strips. The integrally formed drainage channels are designed to facilitate drainage and ventilation thereby providing a rain screen system which is easier and cheaper to install than current systems. The configuration and arrangement of the drainage channel are selected to improve the drainage efficiency while at the same time simplify installation process of the building article.

In some embodiments, the present disclosure provides an integrally waterproof fiber cement composite material that provides a high level of waterproofness comparable to equivalent fiber cement composite materials with additional waterproof membranes. Various embodiments of the integrally waterproof fiber cement composite material formulation incorporate a combination of predetermined quantities of silanol and silica fume which when reacted with other components of the formulation impart unexpectedly high waterproofness to the fiber cement composite material. Contrary to conventional understandings of water resistance in fiber cement, the formulation incorporates extremely small percentages of silanol and silica fume which unexpectedly provide better waterproof performance than formulations that include much higher percentages of silanol or silica fume. The integrally waterproof fiber cement composite material made in accordance with various formulations disclose herein meets or exceeds the criteria of ASTM D4068 hydrostatic pressure test (e.g., the ASTM D4068-17 version, revised in 2017) without applying any additional waterproof membranes. Hereinafter, the term "ASTM D4068 hydrostatic pressure test (e.g., the ASTM D4068-17 version, revised in 2017)" may be referred to as ASTM D4068 hydrostatic pressure test, ASTM D4068 hydrostatic test, ASTM D4068 test, or ASTM D4068 test for waterproofness without limitation.

In one embodiment, the integrally waterproof fiber cement composite material formulation comprises between 25% and 29% by weight of a cementitious binder; between 50% and 60% by weight of silica; between 6.5% and 7.5% by weight of cellulose fibers, between 2.5% and 3% by weight of alumina; between 5% and 6% by weight of a density modifier such as calcium silicate and/or perlite; and between 0.25% and 1% by weight of silica fume having a particle size smaller than 150 μm. The integrally waterproof fiber cement composite material formulation further comprises silanol having a dry weight less than 1% of the dry weight of the cellulose fibers. The silanol and cellulose fibers are pre-dispersed in a solution prior to mixing with the remaining components of the formulation. In some embodiments, the silanol in the pre-dispersed solution has a dry weight equal to approximately 0.5% of the dry weight of the cellulose fibers.

In some embodiments, the integrally waterproof fiber cement composite material formulation includes approximately 0.5% by weight of silica fume. In some embodiments, the integrally waterproof fiber cement composite material can be an interior board for a building structure or an exterior cladding such as siding. In some embodiments, the integrally waterproof fiber cement composite material is sufficiently waterproof to prevent droplet formation when exposed to hydrostatic pressure from a 2" wide×20" tall column of water for 48 hours. For example, the integrally waterproof fiber cement composite material may pass the ASTM D4068 hydrostatic pressure test (e.g., the ASTM D4068-17 version, revised in 2017).

In another embodiment, the integrally waterproof fiber cement composite material formulation comprises a cementitious hydraulic binder; silica; silica fume, wherein the silica fume comprises between 0.25% and 2% of the dry weight of the material formulation; and cellulose fibers, at least some of the cellulose fibers having surfaces that are at least partially treated with a sizing agent to make the surfaces hydrophobic. The dry weight of the sizing agent is between 0.25% and 2% of the weight of the cellulose fibers.

In some embodiments, the silica fume comprises approximately 0.5% of the dry weight of the material formulation. In some embodiments, the sizing agent comprises a silanol solution. In some embodiments, the silanol solution comprises a dispersant. In some embodiments, the dry weight of the sizing agent is approximately 0.5% of the weight of the cellulose fibers. In some embodiments, the integrally waterproof fiber cement composite material formulation further comprises a density modifier. In some embodiments, the density modifier comprises perlite and/or calcium silicate. In some embodiments, the integrally waterproof fiber cement composite material is sufficiently waterproof to prevent droplet formation when exposed to hydrostatic pressure from a 2" wide×20" tall column of water for 48 hours. For example, the integrally waterproof fiber cement composite material may pass the ASTM D4068 hydrostatic pressure test (e.g., the ASTM D4068-17 version, revised in 2017).

In other embodiments, a method of manufacturing an integrally waterproof fiber cement composite material comprises mixing cellulose fibers with a diluted silanol solution, wherein the silanol solution comprises an amount of silanol between 0.25% and 2% of the dry weight of the cellulose fibers; preparing a formulation comprising a cementitious hydraulic binder and silica; adding to the formulation the mixed cellulose fibers and silanol solution; adding to the formulation a relatively small quantity of silica fume, wherein the silica fume comprises between 0.25% and 2% of the dry weight of the formulation; and curing the formulation for a time sufficient to cause the material to set.

In some embodiments, the cellulose fibers are mixed with the silanol solution for between 1 and 10 minutes before being added to the formulation. In some embodiments, the silanol solution comprises a dispersant. In some embodiments, the formulation further comprises a density modifier comprising at least one of perlite and calcium silicate. In some embodiments, the method further comprises, prior to curing the formulation, forming the formulation into one or more substantially planar articles using a Hatschek process. In some embodiments, the substantially planar articles can be an interior board or an exterior cladding for a building structure.

In another embodiment, an integrally waterproof fiber cement composite material comprises between 35% and 39% by weight of a cementitious binder; between 40% and 50% by weight of silica; approximately 8.25% by weight of cellulose fibers, wherein the fibers have surfaces that are treated with a small amount of silanol in a diluted pre-dispersed solution, the silanol having a dry weight less than 1% of the dry weight of the cellulose fibers; approximately 3% by weight of alumina; between 5% and 6% by weight of a density modifier comprising at least one of calcium silicate and perlite; and between 0.25% and 1% by weight of silica fume having a particle size smaller than 150 μm.

In some embodiments, the silanol in the diluted pre-dispersed solution have a dry weight equal to approximately 0.5% of the dry weight of the cellulose fibers. In some embodiments, the integrally waterproof fiber cement composite material includes approximately 0.5% by weight of silica fume. In some embodiments, the integrally waterproof fiber cement composite material is an interior board or an exterior cladding. In some embodiments, the integrally waterproof fiber cement composite material is sufficiently waterproof to prevent droplet formation when exposed to hydrostatic pressure from a 2" wide×20" tall column of water for 48 hours and meets the criteria of the ASTM D4068 hydrostatic pressure test (e.g., the ASTM D4068-17 version, revised in 2017).

In some embodiments, the present disclosure provides various fiber cement composite articles that include counterfeit detection features including pigmented layers disposed between adjacent laminated layers of fiber cement material. The counterfeit detection features disclosed herein provide a number of advantageous and unexpected features. For example, the pigmented layers may be applied in solution in a liquid carrier without bleeding into the adjacent fiber cement layers, regardless of whether the pigment solution is applied to wet (uncured) or dry (cured) fiber cement. In another example unexpected advantage, the pigmented layers may be invisible at the edges of a fiber cement article when the article is cut by water jet cutting, but may be visible at the edges of the article when the article is cut by a saw.

In one embodiment, a fiber cement article comprises a first major face, a second major face opposite the first major face, and an intermediate portion disposed between the first major face and the second major face. The intermediate portion comprises a plurality of laminated layers of fiber cement, and one or more pigmented layers disposed between adjacent layers of the plurality of laminated layers, the one or more pigmented layers having a different color relative to the plurality of laminated layers. In some embodiments, the one or more pigmented layers comprise particles of a pigment having an average particle size smaller than approximately 50 micron. In some embodiments, the pigment has an average particle size of between approximately 1 micron and approximately 10 micron. In some embodiments, the pigment has an average particle size of between approximately 2.5 micron and approximately 7.5 micron. In some embodiments, the one or more pigmented layers comprise an inorganic pigment. In some embodiments, the inorganic pigment comprises at least one of an iron oxide, an aluminum oxide, a silicon oxide, or a titanium oxide. In some embodiments, the inorganic pigment comprises a red iron oxide. In some embodiments, the plurality of laminated layers of fiber cement each comprise a cementitious hydraulic binder, silica, cellulose fibers, and additives. In some embodiments, the plurality of laminated layers of fiber cement are integrally waterproof fiber cement comprising a cementitious hydraulic binder, silica, a pozzolanic material, and cellulose fibers. The pozzolanic material comprises between 0.25% and 2% of the dry weight of the integrally waterproof fiber cement. At least some of the cellulose fibers have surfaces that are at least partially treated with a hydrophobic agent to make the surfaces hydrophobic, wherein the dry weight of the hydrophobic agent is between 0.25% and 2% of the weight of the cellulose fibers. In some embodiments, the intermediate portion comprises at least three laminated layers of fiber cement and at least two pigmented layers, and one of the pigmented layers is disposed between each adjacent pair of laminated layers of fiber cement. In some embodiments, the one or more pigmented layers are visible along a cut edge of the fiber cement article when the fiber cement article is cut by a saw perpendicular to the first and second major faces, and the one or more pigmented layers are not visible along the cut edge of the fiber cement article when the fiber cement article is cut by a water jet perpendicular to the first and second major faces.

In another embodiment, a method of manufacturing a fiber cement article comprises forming a first laminate layer of cementitious slurry; applying a pigment suspension to a first surface of the first laminate layer, the pigment suspension comprising pigment solids suspended in a liquid carrier; forming a second laminate layer of cementitious slurry over the pigment suspension such that the pigment suspension is disposed between the first laminate layer and the second laminate layer; and curing the first and second laminate layers and the pigment suspension to form the fiber cement article comprising a cured pigmented layer disposed between two layers of cured fiber cement.

In some embodiments, the pigment suspension comprises an aqueous suspension including particles of a pigment having an average particle size smaller than 50 micron. In some embodiments, the pigment has an average particle size of between approximately 1 micron and approximately 10 micron. In some embodiments, the pigment has an average particle size of between approximately 2.5 micron and approximately 7.5 micron. In some embodiments, the pigment suspension comprises an inorganic pigment. In some embodiments, the inorganic comprises at least one of an iron oxide, an aluminum oxide, a silicon oxide, or a titanium oxide. In some embodiments, the inorganic pigment comprises a red iron oxide. In some embodiments, the first laminate layer and the second laminate layer are formed by first and second sequential passes over one or more sieve cylinders in a Hatschek process. In some embodiments, the pigment suspension is applied between the first and second sequential passes by depositing the pigment suspension onto a surface of the first laminate layer by one or more of a spray or a slot die, or by passing at least a portion of the first laminate layer through a container of the pigment suspension. In some embodiments, the method further comprises, prior to the curing, applying a second layer of the pigment suspension to a first surface of the second laminate layer, and forming a third laminate layer of cementitious slurry over the second layer of the pigment suspension such that the second layer of the pigment suspension is disposed between the second laminate layer and the third laminate layer. The curing simultaneously cures the first, second, and third laminate layers and the pigment suspension to form the fiber cement article comprising two cured pigmented layers alternately disposed between three layers of cured fiber cement.

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

Various embodiments of the fiber cement composite articles and building system will be described in greater detail below.

BRIEF DESCRIPTION OF THE DRAWINGS

FIG. 1A is a view of the rear face of a cementitious building article according to one embodiment showing one configuration of the drainage channels integrally formed therein.

FIG. 1B is an enlarged view of a section of the drainage channels of FIG. 1A.

FIG. 1C is a further enlarged view of a section of the drainage channels of FIG. 1A.

DETAILED DESCRIPTION

Figure 2:
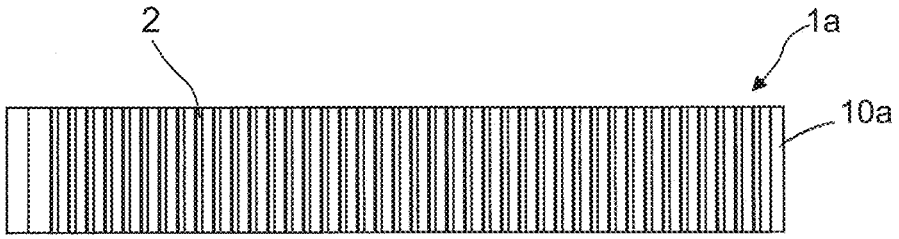
FIG. 2 is a sectional view of a portion of a rear face of one embodiment of the cementitious building article.

References will now be made to the drawings wherein like numerals refer to like parts throughout.

FIGS. 1A, 2, 3A, 3D-3J, 4A, 5A and 6A each show a cementitious building article 1, 1*a*, 3, 3*d*-3*j*, 5, 7, and 9 respectively. Referring specifically to FIG. 3A, cementitious building article 3 comprises a front face 8 and a rear face 10 and an edge member 12 intermediate to and contiguous to the front face 8 and the rear face 10, wherein the front face 8 has a substantially planar surface while the rear face 10 has a non-planar contoured surface. In one embodiment, a plurality of drainage channels 2 are integrally formed on the rear face 10 of the cementitious building article 3. Although not necessarily shown in each of FIGS. 1A, 2, 4A and 6A, it should be understood that each of the cementitious building articles 1, 1*a*, 3, 3*d*-3*j*, 5, 7 and 9 comprise a front face 8, a rear face 10 and an edge member 12 intermediate to and contiguous to the front face 8 and the rear face 10, wherein a plurality of drainage channels 2 are integrally formed on the rear face 10 of the cementitious building article, 1, 1*a*, 3, 3*d*-3*j*, 5, 7 and 9.

The configuration of the drainage channels 2 integrally formed on each of the cementitious building articles 1, 1*a*, 3, 3*d*-3*j*, 5, 7 and 9 is different and will be described in detail below. The configuration or shape of each channel 2 is such that liquid tension forces and capillary action forces are reduced or minimized to facilitate drainage of a liquid through the or each drainage channel and enhance the drainage efficiency of a cementitious building article attached directly to a planar surface of a building without additional furring strips disposed between the surface and the cementitious building article. Furthermore the configuration or shape of the channel 2 is optimized to facilitate circulation of air through each drainage channel 2.

In some embodiments, the cementitious building article 1, 1*a*, 3, 3*d*-3*j*, 5, 7, 9 comprises a plurality of drainage channels 2 which are configured to optimize drainage on the rear face 10 of the cementitious building article.

Referring initially to FIGS. 1A, 1B and 1C, the plurality of drainage channels 2 are in the form of a wave configuration on the rear face 10 of a cementitious building article 1. The wave configuration comprises a predetermined number of drainage channels 2 each with a predetermined configuration and dimension. In the configuration shown, a number of the drainage channels 2 are grouped together in a group or series 4 and each group 4 of drainage channels 2 are then spaced apart from an adjacent group 4 of drainage channels 2 by a spacer section 6. In one embodiment, the group or series of drainage channels 4 comprise a series of six drainage channels 2 grouped together. The group or series 4 of drainage channels 2 may also comprise more or less drainage channels 2 within each group or series as desired by the end user. In one embodiment each group 4 of drainage channels 2 is consistent from one group to the next group. In an alternate embodiment, each group 4 of drainage channels 2 is variable between each group. In the embodiment shown in FIGS. 1A-1C, each drainage channel 2 has a squared or c-shaped configuration 2*a*. In other embodiments, drainage channels 2 depicted in FIGS. 1A-1C may have any other configurations as described herein. For example, the drainage channels 2 may have a triangular, ribbed, or arcuate configuration, a square configuration with rounded, bevelled, or chamfered arms, or the like.

In the embodiment shown, the width and depth of each drainage channel 2 together with the frequency of drainage channels 2 within the group or series 4 and the distance separating each group or series 3 of drainage channels 2, is such that the percentage of total surface area occupied by the plurality of drainage channels 2 relative to the total surface area of the cementitious building article 1 is approximately 75%. In alternative embodiments, the width and depth of each drainage channel 2 together with the frequency of drainage channels 2 within the group or series 4 and the distance separating each group or series 3 of drainage channels 2 as depicted in FIGS. 1A-1C, is such that the percentage of total surface area occupied by the plurality of drainage channels 2 relative to the total surface area of the cementitious building article 1 is between 18% and 75%±0.5%. In a further embodiment, a greater portion of the total surface area of the rear face, such as up to approximately 80% of the total surface area of the rear face 10, may be occupied by drainage channels 2. In the embodiment shown in FIGS. 1A-1C, the frequency of drainage channels 2 in the plurality of drainage channels is between 8 and 16 drainage channels per lineal foot of the cementitious building article 1. In alternative embodiments the frequency of drainage channels 2 in the plurality of drainage channels may be more or less frequent, such as between 5 and 7 drainage channels per lineal foot, or up to 20 drainage channels per lineal foot along a direction perpendicular to the orientation of the plurality of drainage channels.

In one embodiment, the width 2*b* of each drainage channel 2 ranges between approximately 0.5 mm to 2.0 mm±0.1 mm. Conveniently the width of the group or series 4 of drainage channels 2 ranges between approximately 5.5 mm and 22.0 mm±0.1 mm. Referring specifically to the embodiment shown in FIG. 1A-1C, the width of each drainage channel 2 is approximately 0.5 mm±0.1 mm and the width of the group or series 4 of drainage channels 2 is approximately 5.5 mm±0.1 mm.

In one embodiment, the group or series 4 of drainage channels 2 are separated from the next group 4 of drainage channels 2 by a spacer section 6 comprising a width 6*a* of approximately 2.5 mm±0.1 mm. One of the advantages of this configuration of the drainage channels 2 integrally formed on the rear face 10 of the cementitious building article 1, is that it facilitates nailing of the cementitious building article 1 to a building substrate. Optionally, the end user can face nail the cementitious building article 1 to a building substrate through the spacer section 6. One advantage of certain embodiments is that the position and width of spacer section 6 is selected to accommodate spacing on a building substrate. In various embodiments, spacer sections 6 can be located between groups 4 of drainage channels 2 and/or may be located between individual drainage channels 2 where drainage channels 2 are organized individually rather than in groups 4. It is to be understood that the width 6*a* of spacer section 6 is variable and the minimum width 6*a* of the spacer section 6 is determined by the configuration of drainage channels 2.

In one embodiment, the depth of each drainage channel 2 ranges between 0.6 and 1.0 mm±0.1 mm. In a further embodiment, the depth of each drainage channel 2 is approximately 0.8 mm±0.1 mm. In other embodiments, the depth of each drainage channel 2 can be larger, such as up to approximately 2 mm, 3 mm, 4 mm, 5 mm, or more. Preferably, the depth of each drainage channel 2 should be limited so as to prevent excessive weakening of the flexural strength of the panel 1 and/or telegraphing of the configuration of the drainage channel 2 to the front face 8.

Figure 3A:
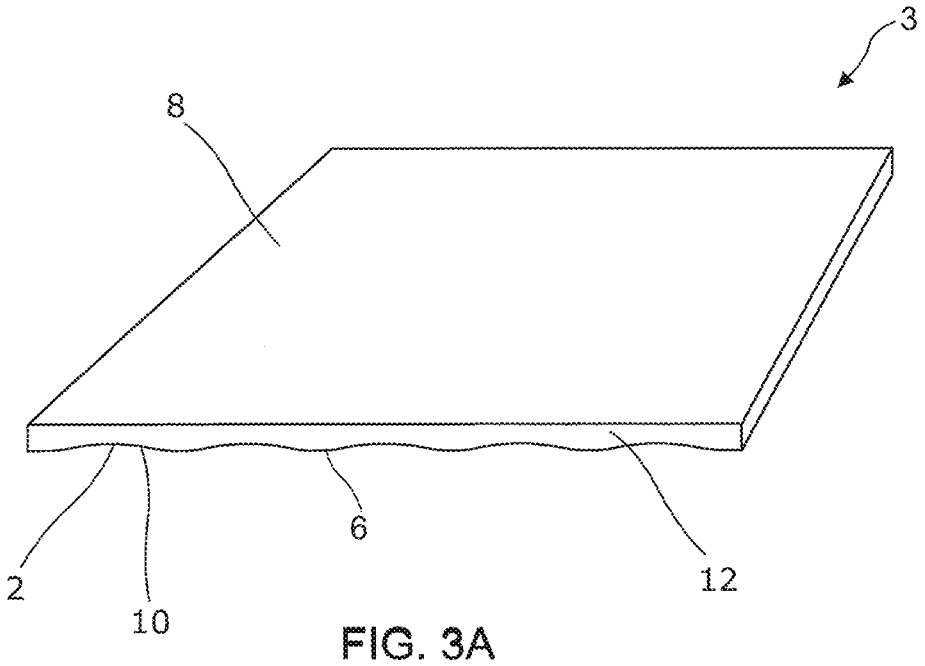
FIG. 3A is a perspective view of one embodiment of a cementitious building article.

FIG. 2 is a sectional view of a portion of a rear face 10*a* of a further embodiment of the cementitious building article disclosed herein. In this embodiment, the plurality of drainage channels 2 integrally formed on the rear face 10*a* of the cementitious building article 1*a* are configured such that the drainage channels 2 are in a continuous series on the rear face 10*a*. As described above with reference to FIGS. 1A-1C, the channels 2 can be any configuration described herein, such as a triangular configuration, a square configuration, a ribbed configuration, an arcuate configuration, and/or a funnel configuration. The channels 2 can be immediately adjacent, or each may be separated by a spacer section or interstice to facilitate fixing of the cementitious building article 1*a* to a building substrate.

Referring now to FIG. 3A, there is shown a perspective view of a cementitious building article 3 comprising a front face 8 and a rear face 10 and an edge member 12 intermediate to and contiguous to the front face 8 and the rear face 10. A plurality of drainage channels 2 are integrally formed on the rear face 10 of the cementitious building article 3 in the form of a wave configuration. In this embodiment, each drainage channel 2 has an arcuate configuration wherein the angle that is subtended by the arc is less than 180°. In the arcuate configuration, at least a portion of the cross-sectional profile of each drainage channel 2 comprises a portion of a circle, e.g., a circular arc. Similar to the embodiments described above with reference to FIGS. 1A-2, the drainage channels 2 in the arcuate configuration may be directly adjacent, or may be separated by a spacer section 6. For example, in the embodiment shown, each drainage channel 2 includes an arc approximately 3.81 cm (1.5") wide and approximately 4 mm-5 mm (0.15"-0.19") deep, with a spacer section 6 of approximately 1.27 cm (0.5") separating each pair of adjacent drainage channels 2.

In the example depicted in FIG. 3A, the spacer section 6 may be a gently curved spacer section 6 where the panel 3 is thicker than the surrounding regions of the panel such that the curved spacer section 6 is a suitable location to drive a mechanical fastener for securing the article 3 to a building substrate. In other embodiments, the channels 2 in an arcuate configuration may be separated by a substantially planar spacer section like spacer section 6 shown in FIGS. 1A and 1B.

Figure 3B:
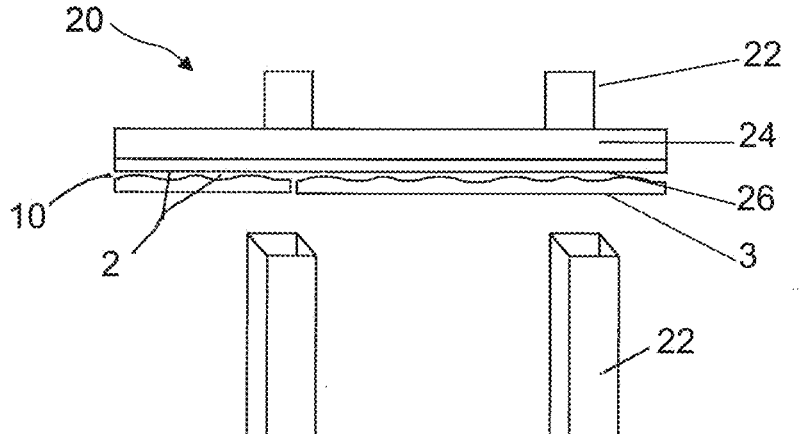
FIG. 3B is a top view of a section of one embodiment of a building system incorporating the cementitious building article of FIG. 3A.
Figure 3C:
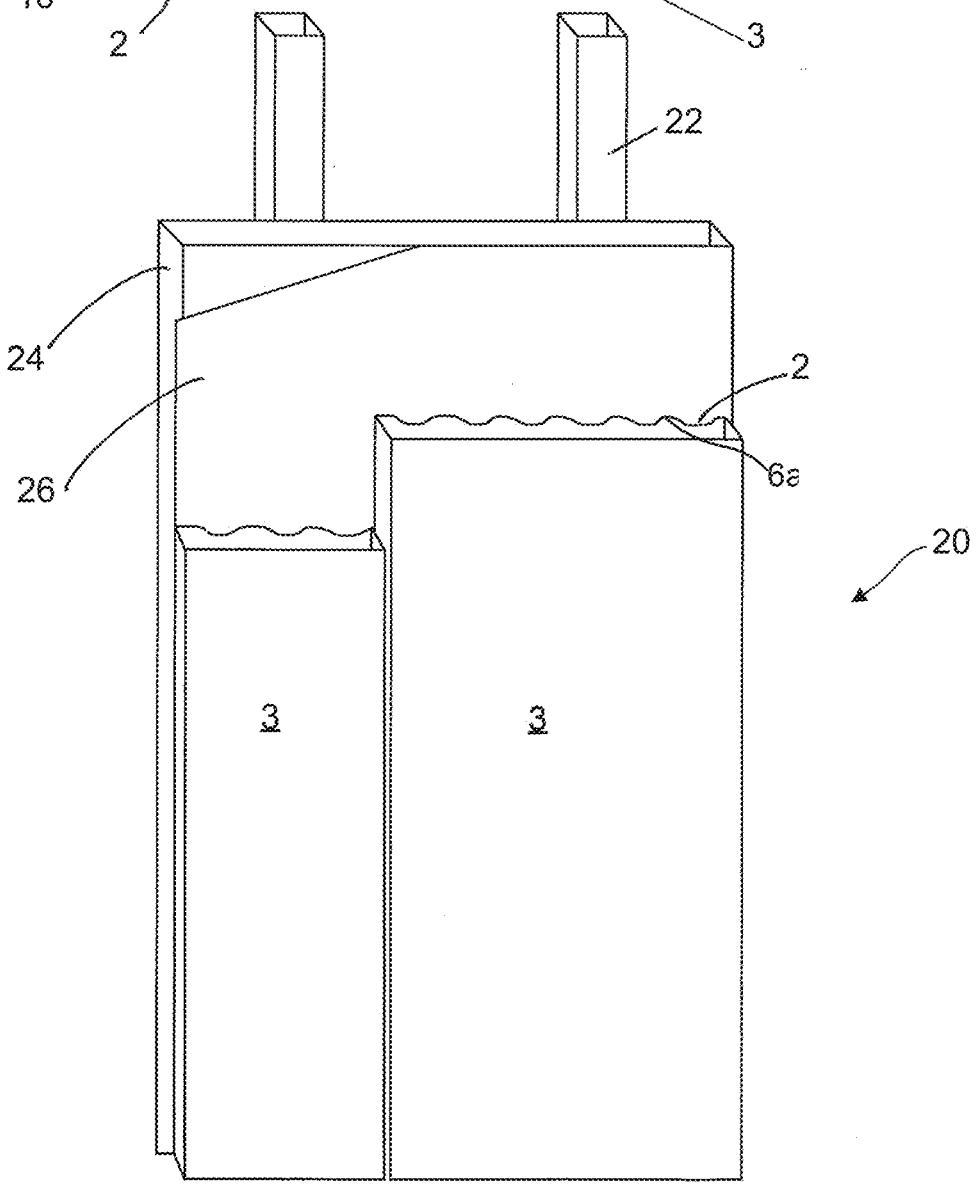
FIG. 3C is a partially cut-away sectional view of the building system of FIG. 3B.

FIGS. 3B and 3C are top and front views respectively of the cementitious building article 3 of FIG. 3A in use in a building system 20. Building system 20 comprises a building substrate 22, oriented strand board (OSB) 24, a weather resistant barrier or house wrap 26 and one or more cementitious building articles 3. In the embodiment of the building system 20 shown, OSB 24 is secured to the building substrate 22. It is to be understood that OSB is an optional feature of the building system 20. House wrap 26 is secured to the front surface of the OSB remote from the building substrate 22 such that the weather resistant barrier or house wrap 26 is locatable intermediate the building substrate 22 and the cementitious building article 3. The cementitious building article 3 is secured to the OSB layer 24 such that the integrally formed drainage channels are adjacent the weather resistant barrier or house wrap layer 26. The optional OSB 24 layer and cementitious building article 3 can be secured to the building substrate 22 using appropriate mechanical or chemical fasteners, for example, adhesives and/or nailing or screw fasteners. In a further embodiment (not shown), the house wrap 26 and one or more cementitious building articles 3 are attached directly to the building substrate 22.

Referring now to FIGS. 3D-3I, cross-sectional views are shown of various embodiments of the cementitious building articles described herein. Each of the building articles 3*d*-3*i* depicted in FIGS. 3D-3I includes a substantially planar front face 8*d*-8*i* and a non-planar rear face 10*d*-10*i* having a plurality of integrally formed drainage channels 2*d*-2*i* configured and arranged in a manner so as to provide various preselected drainage efficiencies. The building article 3*d* depicted in FIG. 3D has drainage channels 2*d* in a ribbed configuration, wherein adjacent channels 2*d* are separated by a spacer section 6*d*, and each channel 2*d* includes a substantially planar base 30*d* and two spaced apart sidewalls 34*d* extending from the base 30*d*. The sidewalls 34*d* are disposed at an angle relative to the base 30*d* and the spacer section 6*d* so as to define the sides of the drainage channel 2*d*. The junction between the sidewalls 34*d* and the base 30*d* can define a preselected angle. In the embodiment depicted, the angle is an obtuse angle between 90° and 180°, for example, 120°, 135°, 150°, or any other suitable angle. In some embodiments, an obtuse angle may enhance ease of manufacture and/or durability of the finished building article 3*d* due to the overhanging spacer section 6*d* that would be created by an acute angle. The upper surfaces of the spacer sections 6*d* extend in substantially the same plane such that when the rear face 10*d* of the building article 3*d* is placed adjacent to a building substrate or weather barrier, a trapezoidal air gap is formed by each drainage channel 2*d*.

Figure 3D:
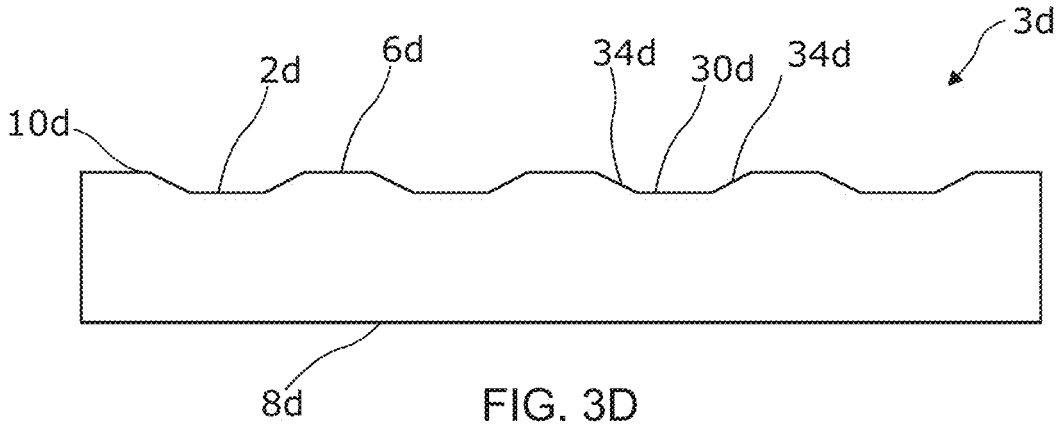
FIGS. 3D-3I are cross-sectional views of various embodiments of cementitious building articles.
Figure 3E:
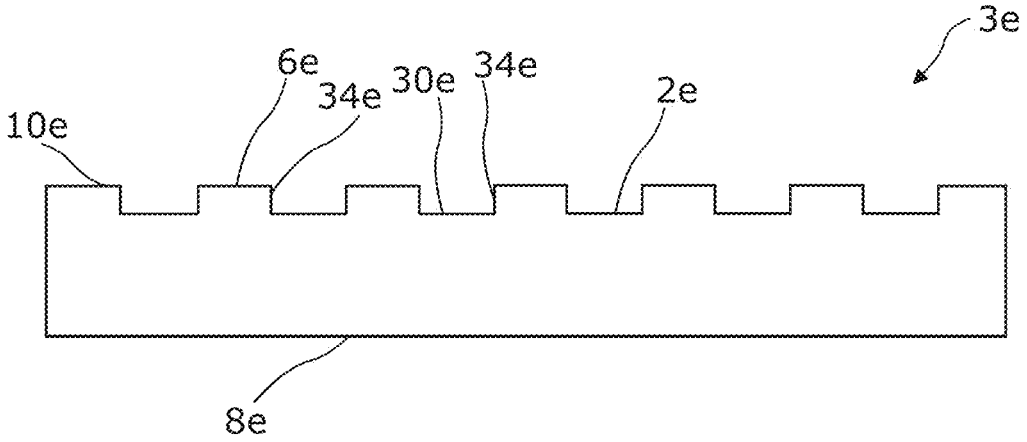

The building article 3*e* depicted in FIG. 3E has drainage channels 2*e* in a squared, or c-shaped, configuration. The drainage channels 2*e* of FIG. 3E are spaced apart by spacer sections 6*e*, and are defined by a substantially planar base 30*e* and two sidewalls 34*e* extending orthogonally from the base 30*e*. As shown in FIG. 3E, the sidewalls 34*e* are disposed substantially perpendicular to the base 30*e* and the spacer sections 6*e*, and the upper surfaces of the spacer sections 6*e* are co-planar. Thus, when the rear face 10*e* of the building article 3*e* is placed adjacent to a building substrate or weather barrier, a rectangular air gap is formed by each drainage channel 2*e*.

Figure 3F:
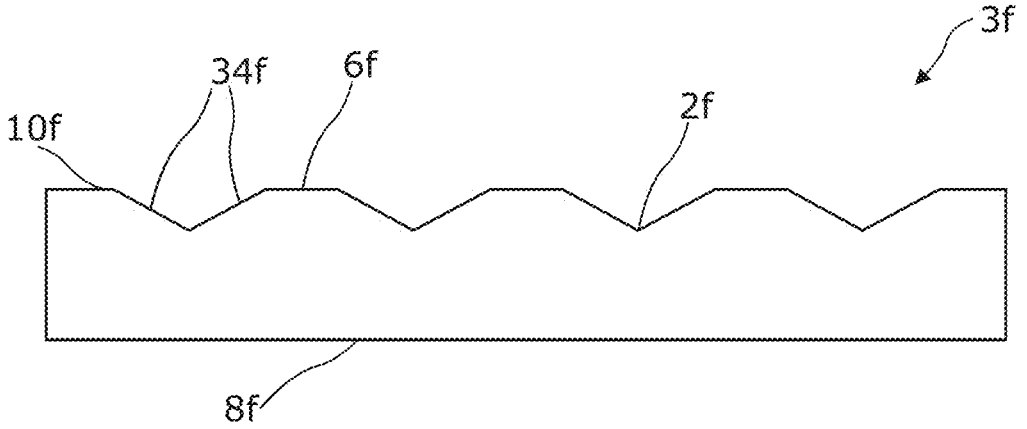

The building article 3*f* depicted in FIG. 3F has drainage channels 2*f* in a triangular, or v-shaped, configuration. In a triangular configuration, the drainage channels 2*f* are spaced apart by spacer sections 6*f* and each channel 2*f* is defined by two sidewalls 34*f*. The two sidewalls 34*f* defining each channel 2*f* extend at an angle relative to the substantially co-planar spacer sections 6*f* and meet at a point approximately halfway between the adjacent spacer sections 6*f*. Thus, when the rear face 10*f* of the building article 3*f* is placed adjacent to a building substrate or weather barrier, a triangular air gap is formed by each drainage channel 2*f*. The angle between each sidewall 34*f* and the adjoining spacer section 6*f* can be any angle between 90° and 180°, such as 120°, 135°, 150°, or any other obtuse angle. In practice, the angle and length of the arms 34*f* can be determined so as to provide drainage channels 2*f* of sufficient depth for efficient drainage, but not so deep as to compromise the strength of the building article 3*f*.

Figure 3G:
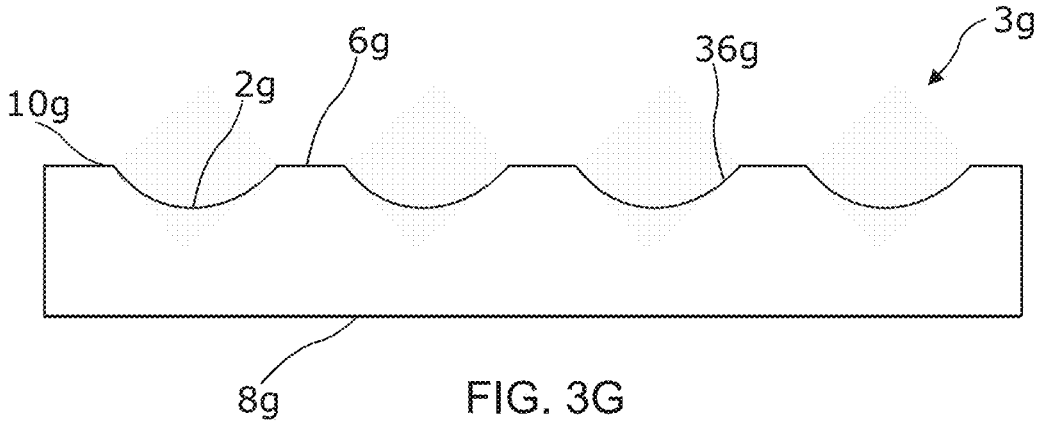

The building article 3*g* depicted in FIG. 3G has drainage channels 2*g* in an arcuate configuration. Similar to the configurations depicted in FIGS. 3D-3F, the building article 3*g* has drainage channels 2*g* separated by substantially co-planar spacer sections 6*g*. However, each drainage channel 2*g* is defined by a single curved channel surface 36*g* extending at an angle from each adjacent spacer section 6*g* in a substantially continuous curve. In various embodiments, the profile of the curved channel surface 36*g* can include a circular arc, a parabolic arc, a freeform curved profile, or any other suitable curved shape. Thus, when the rear face 10*g* of the building article 3*g* is placed adjacent to a building substrate or weather barrier, each drainage channel 2*g* can form an air gap with a profile of a circular segment or parabolic segment.

Figure 3H:
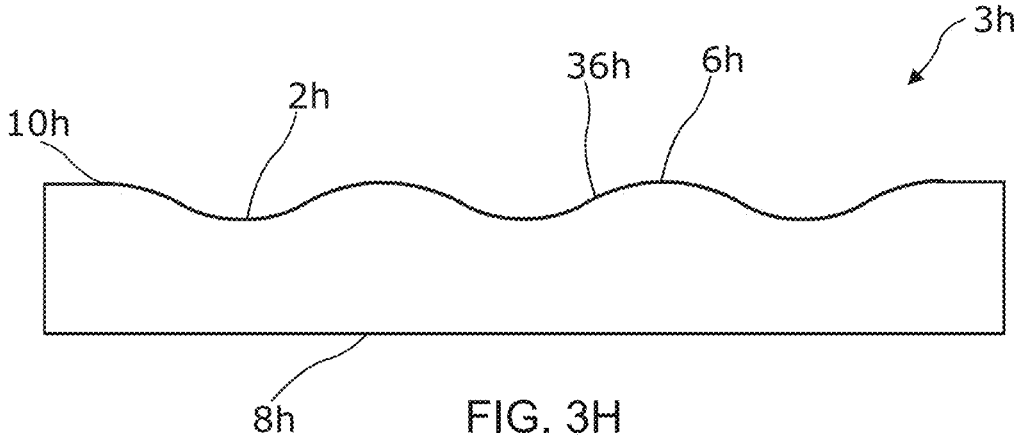

The building article 3*h* depicted in FIG. 3H has drainage channels 2*h* in an alternative arcuate configuration. Similar to the configuration depicted in FIG. 3G, the building article 3*h* has drainage channels 2*h* each defined by a single curved channel surface 36*h*. However, the spacer section 6*h* in the building article 3*h* of FIG. 3H is curved rather than substantially planar. Thus, the rear face 10*h* comprises a continuously curved profile. In some embodiments, the drainage channels 2*h* and spacer sections 6*h* of the rear face 10*h* may form a sinusoidal profile. In other embodiments, the spacer sections 6*h* and the drainage channels 2*h* may have different curvatures. For example, the average radius of curvature in the drainage channel 2*h* section of the rear face 10*h* may be smaller than the average radius of curvature in the spacer sections 6*h* such that a relatively deep drainage channel 2*h* is formed while the spacer section 6*h* has a gentler curve to facilitate coupling to a building substrate. Thus, when the rear face 10*h* of the building article 3*h* is placed adjacent to a building substrate or weather barrier, a bell-shaped air gap is formed by each drainage channel 2*h*.

Figure 3I:
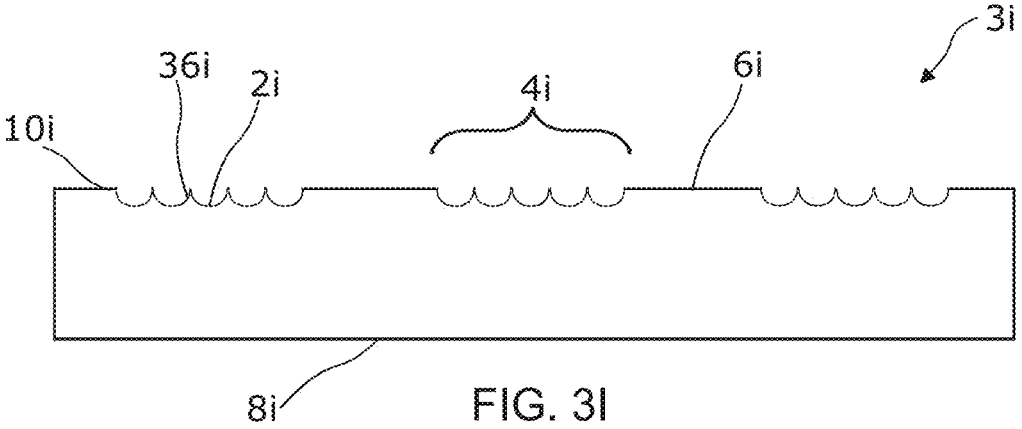

The building article 3*i* depicted in FIG. 3I has drainage channels in a wavy configuration similar to the configuration depicted in FIGS. 1A-1C. The building article 3*i* of FIG. 3I has a plurality of drainage channels 2*i*, each defined by a curved channel surface 36*i*. The drainage channels 2*i* are arranged in groups 4*i* of adjacent channels 2*i* with substantially co-planar spacer sections 6*i* disposed between adjacent groups 4*i* of channels 2*i*, rather than between each pair of channels 2*i*. The drainage channels 2*i* of a wavy or grouped channel configuration like the configuration depicted in FIG. 3I may be narrower than the channels 2*i* of the other configurations described herein. In some aspects, a group 4*i* of narrow drainage channels 2*i* may be advantageous by enhancing the longitudinal flow of water or other liquid along the channel 2*i* and preventing transverse flow, turbulent flow, or other disruption of the intended drainage flow. When the rear face 10*i* of the wavy configuration building article 3*i* is placed adjacent to a building substrate or weather barrier, each group 4*i* of drainage channels 2*i* forms a plurality of circular segment-shaped air gaps.

Various embodiments of the cementitious building articles described herein may have drainage channel configurations including any combination of sub-features described above with reference to FIGS. 3D-3I. For example, some drainage channels 2*d*-2*i* may have profiles including any combination of curved, angled, and/or linear edges. Moreover, any of the drainage channels 2*d*-2*i* depicted in a spaced configuration in FIGS. 3D-3H may equally be implemented in a grouped configuration with groups of adjacent channels 2*d*-2*i* separated by spacer sections 6*d*-6*i*.

Figure 3J:
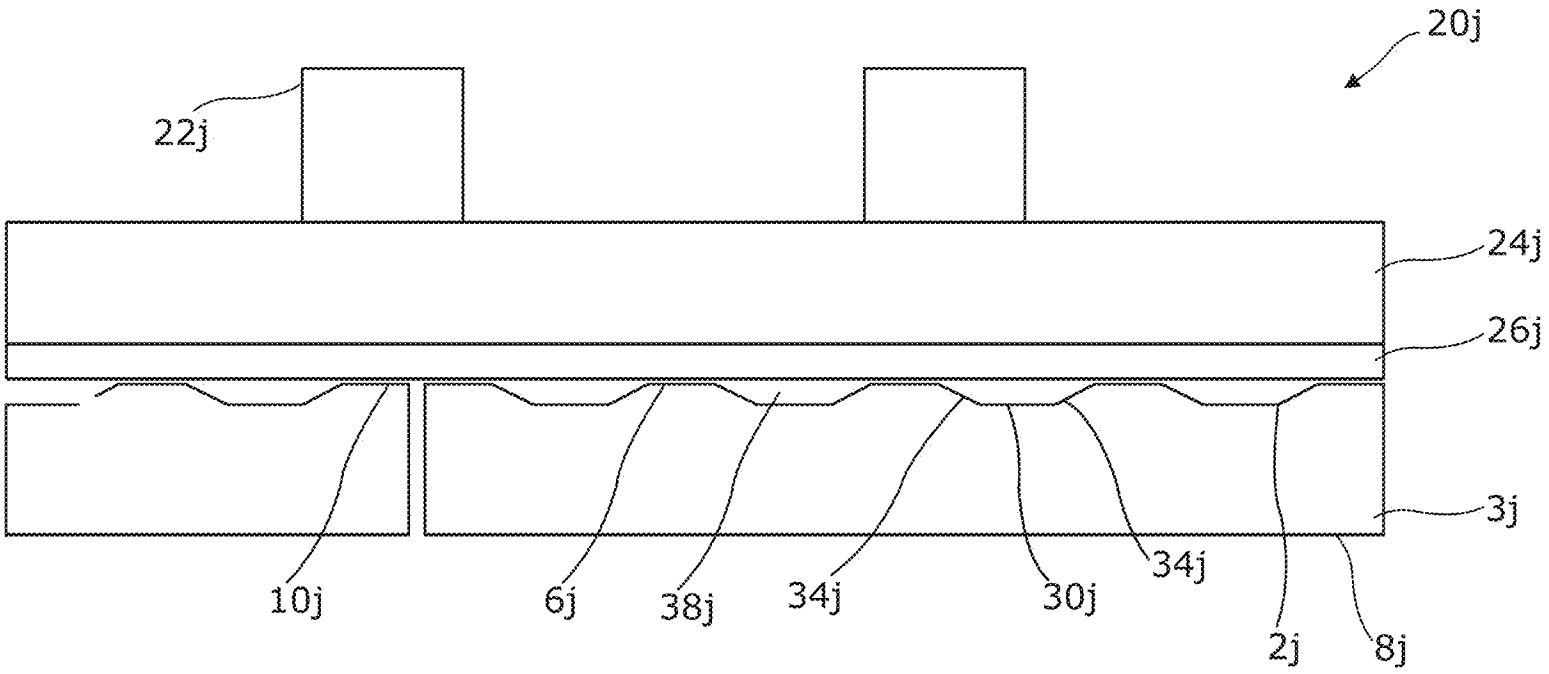
FIG. 3J is a top detail view of a section of one embodiment of a building system incorporating the cementitious building article of FIG. 3D.

FIG. 3J is a detail cross-sectional view of a cementitious building article 3*f* consistent with FIG. 3D in use in a building system 20*j*. Similar to the embodiments depicted in FIGS. 3B and 3C, the cementitious building article 3*j* comprises a plurality of drainage channels 2*j* in a spaced configuration, with each adjacent pair of drainage channels 2*j* separated by a substantially planar spacer section 6*j*. In the ribbed configuration depicted, each drainage channel 2*j* has a cross-sectional profile including a substantially planar base 30*j* and two sidewalls 34*j* disposed at opposing sides of the base 30*j*. Each sidewall 34*j* is disposed at an angle relative to the base 30*j* and the substantially co-planar spacer sections 6*j* such that the sidewall 34*j* forms a continuous surface with the base 30*j* and the adjoining spacer section 6*j*.

In the embodiment shown, spacer sections 6*j* further comprise the thickest portions of the building article 3*j*, because the bases 30*j* and sidewalls 34*j* of the drainage channels 2*j* form recesses within the rear face 10*j* of the building article 3*j*. Thus, when the rear face 10*j* is placed against the weather barrier 26*j* covering the OSB layer 24*j* and building substrate 22*j*, the substantially co-planar spacer sections 6*j* lies against the exterior surface of the weather barrier 26*j*. When the spacer sections 6*j* are positioned against the exterior surface of the weather barrier 26*j*, each drainage channel 2*j* forms an air gap 38*j* between the building article 3*j* and the weather barrier 26*j*. The air gap 38*j* extends the length of each drainage channel 2*j* along the surface of the building article 3*j*. The air gap 38*j* can also serve as a fluid flow path, for example, to facilitate the drainage of water or other liquids. Accordingly, the building articles may be mounted to a building substrate 22*j* or OSB layer 24*j* such that the drainage channels 2*j* and associated air gaps 38*j* are oriented vertically with respect to the building and the ground. In such a configuration, gravity can further facilitate the drainage of liquids through the air gap 38*j* for improved drainage efficiency.

Although the building article 3*j* depicted in FIG. 3J has the ribbed configuration depicted in FIG. 3B, the building article 3*j* may equally have any of the drainage channel configurations depicted and described herein. In one embodiment, the building article 3*j* of FIG. 3J has the squared or c-shaped drainage channel configuration depicted in FIG. 3E. In one embodiment, the building article 3*j* of FIG. 3J has the triangular or v-shaped drainage channel configuration depicted in FIG. 3F. In one embodiment, the building article 3*j* of FIG. 3J has the arcuate drainage channel configuration depicted in FIG. 3G. In one embodiment, the building article 3*j* of FIG. 3J has the continuously curved arcuate drainage channel configuration depicted in FIG. 3H. In one embodiment, the building article 3*j* of FIG. 3J has the grouped drainage channel configuration depicted in FIG. 3I.

Referring jointly to FIGS. 3A-3J, the drainage efficiency of a building article 3, 3*d*-3*j* installed in a building system 20, 20*j* can depend, at least in part, on the cross-sectional area of the fluid flow path provided by the air gap 38*j* defined by the weather barrier 26, 26*j* and each drainage channel 2, 2*d*-2*j*. Accordingly, the dimensions of the spacer sections 6, 6*d*-6*j*, bases 30, sidewalls 34*d*-34*f*, and curved channel surfaces 36*g*-36*i* of the various embodiments depicted can be selected so as to provide for an air gap 38*j* having a desired cross-sectional area. For example, the cross-sectional area A of the trapezoidal air gap 38*j* depicted in FIG. 3J can be calculated by the equation $A=\frac{1}{2}(d)(a+b)$, where d is the depth of the channel 2*j* between the weather barrier 26*j* and the base 30*j*, a is the length of the base 30*j*, and *b* is the length of the portion of the weather barrier 26*j* that forms a boundary of the air gap 38*j*. In another example, if the building article 3*j* of FIG. 3J has a squared drainage channel configuration, the cross-sectional area A of the air gap 38*j* can be calculated by $A=d\times a$, where d is the depth of the channel 2*j* between the weather barrier 26*j* and the base 30*j*, and a is the length of the base 30*j*. In a third example, if the building article 3*j* of FIG. 3J has a triangular drainage channel configuration as depicted in FIG. 3F, the cross-sectional area A of the air gap 38*j* can be calculated by $A=\frac{1}{2}(d\times b)$, where d is the depth of the channel 2*j* between the weather barrier 26*j* and the intersection point between the two sidewalls 34*j*, and *b* is the length of the portion of the weather barrier that forms a boundary of the air gap 38*j*. In yet another example, if the building article 3*j* of FIG. 3J has a circular arcuate configuration as depicted in FIG. 3G, the cross-sectional area A of the air gap 38*j* can be calculated by $A=\frac{1}{2}R2(\theta-\sin\theta)$, where R is the radius of the circle that includes the curved channel surface, and θ is the central angle of the circle subtending the arc length of the curved channel surface.

Although only a section of the building substrate is shown, it is to be understood that the cementitious building articles 3, 3*j* can be arranged in series in one or more directions to cover or clad either a required area on the building substrate or the entire building. When a plurality of cementitious building articles 3, 3*j* are arranged vertically in series, it will be appreciated that one or more drainage channels 2, 2*j* of each building article 3, 3*j* may align such that a contiguous liquid flow path is formed extending along the vertical length of the multiple building articles 3, 3*j*. Such alignment may be advantageous in allowing water or other liquid to drain from an article 3, 3*j* mounted relatively high on a wall, to the ground and away from the building to which the articles 3, 3*j* are mounted.

In the embodiments shown, each of cementitious building articles 3, 3*j* are oriented such that drainage channels 2, 2*j* extend substantially vertically relative to ground level. It is to be understood that although this is a preferred orientation of the cementitious building articles, the cementitious building articles are not limited to this particular orientation and other orientations as determined by the end user are also possible. For example, drainage channels 2, 2*j* may extend horizontally or at any angle between vertical and horizontal relative to ground level.

One of the advantages of this building system is that the cementitious building article 3, 3*j* can be secured to a building substrate 22, 22*j* without the use of furring strips. The drainage channels 2, 2*j* on the rear face 10, 10*j* of the cementitious building article 3, 3*j* are configured to form a capillary break and air gap to facilitate drainage and moisture management between the cementitious building article 3, 3*j* and the building substrate 22, 22*j* and/or OSB layer 24, 24*j*. The drainage efficiency of the building system without furring strips may be similar or equal to the drainage efficiency of pre-existing rain screen systems with furring strips. However, it is also possible to use furring strips if so desired with any one of the cementitious building articles and/or building systems described herein.

In a further embodiment of the present disclosure, screening devices are optionally used at one or more opposing ends of a drainage channel to prevent debris or insects from entering and blocking the drainage channel. In various embodiments, the depth and/or width of the drainage channels 2, 2*j* may be small enough that a screening device may not be necessary.

It will be appreciated that the building systems 20, 20*j* depicted in FIGS. 3B, 3C, and 3J can equally be implemented with any of the other cementitious building articles depicted and described elsewhere herein, including but not limited to building articles 1, 1*a*, 5, 7, 9. Moreover, any of the channel configurations described herein can be included in the building systems described herein, including but not limited to building systems 20, 20*j*. For example, the rear face 10, 10*j* of building articles 3, 3*j* fixed to the building substrate 22, 22*j* in building system 20, 20*j* can include drainage channels in a triangular configuration, a square configuration, a ribbed configuration, a funnel configuration, and/or any combination thereof.

In a further embodiment, it is possible for the front face 8, 8*d*-8*j* of the cementitious building article 1, 1*a*, 3, 3*d*-3*j*, 5, 7, 9 to comprise a variety of styles or shapes, including profiled or embossed faces. For example, the front face 8, 8*d*-8*j* may be embossed with a pattern resembling wood grain or any other desired texture to enhance the appearance of the exterior of a building. The front face 8, 8*d*-8*j* may further be painted and/or primed for painting by a user.

In one embodiment, the cementitious building article 1, 1*a*, 3, 3*d*-3*j*, 5, 7, 9 is a fiber cement building article wherein the fiber cement building article comprises cellulose fibers, hydraulic binders, silica and water. Optionally the fiber cement building article 1, 1*a*, 3, 3*d*-3*j*, 5, 7, 9 further comprises other additives, for example density modifiers. In one embodiment, the fiber cement building article 1, 1*a*, 3, 3*d*-3*j*, 5, 7, 9 comprises a fiber cement panel having a front face 8, 8*d*-8*j* and a rear face 10, 10*d*-10*j* and an edge member 12 intermediate to and contiguous to the front face 8, 8*d*-8*j* and the rear face 10, 10*d*-10*j*, wherein the distance between the front face 8, 8*d*-8*j* and the rear face 10, 10*d*-10*j* comprises at least 0.8 mm±0.5 mm. In one embodiment, the distance between the front face 8, 8*d*-8*j* and the rear face 10, 10*d*-10*j* at the spacer sections is approximately 7.62 cm (0.3"). In one embodiment, the building article 1, 1*a*, 3, 3*d*-3*j*, 5, 7, 9 is approximately 1.2 m (4 feet) wide and includes 22 channels. It is understood that the building article is not limited to this specific size. In one embodiment, the fiber cement building article is formed by thin overlaying substrate layers using the Hatschek process. In one embodiment, the cementitious building article 1, 1*a*, 3, 3*d*-3*j*, 5, 7, 9 comprises, by way of non-limiting example, any of the compositions described herein in the Example Fiber Cement Composite Material Compositions and/or Composition and Manufacturing of Counterfeit Detection Features portions of the present disclosure.

Figure 4C:
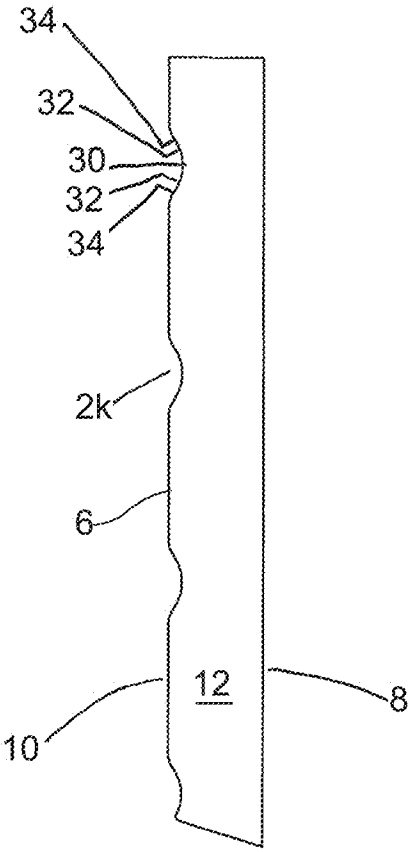
FIG. 4C is an enlarged side view of a section of the cementitious building article of FIG. 4A.
Figure 4B:
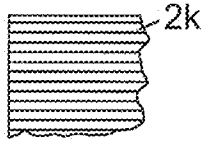
FIG. 4B is an enlarged view of section A-A of FIG. 4A.
Figure 4A:
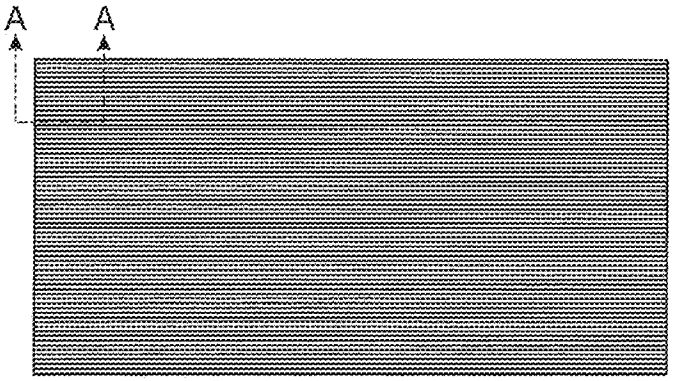
FIG. 4A is a view of the rear face of a further embodiment of the cementitious building article.

In FIGS. 4A, 4B and 4C, there is shown an example of a cementitious building article 5, wherein the drainage channels 2*k* comprise a ribbed configuration similar to the configuration shown in FIG. 3D, however in this embodiment the cross-section channel surface profile appears substantially curved. Drainage channel 2*k* comprises a base 30 and two sidewalls 34, wherein the base 30 comprises a planar section and two angled sections 32. Arms 34 of the ribbed channel configuration project from opposing sides of the base member 30. Each angled section 32 extends outwardly from the base member such that each angled section 32 is positioned between the base member and arms. A base member may be substantially planar having a planar base member 30 with angled sections 32 at the ends of the base member 30. Each arm 34 extends from an end of a base member 30 to connect the base member 30 to an edge of the adjacent spacer section 6. In some embodiments of the ribbed configuration, drainage channels 2*k* may be adjacent to each other without spacer sections 6.

In a further embodiment, it is possible for the front face 8 of the cementitious building article to comprise a variety of styles or shapes, including profiled or embossed faces. For example, the front face 8 may be embossed with a pattern resembling wood grain or any other desired texture to enhance the appearance of the exterior of a building. The front face 8 may further be painted and/or primed for painting by a user.

In a further embodiment, at least one or more faces of the cementitious building articles 1, 1*a*, 3, 3*d*-3*j*, 5, 7, 9 further comprise a coating agent. In one embodiment, the or each drainage channel 2, 2*d*-2*k* are coated to further assist drainage action and the capillary break functionality of the or each drainage channel. For example, a coating agent may provide a smoother surface than an uncoated cementitious building article, so as to further facilitate the flow of water or any other liquid along the surface of the cementitious building article 5. Enhanced flow of water along the surface of the building article can further enhance the drainage efficiency of the cementitious building article 5.

In a further embodiment, the cementitious building article 5 is a primed or painted cementitious building article ready for installation on a building structural substrate.

In one embodiment, the cementitious building article is a fiber cement building article wherein the fiber cement building article comprises cellulose fibers, hydraulic binders, silica and water. Optionally, the fiber cement building article further comprises other additives, for example density modifiers. In one embodiment, the fiber cement building article comprises a fiber cement panel having a front face and a rear face and an edge member intermediate to and contiguous to the front face and the rear face wherein the distance between the front face and the rear face comprises at least 0.8 mm±0.5 mm. In one embodiment, the fiber cement building article is formed by thin overlaying substrate layers using the Hatschek process. In one embodiment, the cementitious building article comprises, by way of non-limiting example, any of the compositions described herein in the Example Fiber Cement Composite Material Compositions and/or Composition and Manufacturing of Counterfeit Detection Features portions of the present disclosure.

Figure 5A:
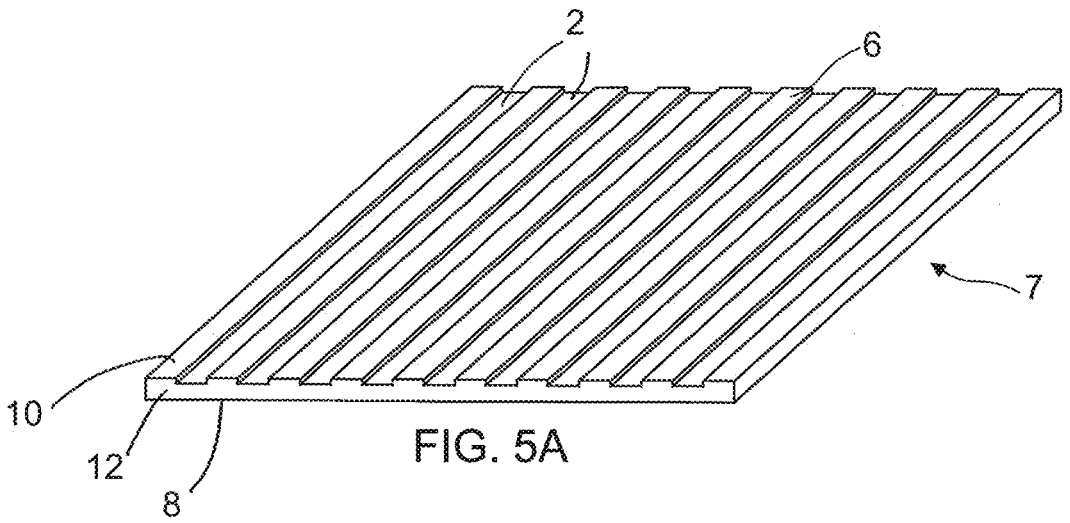
FIG. 5A is view of the rear face of a further embodiment of the cementitious building article.
Figure 5B:
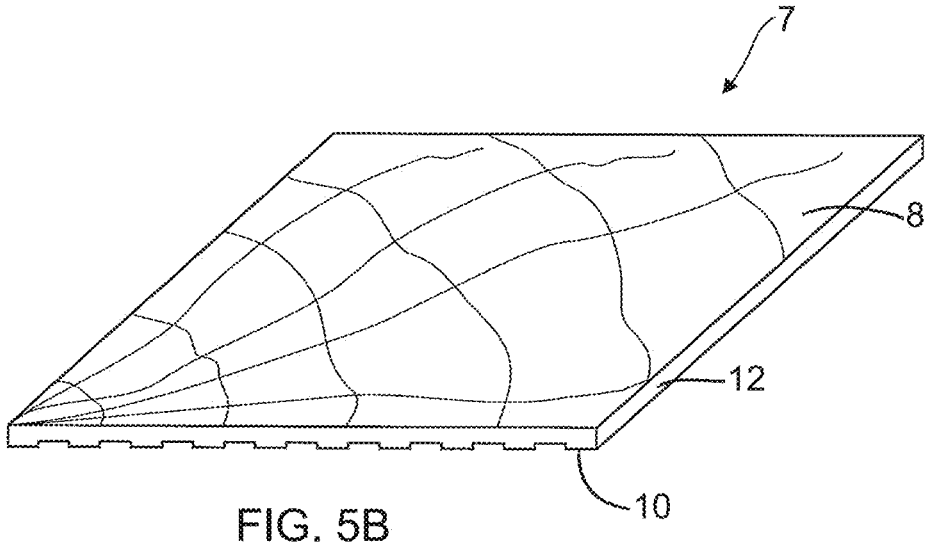
FIG. 5B is a view of the front face of the embodiment of the cementitious building article shown in FIG. 5A.

Referring now to FIGS. 5A and 5B, an example of a fiber cement building article 7 is shown wherein a plurality of squared or c-shaped drainage channels 2 are integrally formed on the rear face 10 of cementitious building article 7. Front face 8 of fiber cement building article 7 is flat and smooth. In various embodiments, front face 8 may also be textured, profiled, embossed, primed, painted, or otherwise prepared to form an exterior surface of a building. In some embodiments, portions of the fiber cement building article 7 between squared drainage channels 2 form spacer sections 6. Spacer sections 6 may advantageously accommodate a mechanical fastener for mounting to a building substrate to form a wall section such as the wall section of the building system 20, 20*j* depicted in FIGS. 3B, 3C, and 3J.

Figure 6A:
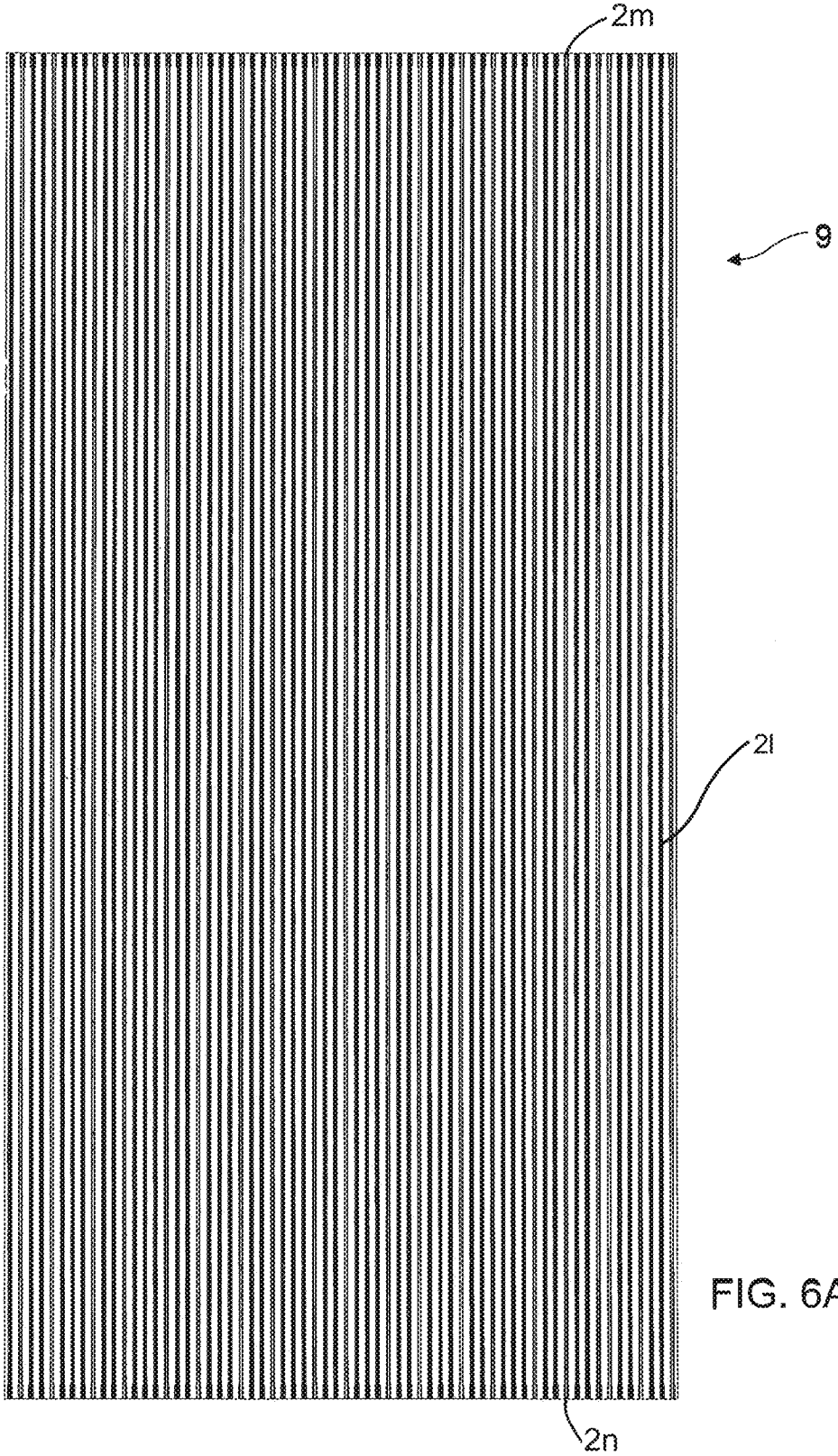
FIG. 6A is a view of the rear face of a further embodiment of the cementitious building article.
Figure 6B:
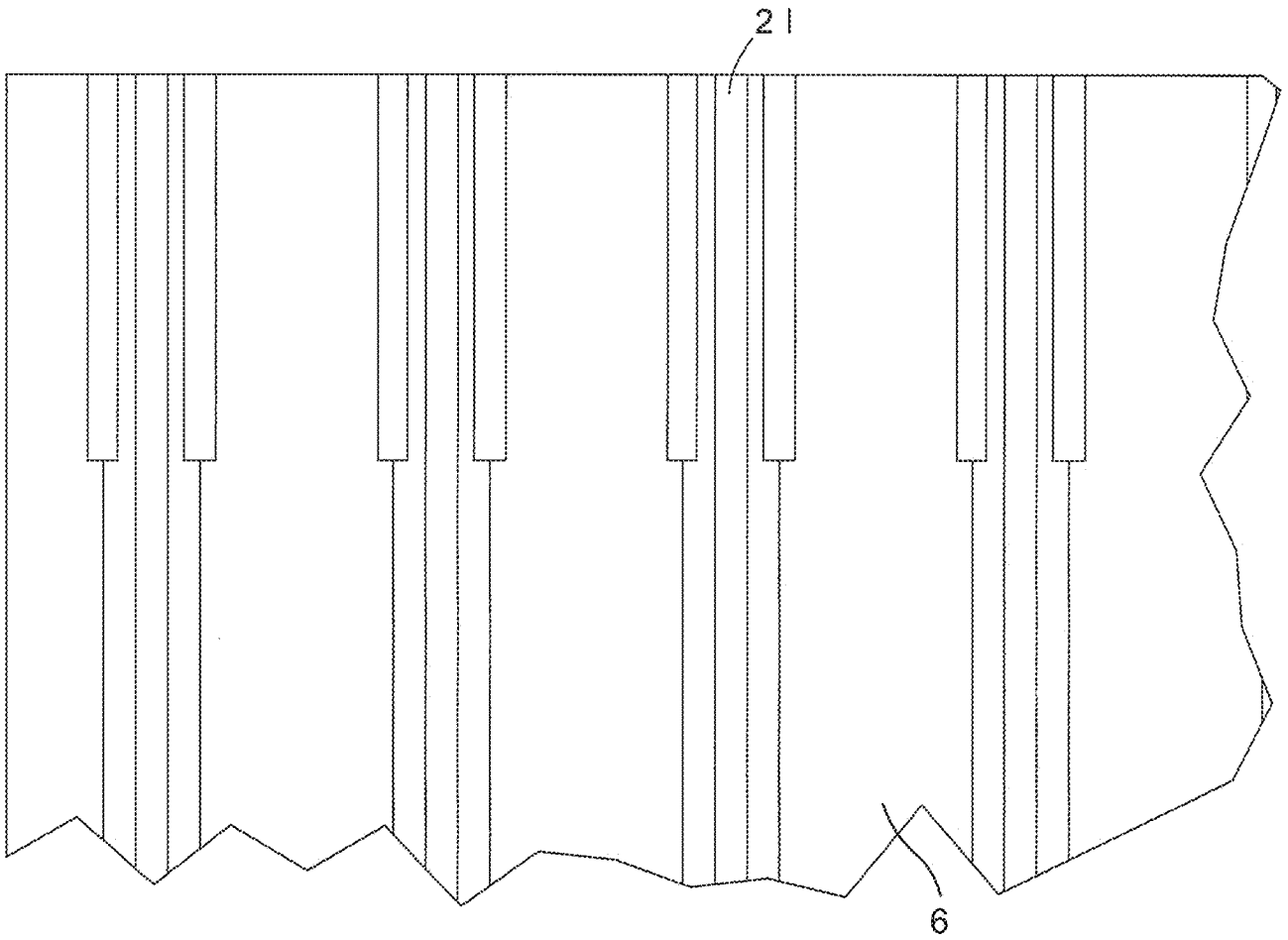
FIG. 6B is an enlarged view of a section of the rear face of FIG. 6A.

Referring now to FIGS. 6A and 6B, a further embodiment of a cementitious building article 9 comprises drainage channels 2*l* having a funneled configuration wherein the, or each, drainage channel is slightly widened at both ends 2*m*, 2*n* of the drainage channel 2*l*. Accordingly, the width of the spacer section 6 may be narrower between ends 2*m*, 2*n* of the drainage channel 2*l*. It will be appreciated that the funneled configuration depicted in FIGS. 6A and 6B may be implemented with any of the embodiments described and/or depicted herein. For example, any of cementitious building articles 1, 1*a*, 3, 3*d*-3*j*, 5, 7 as depicted in FIGS. 1A-5B may be implemented such that the ends of the or each drainage channel is wider than the remaining portion of the or each drainage channel, such as to facilitate liquid flow into or out of each drainage channel. Funneled drainage channels 2*l* may further have any configuration described herein, for example, a triangular, squared, arcuate and/or ribbed cross-sectional profile as depicted elsewhere herein.

Advantageously, referring now to all embodiments depicted in FIGS. 1A-6B, the dimensions of the or each drainage channel 2, 2*d*-2*l* integrally formed on the rear face 10 of the fiber cement building article 1, 1*a*, 3, 3*d*-3*j*, 5, 7, 9 are such that the depth of the, or each, drainage channel 2, 2*d*-2*l* enables production of a fiber cement building article 1, 1*a*, 3, 3*d*-3*j*, 5, 7, 9 comprising integrally formed drainage channels 2, 2*d*-2*l* without the occurrence of telegraphing through to the front face 8 of the fiber cement building article 1, 1*a*, 3, 3*d*-3*j*, 5, 7, 9 whilst the or each drainage channel 2, 2*d*-2*l* functions to provide drainage and capillary break.

In a further embodiment, there is provided a method of manufacturing a fiber cement composite article, the method comprising the steps of: (a) providing a fiber cement green sheet comprising a front face and a rear face and an edge member intermediate to and contiguous to the front face and the rear face; (b) forming a non-planar surface on the rear face of the fiber cement green sheet, said non-planar surface configured to form a plurality of drain channels; and (c) curing the fiber cement green sheet to form a fiber cement building article comprising drainage channels integrally formed on the rear face of the fiber cement building article.

In a further embodiment, the drainage channels formed at step (b) are integrally formed on the rear face of the fiber cement green sheet using one or more of the following techniques, rolling, embossing, pressing, cutting or other suitable techniques known to the person skilled in the art.

In one embodiment, the method of manufacturing a fiber cement building article optionally comprises the further step of profiling or embossing the front face of the fiber cement building article. Optionally, the drainage channels integrally formed on the rear face of a fiber cement building article comprising a profiled or embossed front face at step (b) of the method are formed to a greater depth than required after curing to accommodate any loss of depth that may occur in the or each drainage channel during the step of profiling or embossing the front face of the fiber cement building article.

In a further embodiment, the method of manufacturing a fiber cement building article optionally comprises the further step (d) coating one or more of the plurality of drainage channels integrally formed on the rear face of the fiber cement building article.

EXAMPLES

Drainage Testing

A series of drainage efficiency tests were carried out in accordance with the ASTM E2273 standard test method for determining the drainage efficiency of exterior insulation and finish systems (EIFS) clad wall assemblies. As described elsewhere herein, drainage efficiency can be a significant consideration in determining the adequacy of a rain screen system. For example, because existing rain screen systems with furring strips can provide over 90% drainage efficiency, it may be desirable for the cementitious building articles described herein to similarly be capable of providing drainage efficiency greater than 90% without the use of furring strips.

The control samples comprised a fiber cement panel which had no drainage channels integrally formed on the rear face of the sample in accordance with embodiments of the present disclosure. The drainage efficiency was measured on control samples which had coated and uncoated rear surfaces. The coating that was used was a primer solution.

Samples of an equivalent fiber cement panel to that of the control comprising drainage channels integrally formed on the rear face of the sample in accordance with embodiments of the present disclosure were prepared. Sample A comprised fiber cement panels having drainage channels with an arcuate configuration formed therein similar to the configuration shown in FIG. 3G whilst Sample B comprised fiber cement panels having drainage channels with a v-shaped or triangular configuration formed therein similar to the configuration shown in FIG. 3F. The drainage efficiency of samples A and B were measured wherein the drainage channels integrally formed on the rear face were (a) coated with a primer solution and (b) uncoated. The results of the drainage efficiency tests are presented below in Table 1.

TABLE 1

Results of drainage efficiency tests of example cementitious building articles described herein.

| | Control % Drainage Efficiency | Sample A % Drainage Efficiency | Sample B % Drainage Efficiency |
|---|---|---|---|
| Uncoated 1 | 70.1 | 90.3 | 90.9 |
| Uncoated 2 | 73.3 | 90.6 | 91.4 |
| Uncoated 3 | 71.8 | 90.5 | 90.7 |
| Average | 71.73 | 90.47 | 91.00 |

TABLE 1-continued

Results of drainage efficiency tests of example cementitious building articles described herein.

| | Control % Drainage Efficiency | Sample A % Drainage Efficiency | Sample B % Drainage Efficiency |
|---|---|---|---|
| % Drainage Efficiency Standard Deviation | 1.60 | 0.15 | 0.36 |
| Coated 1 | 81.3 | 95.1 | 95.3 |
| Coated 2 | 77 | 95.3 | 95.1 |
| Coated 3 | 78.2 | 95.7 | 95.8 |
| Average | 78.83 | 95.37 | 95.40 |
| % Drainage Efficiency Standard Deviation | 2.22 | 0.31 | 0.36 |

The drainage efficiency of a fiber cement building article without drainage channels and without a coated surface is approximately 71.7% when measured using ASTM E2773. This efficiency increases to approximately 78.8% when a primer solution is applied to the rear face including the drainage channels of the fiber cement building article.

The drainage efficiency of a cementitious building article with drainage channels and having either an arcuate or v-shaped configuration integrally formed therein in accordance with embodiments of the present disclosure increased significantly relative to the control experiments. The drainage efficiency of Sample A with the arcuate configuration increased to an average drainage efficiency of 90.5% without a coating and to 95.4% when a primer coating was applied to the rear surface including drainage channels of the fiber cement building article. The drainage efficiency of Sample B with the v-shaped configuration increased to an average drainage efficiency of 91% without a coating and to 95.4% when a primer coating was applied to the rear surface.

Strength Testing

A series of tests were carried to determine the flexural strength or modulus of rupture (MoR) of the control samples, sample A and sample B. The sample size for each test was n=18.

As for the drainage tests the control samples comprised a fiber cement panel which had no drainage channels integrally formed on the rear face of the sample in accordance with embodiments of the present disclosure. Whilst Sample A comprised fiber cement panels having drainage channels with an arcuate configuration formed therein and Sample B comprised fiber cement panels having drainage channels with a v-shaped configuration formed therein. The results of the flexural strength tests are presented below in Table 2.

TABLE 2

Results of flexural strength tests of example cementitious building articles described herein.

| | Control MoR/MPa | Sample A MoR/MPa | Sample B MoR/MPa |
|---|---|---|---|
| 1 | 10.041 | 12.39 | 10.477 |
| 2 | 10.43 | 10.78 | 10.864 |
| 3 | 10.023 | 11.10 | 10.766 |
| 4 | 10.339 | 10.31 | 10.542 |
| 5 | 10.468 | 10.31 | 10.468 |
| 6 | 9.726 | 10.53 | 10.164 |
| 7 | 10.315 | 10.741 | 10.742 |
| 8 | 10.368 | 11.061 | 10.521 |

TABLE 2-continued

Results of flexural strength tests of example cementitious building articles described herein.

| | Control MoR/MPa | Sample A MoR/MPa | Sample B MoR/MPa |
|---|---|---|---|
| 9 | 10.748 | 10.982 | 10.546 |
| 10 | 10.399 | 10.862 | 10.578 |
| 11 | 10.277 | 10.927 | 10.818 |
| 12 | 10.655 | 10.612 | 10.788 |
| 13 | 11.198 | 10.614 | 11.098 |
| 14 | 11.134 | 10.764 | 11.204 |
| 15 | 10.757 | 10.802 | 11.368 |
| 16 | 10.734 | 10.329 | 11.468 |
| 17 | 10.787 | 10.437 | 11.287 |
| 18 | 11.055 | 10.861 | 10.883 |
| Average MoR/MPa | 10.53 | 10.8 | 10.81 |
| Standard Deviation | 0.38 | 0.46 | 0.35 |

The results indicate that there is little difference between the flexural strength of the control and the fiber cement panel with drainage channels integrally formed in the rear face of the fiber cement panel irrespective of the shape or configuration of the drainage channel.

Smoothness Testing

The surface smoothness of a number of control samples and samples of a fiber cement panel comprising drainage channels integrally formed on the rear face of the sample were measured.

As before the control samples comprised a fiber cement panel which had no drainage channels integrally formed on the rear face of the sample in accordance with the embodiments of the present disclosure. Sample A comprised fiber cement panels having drainage channels with an arcuate configuration formed therein whilst Sample B comprised fiber cement panels having drainage channels with a v-shaped configuration formed therein. The results of the surface smoothness tests are presented below in Table 3.

TABLE 3

Results of smoothness tests of example cementitious building articles described herein.

| | Control | Sample A | Sample B |
|---|---|---|---|
| 1 | 14.52 | 14.23 | 13.9 |
| 2 | 14.65 | 14.86 | 13.62 |
| 3 | 13.85 | 14.85 | 13.7 |
| 4 | 14.59 | 14.62 | 13.22 |
| 5 | 14.54 | 14.81 | 13.55 |
| 6 | 13.89 | 14.78 | 13.75 |
| 7 | 13.76 | 14.73 | 13.77 |
| 8 | 14.36 | 14.22 | 13.75 |
| 9 | 14.59 | 15.1 | 13.4 |
| 10 | 14.47 | 14.98 | 13.27 |
| 11 | 14 | 15.05 | 13.5 |
| 12 | 13.95 | 14.93 | 13.29 |
| 13 | 14.64 | 14.82 | 13.3 |
| 14 | 14.51 | 14.73 | 13.85 |
| 15 | 14.59 | 15.18 | 13.06 |
| 16 | 14.35 | 14.51 | 13.92 |
| 17 | 14.4 | 15.15 | 13.33 |
| 18 | 13.88 | 14.54 | 13.39 |
| Average | 14.31 | 14.78 | 13.53 |
| Standard Deviation | 0.32 | 0.28 | 0.26 |

The results indicate that there is little difference between the surface smoothness of the front face of the fiber cement panel with or without drainage channels integrally formed in the rear face of the fiber cement panel.

Hydrostatic Pressure Testing

If a cementitious building article is secured to a building substrate without the presence of a capillary break or a rain screen it is known that hydrostatic pressure exists which hinders drainage. A number of calculations were performed to determine the hydrostatic pressure and % increase of same for a number of configurations of the drainage channel together with the frequency of drainage channels per 1.22 m (4 ft.) panel width.

In the following calculations, a number of assumptions were made: the water tank was deemed to be 0.6 m (2') wide with a water column of 2.54 cm (1"). The fiber cement panel had a distance of 8 mm (0.32") between the front and rear surface of the fiber cement panel. The fiber cement panel also had drainage channels integrally formed on the rear surface. Other measurements regarding the frequency and the cross-sectional area of the drainage channel are presented below in Table 4.

The following is a sample of the calculations carried out for a fiber cement panel having 36 drainage channels with an arcuate configuration integrally formed on the rear surface. All other calculations followed a similar process. The results of the calculations are presented in Table 4 below. (A) Volume of water in the drainage test=60.96 cm×2.54 cm and 0.8 cm=123 $cm^3$ (cc). (B) Mass of stored water=Density of water×Volume of water=1 g per $cm^3$×123 $cm^3$=123 g. (C) Force applied by stored water=mass of water×acceleration due to gravity=123 g×981 $cm/s^2$=120663 dyne. (D) Hydrostatic pressure-applied=force per unit area=120663 dyne×(60.96 cm×0.8 cm)=2477 Pa. (E) Hydrostatic pressure-applied by modified design=force per unit area=120663 dyne×[(60.96 cm×0.8 cm)−(36×0.24 $cm^2$)=3007 Pa. (F) Improved forces due to drainage channels=(Hydrostatic pressure-applied by modified design (e)−Hydrostatic pressure-applied (d))×100%=(3007−2477)×100%=21.4%

TABLE 4

Results of hydrostatic pressure tests of example cementitious building articles described herein.

| ID | Channel Shape | Channel x-section area | Number of Channels | Hydrostatic pressure applied by the modified design | Improvement (%) |
|---|---|---|---|---|---|
| 1 | Arc | 0.24 | 24 | 2806 | 13 |
| 2 | Arc | 0.24 | 36 | 3007 | 21 |
| 3 | Arc | 0.24 | 48 | 3240 | 30 |
| 4 | Square | 0.12 | 24 | 2629 | 6 |
| 5 | Square | 0.12 | 36 | 2715 | 9 |
| 6 | Square | 0.12 | 48 | 2806 | 13 |
| 7 | Triangular | 0.06 | 24 | 2550 | 2 |
| 8 | Triangular | 0.06 | 36 | 2589 | 4 |
| 9 | Triangular | 0.06 | 48 | 2629 | 6 |

The calculations show that drainage channels integrally formed in the rear surface of the fiber cement building article accordance with embodiments of the present disclosure increase hydrostatic pressure relative to the hydrostatic pressure applied by the mass of stored water. Furthermore it was also shown that hydrostatic pressure increases as the number of channels increase. Accordingly the configuration of the or each drainage channel together with frequency of drainage channels provides for water or a liquid to flow through the drainage channels.

Additional Embodiments for Building Systems

FIGS. 7-11 illustrate embodiments of building systems that can be used in conjunction with interior and/or exterior portions of a structure (for example, walls of a building). Each of the building systems 70, 80, 90, 1000, and 1100 discussed below and shown in FIGS. 7-11 are shown and described with reference to a vertically oriented framing members 22 (for example, wood studs). However, the building systems 70, 80, 90, 1000, and 1100 discussed below can be used in conjunction with various types of building substrates and/or structural frames. Further, one or more aspects or features of the building systems and components thereof discussed above (for example, building system 20) can be included in the building systems 70, 80, 90, 1000, and 1100 discussed below and/or shown in FIGS. 7-11. Likewise, one or more aspects or features of building systems 70, 80, 90, 1000, and 1100 can be included in the building systems discussed previously (for example, building system 20).

Figure 7:
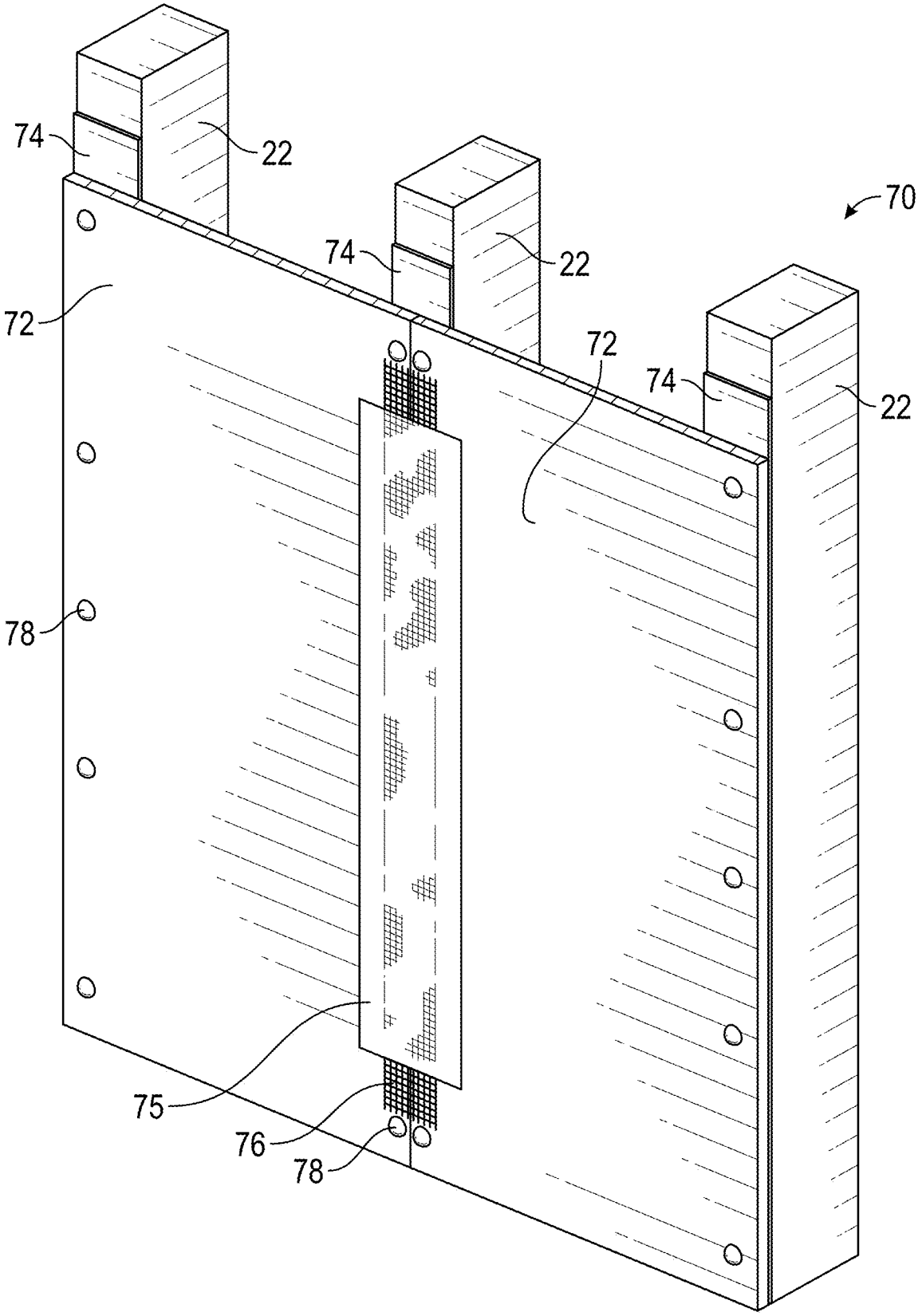
FIG. 7 is a partially cut-away sectional view of another embodiment of a building system.
Figure 8:
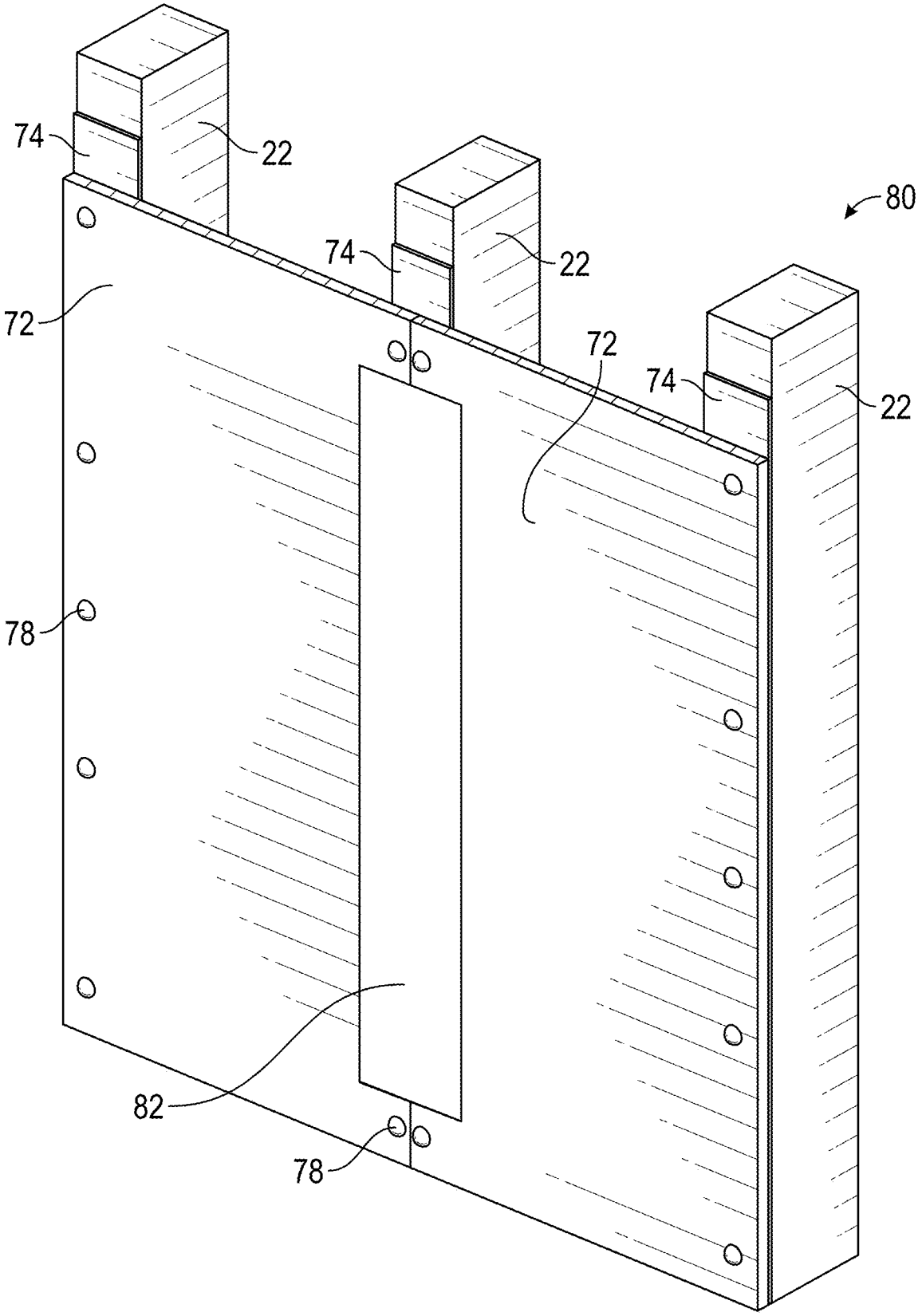
FIG. 8 is a partially cut-away sectional view of another embodiment of a building system.

FIGS. 7-8 illustrate embodiments of a building system 70, 80. As shown, the building system 70, 80 can include building article(s) 72 which can be secured to framing members 22. For example, building article(s) 72 can be mechanically secured (e.g., with fasteners such as nails or screws) and/or chemically secured to framing members 22. FIGS. 7-8 illustrate two building articles 72 secured to framing members 22 with sides abutting one another and secured via fasteners 78 to a common framing member 22. As shown, such abutting sides of the building articles 72 can abut one another along an abutment line (also referred to as an "abutment joint"). While FIGS. 7-8 illustrate two abutting building articles 72, building system 70, 80 can include more than two building articles 72 and/or more than one pair of building articles 72 that abut each other (for example, at a common framing member 22) and secure to one or more framing members 22.

Building article 72 can be a cementitious building article. For example, building article 72 can include a composition similar in some, many, or all respects as cementitious building articles 1, 1*a*, 3, 3*d*-3*j*, 5, 7, 9 discussed above. Building article 72 can be a fiber cement building article and can comprise cellulose and/or synthetic fibers (for example, polypropylene fibers), hydraulic binders, silica and water. Optionally, building article 72 can further comprise other additives, for example density modifiers. In one embodiment, building article 72 comprises a fiber cement panel having a front face and a rear face and an edge member intermediate to and contiguous to the front face and the rear face wherein the distance between the front face and the rear face comprises at least 0.8 mm±0.5 mm. In one embodiment, building article 72 is formed by thin overlaying substrate layers using the Hatschek process.

In some embodiments, building article(s) 72 can comprise a composition such as, by way of non-limiting example, any of the compositions described herein in the Example Fiber Cement Composite Material Compositions and/or Composition and Manufacturing of Counterfeit Detection Features portions of the present disclosure.

FIGS. 7 and 8 illustrate various ways of providing weather or water resistance (for example, waterproofing) for building systems 70, 80 or portions thereof. A water resistant layer, barrier, or house wrap can be secured (for example, adhered and/or mechanically secured) along and/or in between framing members 22 (or portions thereof). As an example, a water resistant barrier or house wrap can be placed and/or secured on framing member 22 adjacent to (for example, behind and/or in front of) the point, region, and/or line (for example, abutment line) where edges or sides of two building articles 72 meet. As shown in FIGS. 7 and 8, a water resistant layer 74 can be secured along a surface of framing member 22 adjacent to a location where portions of building articles 72 are to be secured side-by-side. For example, water resistant layer 74 can be positioned between framing member 22 and a rear face of building article 72. Such water resistant layer 74 can be any tape, membrane, or polymer that can provide weather and/or water resistance. In one embodiment, the water resistant layer 74 is butyl tape. Providing such water resistant layer 74 adjacent to (e.g., "behind") and/or along the abutment line where sides of two adjacent building articles 72 meet and/or behind fastener holes can advantageously provide water resistance to the framing members 22 and/or interior portions of the wall including the framing members 22 (or interior portions of a building contained therein). Such water resistance is especially helpful where liquids penetrate through small gaps and space between the sides of two adjacent buildings articles 72 and/or through holes where fasteners 78 extend through the building article 72.

FIG. 7 further illustrates an optional weather resistant layer 75 secured (for example, adhered) along portions of the abutting sides of building articles 72 where edges (also referred to herein as "sides") of the two building articles 72 meet. In such configuration, weather resistant layer 75 (also referred to herein as "water resistant layer") can provide waterproofing benefits in addition or as an alternative to the water resistant layer 74. In some embodiments, building system 70 includes both layers 74 and 75, and water resistant layers 74, 75 can together sandwich portions of the abutting buildings articles 72 where the two articles 72 meet. Water resistant layer 75 can be a cementitious material and/or coating. For example, water resistant layer 75 can be thinset mortar. As shown in FIG. 7, building system 70 can include a mesh layer 76 (also referred to herein as "mesh") that can be positioned between the water resistant layer 75 and the building articles 72 over the line where two sides of the articles 72. The mesh layer 76 can be a wire mesh and can be adhered (for example, glued) to surfaces of the building articles 72. The mesh layer 76 can help the water resistant layer 75 secure (for example, bond) to the surfaces of the building articles 72. As shown in FIG. 7, in some cases, the water resistant layer 75 and/or the mesh layer 76 can be placed adjacent and/or overtop (for example, covering) fasteners 78 which can fasten the building articles 72 to the framing members 22.

FIG. 8 further illustrates a building system 80 including an optional weather resistant layer 82 secured (for example, adhered) along portions of the abutting sides of building articles 72 covering the abutment line where the two articles 72 meet. In such configuration, weather resistant layer 82 (also referred to herein as "water resistant layer") can provide waterproofing benefits in addition or as an alternative to the water resistant layer 74. In some embodiments, building system 80 includes both water resistant layer 74 and 82, and layers 74, 82 can together sandwich portions of the abutting buildings articles 72 where the two articles 72 meet. Water resistant layer 75 can be any tape, membrane, or polymer that can provide water resistance. As shown in FIG. 8, in some cases, the water resistant layer 82 can be placed adjacent and/or overtop (for example, covering) fasteners 78 which can fasten the building articles 72 to the framing members 22.

While FIGS. 7-8 illustrate building systems 70, 80 having three framing members 22, two building articles 72, it is to be understood that building systems 70, 80 are not limited to these illustrated configurations. Building systems 70, 80 can include a multiple pairs of building articles 72 secured to a plurality of framing members 22, and such building articles 72 can be secured to the framing members 22 via vertical stacking and/or horizontal abutting. Additionally, building systems 70, 80 can include framing members in addition to framing members 22 which are shown as vertical studs. For example, building systems 70, 80 can include horizontal framing members which are disposed between the vertical framing members 22. In such configuration portions of the building articles 72 can be secured to such additional framing members.

In some embodiments, building articles 72 can act as sheathing when secured to framing members 22, and can provide resistance against shear forces experienced by the building system 70, 80. In some embodiments, building system 70, 80 includes building articles 72 but does not include wood sheathing (for example, oriented strand board). In alternative embodiments, wood sheathing can be included as an alternative to building articles 72. In some embodiments, building system 70, 80 includes wood sheathing secured to framing members 22 (with or without the water resistant layer 74) and building articles 72 are secured overtop and/or adjacent to such sheathing. In such embodiments where building system 70, 80 includes both wood sheathing secured to framing members 22 and building articles 72, building system 70, 80 can additionally include furring strips in the form of battens positioned between the wood sheathing and the building articles 72. In some embodiments, building system 70, 80 includes one or more panels which can be secured to the front faces of the building articles 72, for example, fiber cement wall panels. In such embodiments, building system 70, 80 can additionally include furring strips in the form of battens positioned between the building articles 72 and such fiber cement wall panels.

Figure 9A:
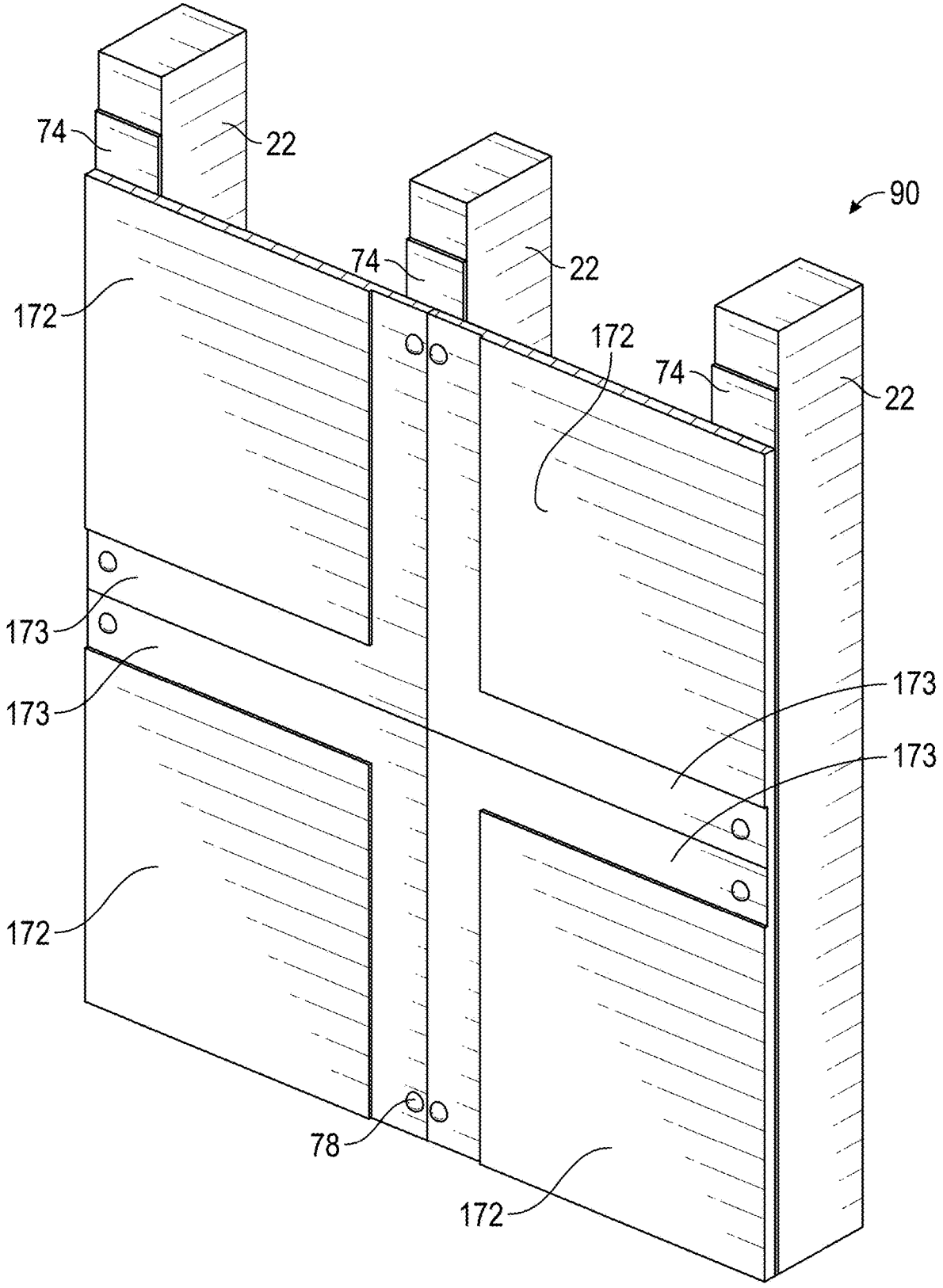
FIG. 9A is a partially cut-away sectional view of another embodiment of a building system.

FIG. 9A illustrates an embodiment of a building system 90 that can be similar to building systems 70, 80 in many respects. Building system 90 can include framing members 22, water resistant layer 74, building articles 172, and fasteners 78 (for example, a nail) which can help secure the building articles 172 and/or water resistant layer 74 to the framing members 22. Building article 172 can be the same as building articles 72 in some or many respects. For example, building article 172 can be a cementitious building article and can comprise a composition similar in some, many, or all respects as cementitious building articles 1, 1*a*, 3, 3*d*-3*j*, 5, 7, 9 discussed above. Building article 172 can be a fiber cement building article and can comprise cellulose and/or synthetic fibers (for example, polypropylene fibers), hydraulic binders, silica and water. Optionally, building article 172 can further comprise other additives, for example density modifiers. In one embodiment, building article 172 comprises a fiber cement panel having a front face and a rear face and an edge member intermediate to and contiguous to the front face and the rear face wherein the distance between the front face and the rear face comprises at least 0.8 mm±0.5 mm. In one embodiment, building article 172 is formed by thin overlaying substrate layers using the Hatschek process. As described with reference to building article 72, in some embodiments, building article(s) 172 can comprise a composition such as, by way of non-limiting example, any of the compositions described herein in the Example Fiber Cement Composite Material Compositions and/or Composition and Manufacturing of Counterfeit Detection Features portions of the present disclosure.

Building articles 172 can include recessed portions 173 extending along portions of the building articles 172. For example, as shown in FIG. 9A, building articles 172 can include recessed portion(s) 173 that extend along a surface of the articles 172 adjacent and/or proximate the edges or sides of the building articles 172. Such recessed portion(s) 173 can extend along a surface of the building article 172 adjacent and/or proximate one, two, three, or four edges or sides of building article 172. Recessed portions 173 can advantageously accommodate a thickness of a weather resistant layer 82, 75 and/or mesh layer 76, and/or head of fastener(s) 78 so that, when such layers 82, 75, 76 are secured over the line where two abutting building articles 72 meet, a surface of such layers 82, 75, 76 is planar (for example, "flush") with a surface of the building articles 172. For example, recessed portions 173 can be sized, shaped, and/or otherwise configured to accommodate a thickness, width, and/or length of layers 82, 75, and/or 76 so that the surfaces of the layers 82, 75, and/or 76 are flush with the surfaces (for example, surrounding surfaces) of the building articles 172. While FIG. 9A illustrates four, abutting building articles 172, each having two recessed portions 173 extending along sides thereof, building articles 172 can include more or less recessed portions 173 depending on the configuration and/or amount of building articles 172 in building system 90. For example, where additional building articles are secured to framing members 22 above and/or to the sides of the two, rightmost building articles 172 in FIG. 9A, the top, rightmost building article 172 could have recessed portions 173 extending along the top and right edges or sides in addition to the recessed portions 173 extending along the left and bottom edges or sides. As shown in FIG. 9A, the recessed portions 173 can have a width such that one or more fasteners 78 can be positioned therewithin when fixed to the building articles 172, framing members 22 and/or water resistant layer 74. In some embodiments, building system 90 includes weather resistant layer 82, 75 (with or without mesh layer 76) along one or more of the recessed portions 173 in order to provide waterproofing of along the abutment line of two adjacent building articles 172. In some embodiments, building system 90 does not include any fasteners 78 within the recessed portions 173, but only in the non-recessed portions of building articles 172.

Figure 9B:
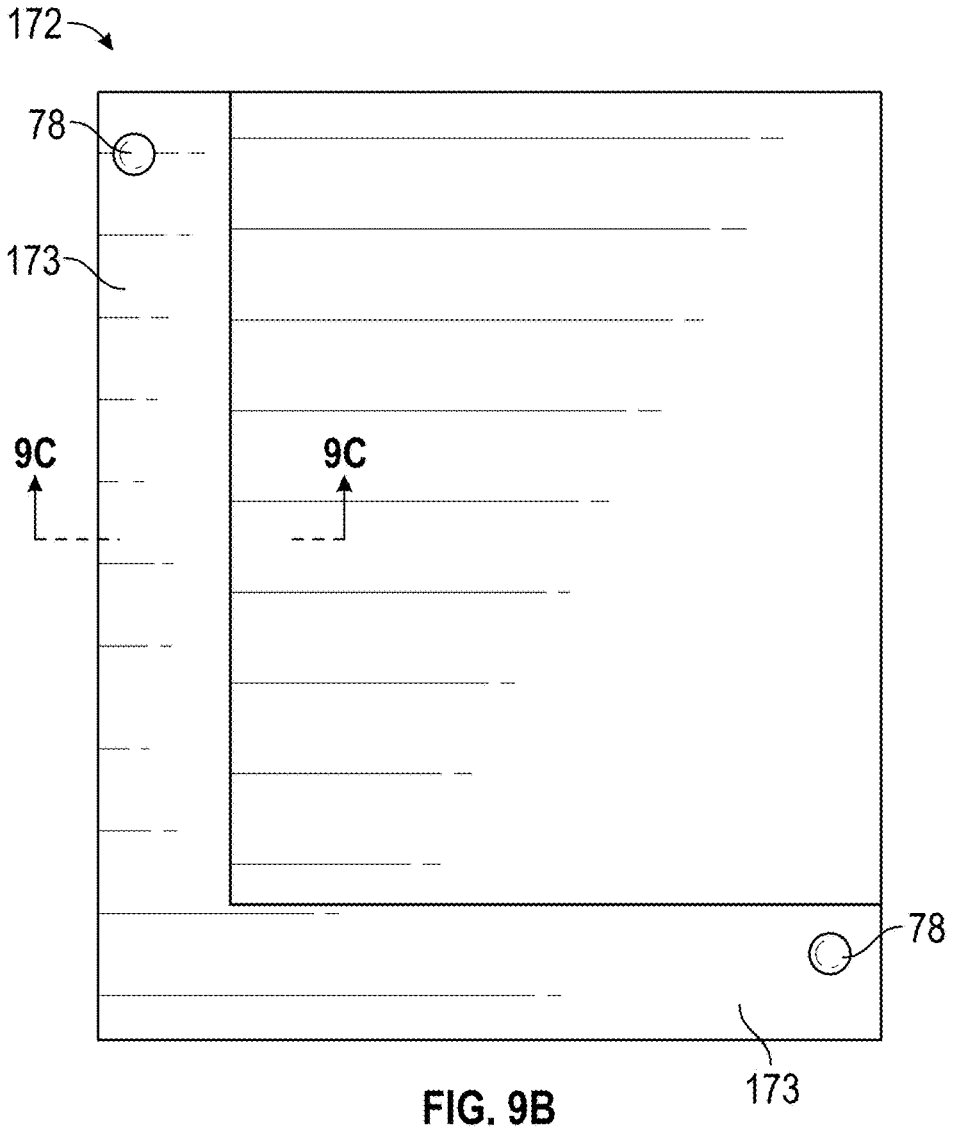
FIG. 9B is an enlarged front view of a building article of the building system of FIG. 9A.
Figure 9C:
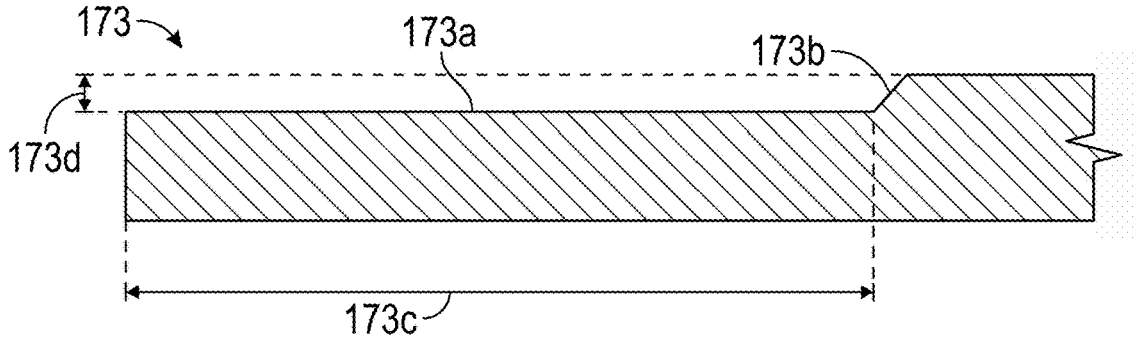
FIG. 9C is an enlarged cross-sectional view of a portion of the building article of FIG. 9B.

FIG. 9B illustrates an enlarged front view of the top, rightmost building article 172 of FIG. 9A, while FIG. 9C illustrates a cross-section through a recessed portion 173 of such building article 172. As shown, recessed portion 173 can include a depth 173*d* and a width 173*c* extending from an edge or side of building article 172. While surface 173*a* of recessed portion 173 is shown as flat, in some embodiments, surface 173 is angled and/or tapered to or from the edge or side of building article 172. Surface 173*a* can join a front (e.g., top) surface of building article 172 at a transition region 173*b*, which can be transverse (for example, perpendicular) to a plane of the front or top surface of building article 172 and/or to surface 173*a*. In some embodiments, transition region 173*b* is angled with respect to surface 173*c* and/or a front or top surface of building article 172 at an angle of 5°, 10°, 15°, 20°, 25°, 30°, 35°, 40°, 45°, 50°, 55°, 60°, 65°, 70°, 75°, 80°, 85°, or 90°, or any value therebetween, or any range bounded by any combination of these values, although values outside these values or ranges can be used in some cases. In some embodiments, recessed portion 173 does not include a transition region 173*b*, but rather, comprises a tapered surface 173*a* which tapers from a maximum depth gradually upward a certain distance (e.g., width 173*c*) until the depth is zero and the full thickness of the article 172 is reached.

As discussed above, recessed portions 173 can advantageously accommodate a thickness of a weather resistant layer 82, 75, and/or mesh layer 76 so that, when such layers 82, 75, 76 are secured over the abutment line where two adjacent building articles meet 172, a surface of such layers 82, 75, 76 is planar (for example, "flush") with a surface of the building articles 172. With reference to FIG. 9C, recessed portion 173 can have a depth 173*d* that is greater than or equal to a thickness of weather resistant layer 82, or weather resistant layer 75 and/or mesh layer 76. Recessed portion 173 can have a depth 173*d* that is within a certain percentage (e.g., greater than or less than) of the thickness of weather resistant layer 82, or weather resistant layer 75 and/or mesh layer 76. For example, recessed portion 173 can have a depth 173*d* that is within 1%, 2%, 3%, 4%, 5%, 6%, 7%, 8%, 9%, 10%, 15%, or 20% of the thickness of weather resistant layer 82, or weather resistant layer 75 and/or mesh layer 76, or any percentage value between the above-listed percentage values, or any range bounded by any combination of these percentage values, although percentage values outside these values or ranges can be used in some cases. As another example, recessed portion 173 can have a depth 173*d* that is 0.25 mm, 0.5 mm, 0.75 mm, 1 mm, 2 mm, 3 mm, 4 mm, 5 mm, 6 mm, 7 mm, 8 mm, 9 mm, 10 mm, 15 mm, 20 mm, 25 mm, 30 mm, 35 mm, 40 mm, 45 mm, or 50 mm, or any value therebetween, or any range bounded by any combination of these values, although values outside these values or ranges can be used in some cases. Additionally or alternatively, depth 173*d* can be less than a certain percentage of a thickness of building article 172 so as not to affect the structural integrity of the article 172. For example, depth 173*d* can be less than 1%, 2%, 3%, 4%, 5%, 6%, 7%, 8%, 9%, 10%, 15%, 20%, 25%, or 30% of the thickness of building article 172, or any value therebetween, or any range bounded by any combination of these values, although values outside these values or ranges can be used in some cases.

Recessed portion 173 can have a width 173*c* that is greater than or equal to a width of weather resistant layer 82, or weather resistant layer 75 and/or mesh layer 76. Recessed portion 173 can have a width 173*c* that is greater than the width of the weather resistant layer 82, or weather resistant layer 75 and/or mesh layer 76 by a certain percentage. For example, recessed portion 173 can have a width 173*c* that is greater than the width of the weather resistant layer 82, or weather resistant layer 75 and/or mesh layer 76 by 1%, 2%, 3%, 4%, 5%, 6%, 7%, 8%, 9%, 10%, 15%, or 20%, or any percentage value between the above-listed percentage values, or any range bounded by any combination of these percentage values, although percentage values outside these values or ranges can be used in some cases. Recessed portion 173 can have a width 173*c* that is a certain percentage of the width and/or length of building article 172. For example, recessed portion 173 can have a width 173*c* that is 1%, 5%, 10%, 15%, 20%, or 25% of the width and/or length of building article 172, or any percentage value therebetween, or any range bounded by any combination of these percentage values, although percentage values outside these values or ranges can be used in some cases. Recessed portion 173 can have a width 173*c* that is ¼ inch (0.635 cm), ½ inch (1.27 cm), 1 inch (2.54 cm), 1.5 inch (3.81 cm), 2 inch (5.08 cm), 2.5 inch (6.35 cm), 3 inch (7.62 cm), 4 inch (10.2 cm), 5 inch (12.7 cm), 6 inch (15.2 cm), 7 inch (17.8 cm), 8 inch (20.3 cm), 9 inch (22.9 cm), or 10 inch (25.4 cm) depending on the width and/or length of the building article 172. Width 173*c* can be any value in between these values, or any range bounded by any combination of these values, although values outside these values or ranges can be used in some cases.

Any of the building systems 70, 80, 90 can be utilized for exterior or interior implementations. For example, where building systems 70, 80, 90 are used for interior applications within a building, the building articles 72, 172, can be coated and/or covered with a coating, finish, and/or tile (such as a vinyl stone).

Figure 10:
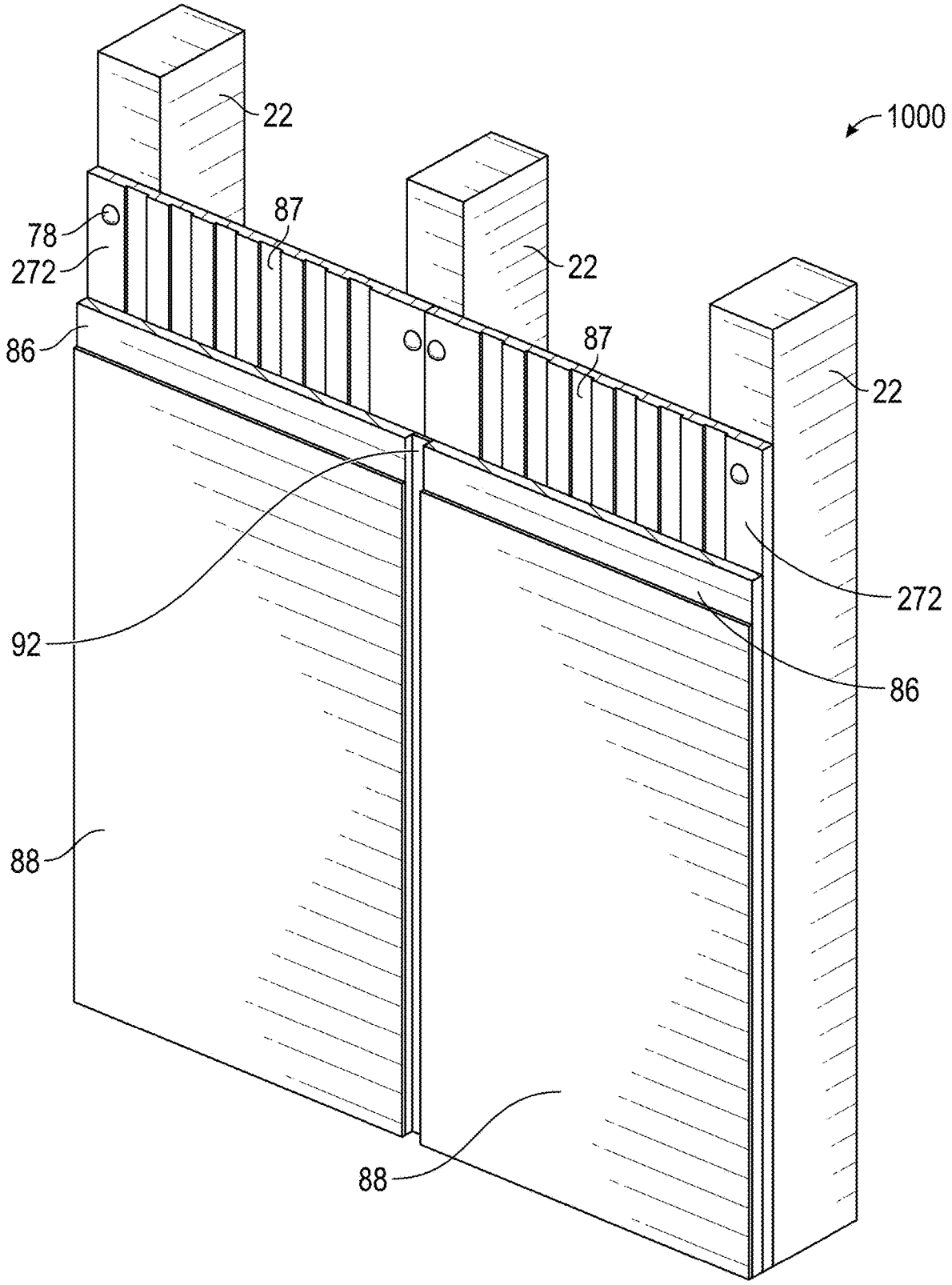
FIG. 10 is a partially cut-away sectional view of another embodiment of a building system.
Figure 11:
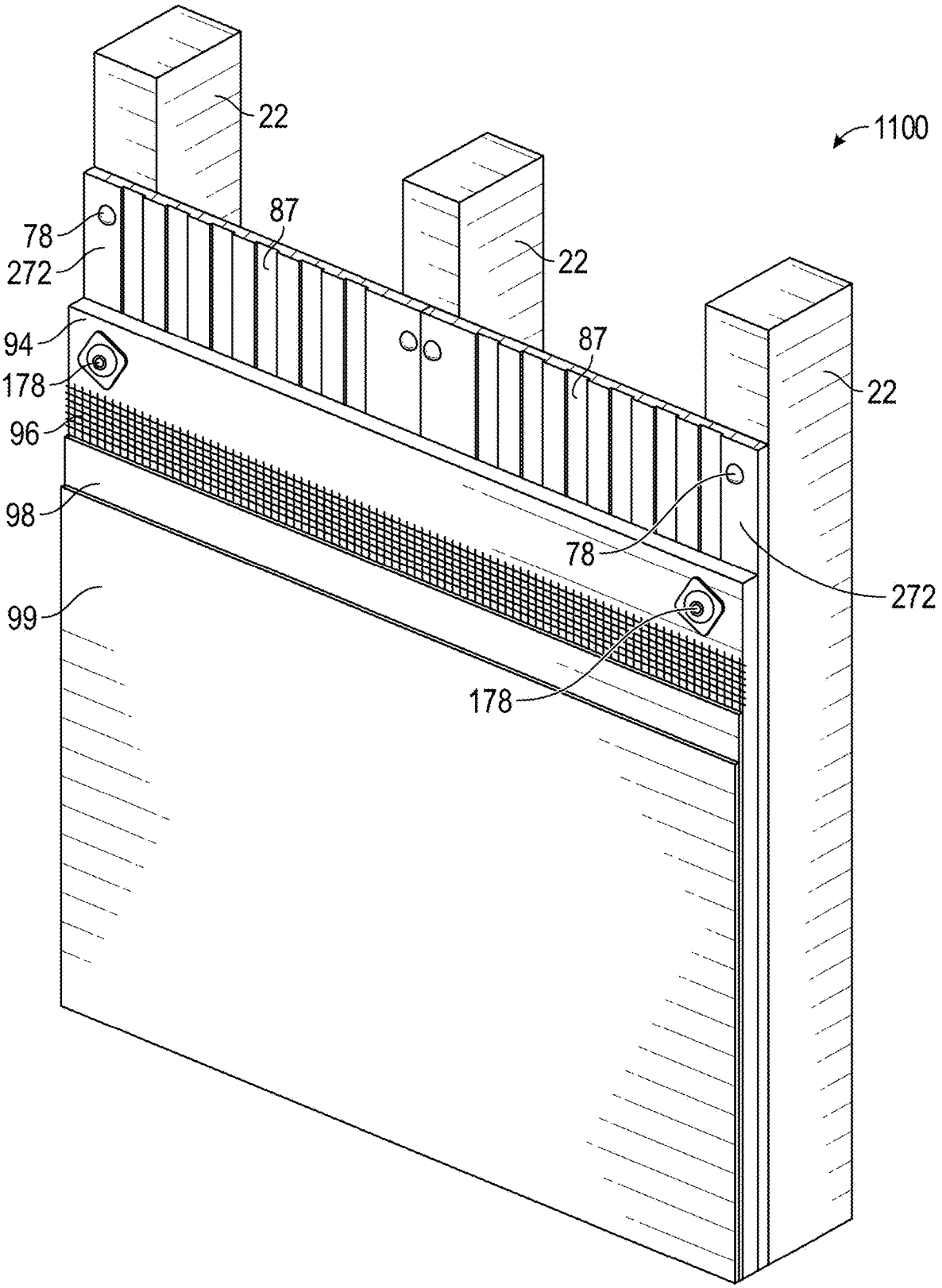
FIG. 11 is a partially cut-away sectional view of another embodiment of a building system.

FIGS. 10-11 illustrate embodiments of a building system 1000, 1100 that can be similar to building systems 70, 80, 90 in many respects. Building system 1000, 1100 can include framing members 22, building articles 272, and fasteners 78 (for example, a nails) which can help secure the building articles 272 to the framing members 22. While not shown, building system 1000, 1100 can include water resistant layer 74 between framing members 22 and building articles 272 along and/or near where the two building articles 272 meet, similar or identical as that discussed above with reference to FIGS. 7-9C.

Building article 272 can be the same as building article 72, 172 in some or many respects. Building article 272 be a cementitious building article and can comprise a composition similar in some, many, or all respects as cementitious building articles 1, 1*a*, 3, 3*d*-3*j*, 5, 7, 9 discussed above. Building article 272 can be a fiber cement building article and can comprise cellulose and/or synthetic fibers (for example, polypropylene fibers), hydraulic binders, silica and water. Optionally, building article 272 can further comprise other additives, for example density modifiers. In one embodiment, building article 272 comprises a fiber cement panel having a front face and a rear face and an edge member intermediate to and contiguous to the front face and the rear face wherein the distance between the front face and the rear face comprises at least 0.8 mm±0.5 mm. In one embodiment, building article 272 is formed by thin overlaying substrate layers using the Hatschek process. As described with reference to building article 72, 172, in some embodiments, building article 272 can comprise any known fiber cement composition such as, by way of non-limiting example, any of the compositions described herein in the Example Fiber Cement Composite Material Compositions and/or Composition and Manufacturing of Counterfeit Detection Features portions of the present disclosure.

As shown in FIG. 10, building articles 272 can include a plurality of drainage channels 87. Drainage channels 87 can be the same in some, many, or all respects to any of the drainage channels discussed above, for example, drainage channels 2, 2*d*, 2*e*, 2*f*, 2*g*, 2*h*, 2*i*, 2*j*, 2*k*, or 2*l*. For example, the width, length, orientation, configuration, number, spacing, shape, depth, and/or percentage of surface area of building article 272, for drainage channels 87 can be the same in some, many, or all respects as drainage channels 2, 2*d*, 2*e*, 2*f*, 2*g*, 2*h*, 2*i*, 2*j*, 2*k*, or 2*l*, and/or building articles 1, 1*a*, 3, 3*d*-3*j*, 5, 7, 9 discussed above. As another example, the drainage channels 87 can be arranged in the same or similar way as any of the drainage channels discussed above, for example, drainage channels 2, 2*d*, 2*e*, 2*f*, 2*g*, 2*h*, 2*i*, 2*j*, 2*k*, or 2*l*. For example, the drainage channels 87 can be separated by spacer sections (like spacer sections 6 discussed above) and/or can be arranged in groups similar or identical to that discussed above with reference to FIGS. 1A-1C and/or FIG. 3I.

As shown in FIGS. 10-11, drainage channels 87 can be located on a front face of building article 272. Such front face can be opposite to a rear face that contacts the framing members 22 in FIGS. 10-11. Thus, such drainage channels 87 can be positioned on a surface of the building article 272 that faces away from the structural framing and/or interior of a building when the building article 272 is secured thereto.

In some embodiments, drainage channels 272 are integrally formed with building article 272. As discussed above with reference to other drainage channels disclosed herein, drainage channels 87 can advantageously form a capillary break and air gap to facilitate drainage, ventilation, and/or moisture management between the building article 272 and a weather resistant layer or barrier (such as water resistant layer 74) and/or a structural frame (including, for example, framing members 22). As also discussed, such drainage channels 87 can eliminate the need for furring strips.

In some embodiments, one or more faces of building article 272 can include a coating agent. For example, one or more of the drainage channels 87 can be coated with a coating agent to further assist drainage action and the capillary break functionality of each drainage channel 87. For example, a coating agent may provide a smoother surface than an uncoated building article 272 (such as a cementitious building article), so as to further facilitate the flow of water or any other liquid along the surface of the building article 272. Enhanced flow of water along the surface of the building article 272 can further enhance the drainage efficiency of the building article 272.

In some embodiments, drainage channels 87 have a funneled configuration wherein one or more of the drainage channels 87 are slightly widened at one or both ends of the drainage channel 87, similar or identical to as that described above with reference to drainage channels 2*l* and FIGS. 6A-6B.

FIG. 10 illustrates an embodiment of building system 1000 which includes a panel 86 and a coating 88. Panel 86 can comprise a cementitious material. For example, panel 86 can be a fiber cement panel comprising a fiber cement composition similar or identical to that described above with reference to building articles 1, 1*a*, 3, 3*d*-3*j*, 5, 7, 9, 72, 172, 272. Coating 88 can be a paint, render finish, or other coating or material adhered to a front face of panel 86. As shown in FIG. 10, panels 86 can be placed adjacent and/or in front of building articles 272 and can be secured to building articles 272 and framing members 22. Such securement can be by, for example, mechanicals fasteners. As also shown in FIG. 10, sides of two adjacent panels 86 can be separated by an express joint 92 which can include a metal strip, for example.

FIG. 11 illustrates an embodiment of building system 1100 which includes an insulation panel 94, mesh layer 96, and one or more coating layers 98, 99. Building system 1100 can have one or both of coating layers 98, 99. The one or more coating layers 98, 99 can comprise, for example, a cementitious and/or polymeric coating and/or an acrylic (for example, acrylic paint). For example, coating layer 98 can be a basecoat, and/or coating layer 99 can be a topcoat. The basecoat and/or topcoat can comprise, for example, acrylic (such as acrylic paint). The one or more coating layers 98, 99 can be an exterior finish comprising, for example, plaster or stucco. The mesh layer 96 can comprise a wire or fiberglass reinforcing mesh, for example. As shown, the insulation panel 94 can be secured to the building articles 272 and the framing members 22 via fasteners 178 which may be mounted along with a washer or other piece to aid securement. Additionally, the mesh layer 96 can be secured (for example, adhered) to the insulation panel 94, and the basecoat 98 and/or topcoat 99 can be secured (for example, adhered) to the mesh layer 96 and/or the insulation panel 94 as shown.

While FIGS. 7-11 illustrate various features, aspects, and/or configurations for building systems 70, 80, 90, 1000, 1100, the features, aspects, and/or configurations shown in any of these systems 70, 80, 90, 1000, 1100 can be combined and/or incorporated into any other of the systems 70, 80, 90, 1000, 1100, or any of the building systems discussed with reference to FIGS. 1-6B, and vice versa. As an example, any of the building articles 72, 272 can include the recessed portions 173 discussed and shown with reference to FIG. 9A-9C and building article 172. As another example, any of the building articles 72, 172 can include the drainage channels 87 discussed and shown with reference to FIG. 10-11 and building article 272. As another example, any of the building systems 70, 80, 90 could include one or more of panel 86, coating 88, insulation panel 94, basecoat 98, and/or topcoat 99 secured adjacent to the building article 72, 172, weather resistant layer 75, mesh layer 76, and/or weather resistant layer 82. As another example, any of the building systems 1000, 1100 can include the water resistant layer 74 positioned between building articles 272 and framing members 22.

Waterproof Fiber Cement Composite Material Compositions

Disclosed herein are integrally waterproof fiber cement composite materials that exhibit unexpectedly high waterproofness characteristics due to the inclusion of small percentages of a combination of silica fume and silanol in conjunction with the other components. The quantities of silica fume and silanol that have been found to yield superior waterproof properties can be at least an order of magnitude smaller than the respective quantities of silica fume or silanol that would be required to produce a waterproof material. The amounts of silanol or silica fume necessary to produce a waterproof fiber cement composite material, if included individually, are large enough as to cause undesirable side effects during production. Accordingly, the combination of silica fume and silanol in the small percentages disclosed herein advantageously provide cost savings and allow commercial production of integrally waterproof fiber cement composite materials.

As will be described in greater detail, the synergistic combinations of predetermined amounts of silanol and silica fume disclosed herein can yield integrally waterproof fiber cement composite materials at significantly lower combined dosages than would be required of either component individually. For example, it has been discovered that the inclusion of silica fume in a fiber cement formulation at only 0.5% by weight reduces the amount of silanol required to produce an integrally waterproof fiber cement composite material by approximately 90% (e.g., from approximately 5% of cellulose fiber dry weight to approximately 0.5% of cellulose fiber dry weight).

Example Fiber Cement Composite Material Compositions

Embodiments of fiber cement composite material compositions generally include a cementitious hydraulic binder, such as Portland cement or any other suitable cement, silica, and fibers, such as cellulose or other suitable fibers. The fiber may include a blend of two or more types of fibers, and may include recycled fiber materials. In some embodiments, the fiber is added in the form of a pulp, such as wood pulp or the like. The fiber cement composite materials may further include additional components such as silica, alumina, coloring additives, or the like. One or more density modifiers, such as low density additives, may further be included. Coloring additives may include, for example, pigments such as red or pink clay, or the like. Density modifiers may include, for example, low-density additives such as calcium silicate, perlite, or the like. The components of a fiber cement composite material formulation may be mixed in a slurry form including water, and may be formed into fiber cement composite materials by any of various processes such as a Hatschek process or the like. Water content may be removed from the fiber cement composite materials by various curing methods including autoclaving or the like, to form solid fiber cement composite materials.

In various formulations, the cement may comprise between 20% and 45% of the dry weight of the slurry. For example, the cement may comprise between 25% and 39% of dry weight, between 25% and 29% of dry weight, between 35% and 39% of dry weight, or any percentage within the preceding ranges. Cement content less than 20% or greater than 45% is similarly possible. In some embodiments, a relatively lower cement content, such as between 25% and 29% of dry weight, may be desirable for interior cladding articles, interior board, or the like. In some embodiments, a relatively higher cement content, such as between 35% and 39% of dry weight, may be desirable for exterior cladding articles. It will be understood that each of the cement contents or cement content ranges disclosed herein may be reduced by an amount of silica fume added to the formulation. For example, a baseline cement content of between 25% and 39% of dry weight may correspond to an actual cement content of between 23% and 37% of dry weight if 2% by weight of silica fume is included in the formulation.

In various formulations, cellulose fibers may comprise between 3% and 15% of dry weight of the slurry. For example, the cellulose fibers may comprise between 5% and 10% of dry weight, between 6% and 9% of dry weight, between 6.5% and 7.5% of dry weight, between 7.75% and 8.75% of dry weight, or any percentage within the preceding ranges. Cellulose fiber content less than 3% or greater than 15% is similarly possible. In some embodiments, a relatively lower cellulose fiber content, such as between 6.5% and 7.5%, or approximately 7% of dry weight, may be desirable for interior cladding articles, interior board, or the like. In some embodiments, a relatively higher cellulose fiber content, such as between 7.75% and 8.75%, or approximately 8.25% of dry weight, may be desirable for exterior cladding articles.

In various formulations, the silica may comprise any percentage between 50% and 60% of dry weight. For example, the silica may comprise approximately 50% of dry weight, 54% of dry weight, 56% of dry weight, 58% of dry weight, etc. In various formulations, the alumina may comprise any percentage between 2% and 5% of dry weight. For example, the alumina may comprise approximately 3% of dry weight, approximately 3.5% of dry weight, etc. In various formulations, the density modifier may comprise any percentage between 0% and 7% of dry weight. For example, some formulations may include no density modifier, or may include approximately 2% of dry weight, approximately 3% of dry weight, approximately 4% of dry weight, approximately 5% of dry weight, approximately 5.5% of dry weight, approximately 7% of dry weight, etc. Common density modifiers present in these quantities may include calcium silicate, perlite, or the like.

In some embodiments, additional components may be included as components in a fiber cement composite material, in addition to the components described above. For example, in some embodiments a fiber cement composite material formulation may include one or more components that cause water resistance or waterproofness of the finished fiber cement composite material. One example component is a sizing agent such as a silanol solution, which may include silanol and water or another suitable solvent. Without being bound by theory, it is understood that silanols increase water resistance because they act as sizing agents making the surfaces of the fibers hydrophobic and, when used to treat fiber cement fibers, prevent water from traveling through the fiber cement matrix along the edges of the fibers. In some embodiments, a silanol solution may be mixed with the fiber component of the fiber cement formulation. The silanol solution may be added to the fibers at the time the fiber is mixed with the remaining components of the fiber cement formulation, or may be pre-mixed with the fiber (e.g., for 1 minutes, 5 minutes, 10 minutes, 20 minutes, or more) prior to adding the remaining components of the fiber cement formulation. Quantities of silanol solution to be added to the fibers may be determined such that the silanol have a dry weight of approximately 0.25% of fiber dry weight, approximately 0.5% of fiber dry weight, approximately 1% of fiber dry weight, approximately 2% of fiber dry weight, approximately 3% of fiber dry weight, approximately 4% of fiber dry weight, approximately 5% of fiber dry weight, or more. The dry weight of the silanol may be in any suitable range such as between 0.25% and 3% of fiber dry weight, between 0.25% and 2% of fiber dry weight, between 0.25% and 1% of fiber dry weight, or any sub-range therebetween.

Silica fume is another example component that may be included in some fiber cement composite material formulations. Silica fume is a fine pozzolanic material comprising amorphous silica. Silica fume may be produced, for example, as a byproduct of the production of elemental silicon or ferro-silicon alloys in electric arc furnaces. Silica fume may be included in a variety of concrete and cementitious products, but is not typically used for waterproofing implementations. However, it has been discovered that silica fume may enhance the water resistance of fiber cement composite materials and may yield integrally waterproof fiber cement composite materials when included in conjunction with silanol. Without being bound by theory, it is believed that the relatively fine size of silica fume, relative to the other components of a fiber cement article, may reduce porosity of the cementitious matrix between fibers. Moreover, silica fume can conveniently be added to fiber cement formulations as a replacement for a portion of the cement. For example, in some embodiments the cement component of the fiber cement may be reduced by an equal weight to the weight of silica fume added to the formulation, without undesirably affecting other physical properties of the fiber cement articles such as dimensional stability, flexural strength, or the like. In various formulations, the amount of silica fume in a fiber cement article may be, for example, between 0.25% and 5% of dry weight, between 0.25% and 4% of dry weight, between 0.25% and 3% of dry weight, between 0.25% and 2% of dry weight, between 0.25% and 1% of dry weight, or any sub-range or percentage therebetween. For example, in some embodiments, the silica fume content is approximately 0.5% of dry weight, approximately 1% of dry weight, approximately 1.5% of dry weight, approximately 2% of dry weight, etc. However, relatively large quantities of silica fume (e.g., above 2-3% of dry weight) may interfere with commercial-scale production of fiber cement composite materials.

Results of Waterproofness and Surface Wetness Testing

As will be described in greater detail, various fiber cement composite material formulations were tested to investigate the unexpected synergy of sizing agents and pozzolanic materials. In a first trial, control fiber cement specimens and specimens formulated using either silanol or silica fume (but not both) were tested to evaluate how much of either additive would be required (if even possible) to yield a waterproof fiber cement composite material. Second and third trials evaluated formulations including both silanol and silica fume in decreasing quantities to evaluate the extent of synergy by determining how little of each additive could be included in combination while still yielding an integrally waterproof fiber cement composite material. A fourth trial evaluated the effects of certain variations in the manufacturing processes disclosed herein.

Testing for waterproofness was performed using the ASTM D4068 hydrostatic test. A standard waterproofing test has not been established for tiled interior boards. However, the industry typically uses the ASTM D4068 hydrostatic test to assess waterproofness of waterproof membrane materials such as chlorinated polyethylene (CPE) or the like. Accordingly, specimens of the fiber cement compositions disclosed here were subjected to the ASTM D4068 test to provide a similar indication of waterproofness. The example revision of the test used to test the specimens was the ASTM D4068—17 version, revised in 2017.

ASTM D4068 hydrostatic pressure test is a pass-fail test. A specimen is exposed to surface pressure from a column of water 2 feet (60.96 cm) high and 2 inches (5.08 cm) in diameter. The specimen is exposed to the water surface pressure for 48 hours. After 48 hours of exposure, the specimen passes the test and can be considered waterproof if there is no evidence of water droplet formation on the opposite side (e.g., the underside) of the specimen. Evidence of water droplet formation (e.g., due to water seeping through the specimen below the water column) results in a failure of the waterproofness test.

In addition to the pass-fail result of the ASTM D4068 hydrostatic pressure test based on presence or lack of droplet formation, specimens of the fiber cement compositions were tested with a moisture meter to quantify surface wetness of the side of each specimen opposite the water column. The moisture meter provides a measurement of electrical conductivity along the surface of the specimen between two electrodes at a predefined spacing. Because electrical conductivity of the cementitious article increases in proportion to the presence of water along the conductive path between the electrodes, the determined conductivity can provide a reliable indication of surface wetness.

Trial 1

In a first trial, various sample specimens of fiber cement composite materials were produced and tested using the ASTM D4068 hydrostatic pressure test. The specimens tested in the first trial included control specimens including neither silanol nor silica fume, and specimens produced using either silanol or silica fume. A calcium silicate control specimen was formulated with cement comprising 28.70% of dry weight, silica comprising 55.80% of dry weight, cellulose fiber comprising 7.00% of dry weight, alumina comprising 3.00% of dry weight, and calcium silicate comprising 5.50% of dry weight. 1% silica fume, 2% silica fume, and 6% silica fume specimens were formulated based on the above calcium silicate control formulation, by adding silica fume in quantities of 1%, 2%, and 6% of dry weight, respectively, and reducing the quantity of cement by an equal weight. 3% silanol, 4% silanol, and 5% silanol specimens were formulated based on the above calcium silicate control formulation, by mixing the cellulose fiber with a silanol-dispersant solution in quantities of 3%, 4%, and 5% of fiber dry weight, respectively, before adding the remaining components. A perlite control specimen was formulated with 30.20% cement, 53.90% silica, 7.00% cellulose fiber, 3.00% alumina, and 5.90% perlite. A 4% silica fume specimen was formulated based on the perlite control formulation by adding 4% dry weight of silica fume (2% mixed with the cellulose fiber prior to adding the remaining components and 2% added with the remaining components) and reducing the quantity of cement by 4% dry weight. A 5% silanol specimen was formulated based on the above perlite control formulation by mixing the cellulose fiber with 5% fiber dry weight of the silanol-dispersant solution before adding the remaining components. After mixing, each specimen formulation was cured in an autoclave.

For the above formulations including silica fume, the silica fume was prepared as follows. The silica fume was received in a densified and agglomerated form. The silica fume was wet-out and dispersed in a 50% solids solution with fresh water for 10 minutes in a shear mixer. Particle size of the silica fume before mixing, after 1 minutes of mixing, and after 10 minutes of mixing is shown in Table 2 below.

TABLE 1

Silica fume particle size

| | Silica Fume 0 m | Silica Fume 1 m | Silica Fume 10 m |
|---|---|---|---|
| Median particle size (μm) | 12.92 | 13.39 | 3.75 |
| Mean particle size (μm) | 31.42 | 26.92 | 9.69 |
| % Passing 10 μm | 38.04 | 38.39 | 69.68 |
| % Passing 40 μm | 87.52 | 86.74 | 94.63 |
| % Passing 150 μm | 96.26 | 96.26 | 100.0 |

For the above formulations including a silanol-dispersant solution, the silanol-dispersant solution was prepared as follows. A silanol solution of 88% solids was obtained. A dispersant aid was mixed with water to achieve 10% solids and mixed for 3 hours. The dispersant aid solution was mixed with the silanol solution in a quantity of 2% solids and mixed for 5 minutes.

Each formulation above was subjected to a 48-hour ASTM D4068 test. The results of the ASTM D4068 test are shown in Table 2 below.

TABLE 2

Results of ASTM D4068 testing of example fiber cement specimens

| Formulation | Result |
|---|---|
| Calcium silicate control | Fail |
| Calcium silicate-1% silica fume | Fail |
| Calcium silicate-2% silica fume | Fail |
| Calcium silicate-6% silica fume | Fail |
| Calcium silicate-3% silanol | Fail |
| Calcium silicate-4% silanol | Fail |
| Calcium silicate-5% silanol | Pass |
| Perlite control | Fail |
| Perlite-4% silica fume | Fail |
| Perlite-5% silanol | Fail |

Following the ASTM D4068 test, the specimens were further tested with a moisture meter to determine surface wetness. For each formulation, electrical conductivity (proportional to surface wetness) was measured for the surface opposite the column of water used for the ASTM D4068 test. The conductivity values were measured in a dimensionless scale corresponding to the moisture meter, and consistent across all samples. It was determined empirically that a conductivity value less than approximately 85 corresponds to a specimen passing the ASTM D4068 test (e.g., no droplet formation). Consistent with the results in Table 1 above, only the calcium silicate-5% silanol specimen had a conductivity value confidence interval lower than 85.

As shown in Table 1 above, only one of the ten specimens tested in the first trial passed the ASTM D4068 test for waterproofness. The passing specimen was the calcium silicate-5% silanol specimen. As described above, treating the cellulose fiber with 5% fiber dry weight of silanol-dispersant mixture would be undesirable for full-scale production of fiber cement composite materials due to various production difficulties associated with high levels of silanol. Moreover, while 5% silanol was sufficient for waterproofing in the calcium silicate formulation, 5% silanol did not yield a waterproof specimen in the perlite formulation. Thus, the first trial confirmed that neither silica fume alone nor silanol alone was suitable as a waterproofing additive in commercially feasible quantities.

Trial 2

In a second trial, various sample specimens of fiber cement composite materials were produced and tested using the ASTM D4068 hydrostatic pressure test. The specimens tested in the second trial included a calcium silicate control specimen, calcium silicate specimens produced using either silanol or silica fume, and calcium silicate specimens produced using both silanol and silica fume. The calcium silicate control specimen was formulated with cement comprising 28.70% of dry weight, silica comprising 55.80% of dry weight, cellulose fiber comprising 7.00% of dry weight, alumina comprising 3.00% of dry weight, and calcium silicate comprising 5.50% of dry weight. 3% silica fume and 6% silica fume specimens were formulated based on the above calcium silicate control formulation, by adding silica fume in quantities of 3% and 6% of dry weight, respectively, and reducing the quantity of cement by an equal weight. 2% silanol and 4% silanol specimens were formulated based on the above calcium silicate control formulation, by mixing the cellulose fiber with a silanol-dispersant solution in quantities of 2% and 4% of fiber dry weight, respectively, before adding the remaining components. In addition, combination specimens were formulated based on the above calcium silicate control formulation by mixing the cellulose fiber with the silanol-dispersant solution and replacing cement with silica fume each of the four possible combinations of the silica fume and silanol specimens above (e.g., 3% silica fume-2% silanol, 3% silica fume-4% silanol, 6% silica fume-2% silanol, and 6% silica fume-4% silanol). After mixing, each specimen formulation was cured in an autoclave. For the above formulations including silica fume, the silica fume was prepared by the same method as in Trial 1, except that the silica fume was wet-out and dispersed in a 25% solids solution rather than 50% solids. For the above formulations including the silanol-dispersant solution, the silanol-dispersant solution was prepared by the same method as in Trial 1.

Each formulation above was subjected to a 48-hour ASTM D4068 test. The results of the ASTM D4068 test are shown in Table 3 below.

TABLE 3

Results of ASTM D4068 testing of example fiber cement specimens

| Formulation | Result |
|---|---|
| Calcium silicate control | Fail |
| Calcium silicate-3% silica fume | Fail |
| Calcium silicate-6% silica fume | Fail |
| Calcium silicate-2% silanol | Fail |
| Calcium silicate-4% silanol | Fail |
| Calcium silicate-2% silanol-3% silica fume | Pass |

TABLE 3-continued

Results of ASTM D4068 testing of example fiber cement specimens

| Formulation | Result |
|---|---|
| Calcium silicate-4% silanol-3% silica fume | Pass |
| Calcium silicate-2% silanol -6% silica fume | Pass |
| Calcium silicate-4% silanol -6% silica fume | Pass |

Following the ASTM D4068 test, the specimens were further tested with a moisture meter to determine surface wetness. For each formulation, electrical conductivity (proportional to surface wetness) was measured for the surface opposite the column of water used for the ASTM D4068 test. The conductivity values were measured in a dimensionless scale corresponding to the moisture meter, and consistent across all samples. It was determined empirically that a conductivity value less than approximately 85 corresponds to a specimen passing the ASTM D4068 test (e.g., no droplet formation). Consistent with the results in Table 3 above, each of the specimens including both silica fume and silanol had a conductivity value significantly lower than 85, while the control specimen and each of the specimens including only silica fume or silanol had a conductivity value of approximately 85 or higher.

As shown in Table 3 above, each of the specimens including both silica fume and silanol passed the ASTM D4068 test for waterproofness, while the remaining specimens showed evidence of droplet formation and failed the test. In addition, the ASTM D4068 test conditions were maintained for more than 8 weeks beyond the 48-hour test period, and the passing specimens continued to pass the waterproofness test criteria by not showing evidence of droplet formation. Notably, the quantities of silica fume and silanol-dispersant solution used in producing some of the passing specimens was substantially lower than the quantities used in the failing specimens and the quantities used in Trial 1 (e.g., the calcium silicate-2% silanol-3% silica fume specimen). Thus, the second trial indicated that a combination of silica fume and silanol may be able to yield an integrally waterproof fiber cement composite material in substantially smaller concentrations.

Trial 3

In a third trial, various sample specimens of fiber cement composite materials were produced and tested using the ASTM D4068 hydrostatic pressure test. The specimens tested in the third trial included perlite specimens produced using both silanol and silica fume. The specimens were formulated based on a baseline formulation including cement comprising 30.20% of dry weight, silica comprising 53.90% of dry weight, cellulose fiber comprising 7.00% of dry weight, alumina comprising 3.00% of dry weight, and perlite comprising 5.90% of dry weight. The test specimens were formulated based on the above baseline formulation, by adding replacing the cement with silica fume in quantities of 0.5%, 2%, and 4%. For each of these three quantities of silica fume, three different formulations were produced by mixing the cellulose fiber with a silanol-dispersant solution in quantities of 0.5%, 1.5%, and 3% of fiber dry weight, respectively, before adding the remaining components. Thus, a total of nine different combination formulations were produced for the third trial. After mixing, each specimen formulation was cured in an autoclave. The silica fume was prepared by the same method as in Trial 2. The silanol-dispersant solution was prepared by the same method as in Trial 1.

Each formulation above was subjected to a 48-hour ASTM D4068 test. The results of the ASTM D4068 test are shown in Table 4 below.

TABLE 4

Results of ASTM D4068 testing of example fiber cement specimens

| Formulation | Result |
|---|---|
| Perlite Control | Fail |
| Perlite-0.5% silanol-0.5% silica fume | Pass |
| Perlite-1.5% silanol-0.5% silica fume | Pass |
| Perlite-3% silanol-0.5% silica fume | Pass |
| Perlite-0.5% silanol-2% silica fume | Pass |
| Perlite-1.5% silanol-2% silica fume | Pass |
| Perlite-3% silanol-2% silica fume | Pass |
| Perlite-0.5% silanol-4% silica fume | Pass |
| Perlite-1.5% silanol-4% silica fume | Pass |
| Perlite-3% silanol-4% silica fume | Pass |

Following the ASTM D4068 test, the specimens were further tested with a moisture meter to determine surface wetness. For each formulation, electrical conductivity (proportional to surface wetness) was measured for the surface opposite the column of water used for the ASTM D4068 test. The conductivity values were measured in a dimensionless scale corresponding to the moisture meter, and consistent across all samples. It was determined empirically that a conductivity value less than approximately 85 corresponds to a specimen passing the ASTM D4068 test (e.g., no droplet formation). Consistent with the results in Table 4 above, most of the specimens including both silica fume and silanol had a conductivity value significantly lower than 85, compared with the perlite control value greater than 85.

As shown in Table 4 above the specimens including both silica fume and silanol generally passed the ASTM D4068 test for waterproofness. Notably, the quantities of silica fume and silanol-dispersant solution used in producing some of the passing specimens was substantially lower than the quantities used in the failing specimens and the quantities used in Trials 1 and 2. For example, an integrally waterproof fiber cement composite material can be produced by replacing cement with silica fume at only 0.5% of dry weight, and mixing silanol-dispersant solution with the cellulose fiber at only 0.5% of total fiber dry weight. It is understood that these concentrations are low enough that they are unlikely to cause any production difficulties. Thus, the third trial confirmed that a combination of silica fume and silanol can be used to produce an integrally waterproof fiber cement composite material in commercially feasible concentrations.

Trial 4

A fourth trial was conducted similar to Trials 1-3. In the fourth trial, a calcium silicate-0.5% silanol-0.5% silica fume specimen was tested to determine whether the 0.5%/0.5% combination yielded similar waterproofness in a formulation including calcium silicate rather than perlite. The calcium silicate-0.5% silanol-0.5% silica fume specimen included (dry weight) 28.2% cement, 55.8% silica, 7.0% cellulose fiber, 3.0% alumina, 5.5% calcium silicate, and 0.5% silica fume. The cellulose fiber was mixed with the same silanol-dispersant solution of Trial 1, in a quantity of 0.5% fiber dry weight. The silica fume was prepared as in Trial 2, and the specimen was cured in the same manner. The calcium silicate-0.5% silanol-0.5% silica fume specimen did not show evidence of droplet formation after 48 hours and accordingly passed the ASTM D4068 test.

The fourth trial additionally include a process trial to assess the effects of several variations in the mixing process for a single formulation. Each of four process trial specimens had a formulation including (dry weight) 25.7% cement, 55.8% silica, 7.0% cellulose fiber, 3.0% alumina, 5.5% calcium silicate, and 3% silica fume. The cellulose fiber in each specimen was mixed with silanol in a quantity of 2% of total fiber dry weight. Thus, the formulations corresponded to a calcium silicate-2% silanol-3% silica fume formulation.

Two variables were tested among the four process trial specimens. A first variable was whether to pre-disperse the silanol prior to adding (e.g., mixing the cellulose fiber with a silanol-dispersant solution vs. mixing the cellulose fiber with a pure silanol solution). The second variable was whether to pre-mix the silanol with the cellulose fiber (e.g., mixing the silanol or silanol-dispersant solution with the cellulose fiber prior to adding the remaining components vs. mixing the silanol or silanol-dispersant solution with the cellulose fiber and the remaining components at the same time).

Four specimens were produced to test each possible combination of variables. All specimens passed the ASTM D4068 test for waterproofness, as shown in Table 5 below.

TABLE 5

Results of ASTM D4068 testing of example fiber cement specimens

| Process | Result |
|---|---|
| Pre-mix fiber with silanol-dispersant solution | Pass |
| Pre-mix fiber with pure silanol solution | Pass |
| No pre-mix, silanol-dispersant solution | Pass |
| No pre-mix, pure silanol solution | Pass |

Following the ASTM D4068 test, the process trial specimens were further tested with a moisture meter to determine surface wetness. For each formulation, electrical conductivity (proportional to surface wetness) was measured for the surface opposite the column of water used for the ASTM D4068 test. The conductivity values in a dimensionless scale corresponding to the moisture meter, and consistent across all samples. It was determined empirically that a conductivity value less than approximately 85 corresponds to a specimen passing the ASTM D4068 test (e.g., no droplet formation). Consistent with the results in Table 5 above, the pre-mixed specimens had a conductivity value significantly lower than 85. However, despite passing the ASTM D4068 test, the specimens that were not pre-mixed had conductivity values of approximately 85. Based on the surface wetness testing in Trial 4, it was determined that pre-mixing the silanol with the cellulose fiber prior to adding the remaining components improved water resistance. However, pre-dispersing the pure silanol solution with a dispersant appeared not to have a significant impact on water resistance.

Fiber Cement Materials with Counterfeit Detection Features

Disclosed herein are fiber cement composite articles including defensive measures against the unauthorized sale of counterfeit articles. Defensive measures include one or more pigmented layers disposed between adjacent laminated layers within a fiber cement article. The pigmented layers can have a color different and visually distinguishable relative to the color of the adjacent laminated layers. In some embodiments, a fiber cement article such as a board, panel, sheet, or the like, can include several parallel pigmented layers. For example, a pigmented layer may be provided between each pair of adjacent laminated layers of the fiber cement article, such that the pigmented layers are regularly spaced and readily visible to an observer. Advantageously, the pigmented layers disclosed herein may be included in a fiber cement article without negatively affecting the strength or integrity of the finished article.

The manufacturing processes disclosed herein utilize pigments having suitably small particles sizes so as to provide for a thin and consistent pigmented layer covering substantially the full length and width of an article such that any portion of an article may be tested to confirm authenticity. Moreover, the particular processes and pigment particle sizes disclosed herein result in pigmented layers that remain visibly defined rather than smearing or bleeding when the articles are saw cut to confirm authenticity, as smearing or bleeding of the layers would complicate attempts to visibly confirm the presence of the pigmented layers.

As will be described in greater detail, the pigmented layers disclosed herein, when incorporated into manufactured fiber cement articles, may allow for purchasers or installers of fiber cement products to easily ascertain that a batch of fiber cement articles are genuine and not counterfeit prior to installation. For example, an installer may obtain a batch of fiber cement articles for installation. After obtaining the articles, such as at the installation site prior to installation, the installer may select one sample article from the batch and use a saw to cut off a portion of the sample article. The installer may then visually inspect the freshly cut faces of the sample article to see whether the pigmented layers can be observed within the fiber cement material. If the pigmented layers are observed, the installer may proceed with the installation having confirmed that the articles are genuine and are likely to perform as expected. If no pigmented layers are observed, the installer may test one or more additional sample articles from the batch, and/or may contact the seller and/or the purported manufacturer to report the possible counterfeit goods.

Composition and Manufacturing of Counterfeit Detection Features

Figure 12:
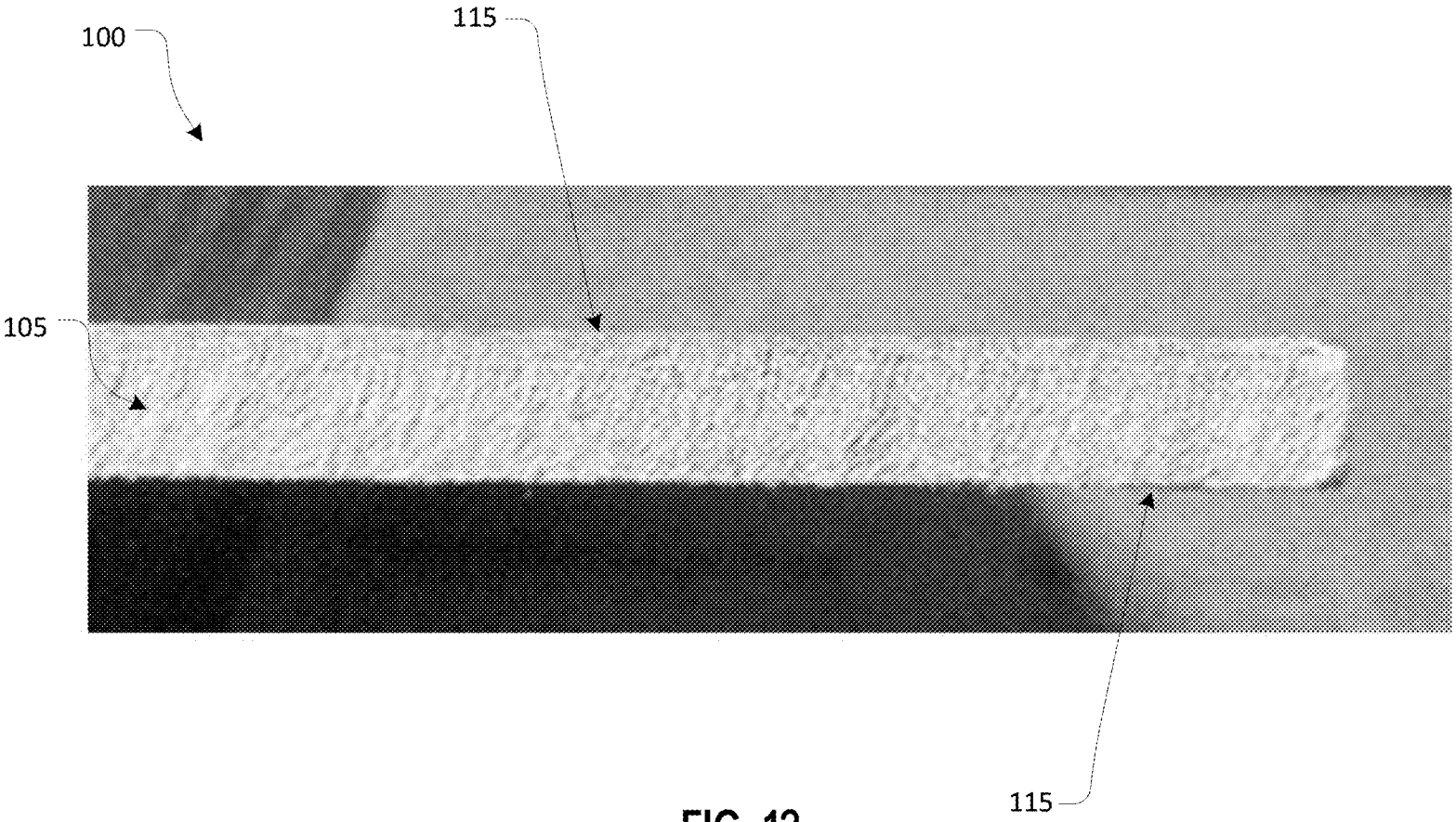
FIG. 12 is a side view of an edge of an example fiber cement article including counterfeit detection features after water jet cutting.
Figure 13:
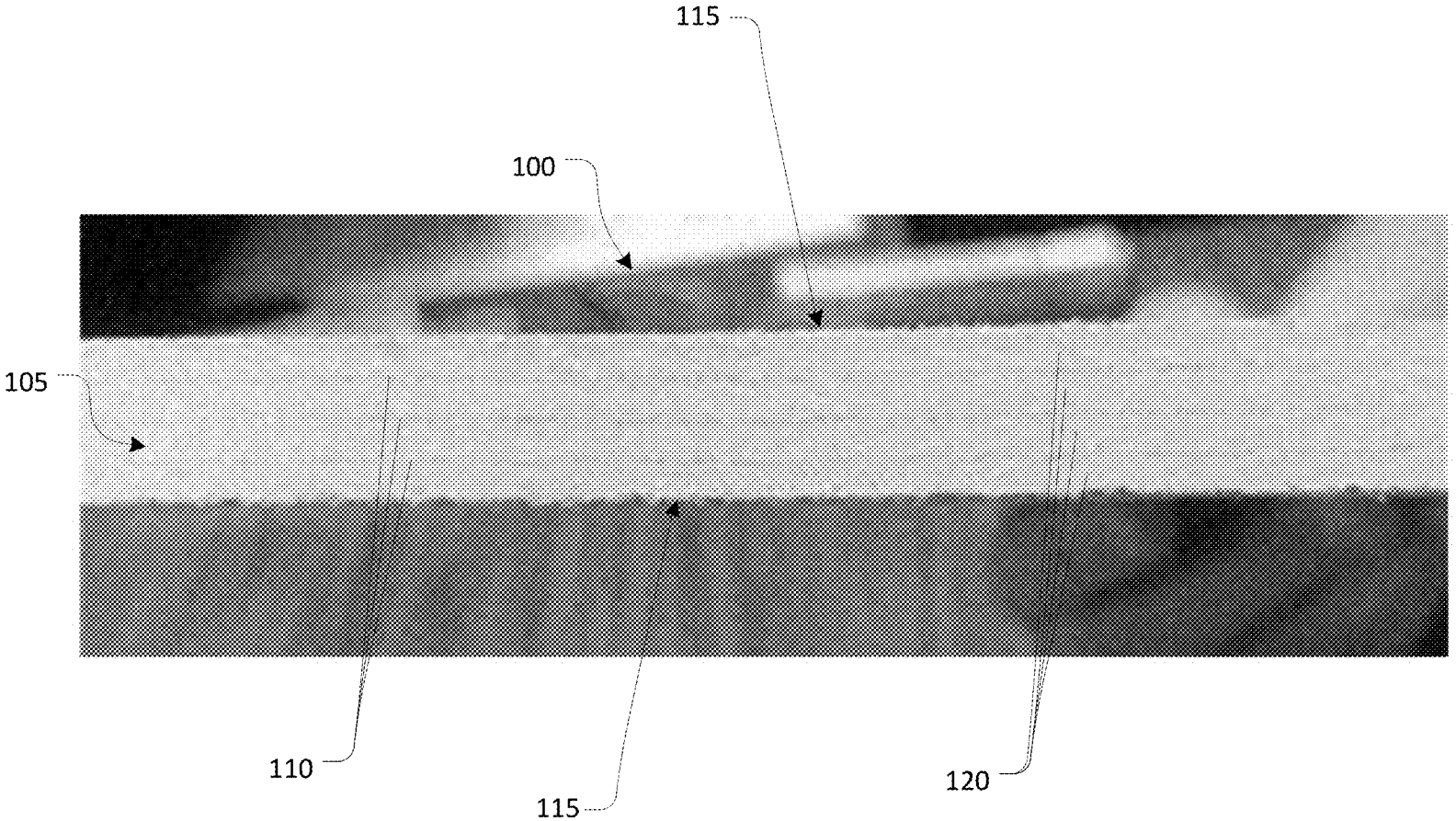
FIG. 13 is a side view of an edge of an example fiber cement article including counterfeit detection features after saw cutting.

FIGS. 12 and 13 are side sectional views of an example fiber cement article 100 including pigmented layers 110 that provide for counterfeit detection. FIG. 12 is a side view illustrating a side surface 105 of an article 100 that has been cut substantially perpendicular to its major faces 115 by a water jet or similar relatively coarse cutting method. FIG. 13 is a side view illustrating the side surface 105 of the article 100 having been cut using a saw or similar relatively smooth cutting method. It will be appreciated that the pigmented layers 110 that are visible on the side surface 105 in FIG. 13 are not visible in FIG. 12. Thus, as illustrated in FIGS. 12 and 13, a fiber cement article may be produced with included pigmented layers, and may be finished by water jet or similar coarse cutting method, and/or covered in a paint and/or primer, such that the pigmented layers are not visible on the finished article unless the article is cut by a saw or similar relatively smooth cutting method.

A finished article, such as the article 100 of FIG. 13, may include a plurality of laminated layers 120 of fiber cement material integrally formed or adhered together to form the article 100. Each pigmented layer 110 may be a layer of material including particles of one or more pigments having a different color relative to the color of the neighboring laminated layers 120 of fiber cement. In some embodiments, the pigmented layers in an article may be the same color, or may be different colors, for example, so as to form a predetermined sequence of colors indicative of authenticity (e.g., an article may be formed with two green pigmented layers and one red pigmented layer such that other colors or combinations of colors may be indicative of a counterfeit article). In some embodiments, the pigments included within the pigmented layers may be inorganic pigments. Any suitable inorganic pigment may be used. For example, in some embodiments the pigment or pigments include metal oxides such as titanium oxides (e.g., TiO, $TiO_2$, etc.), iron oxides (e.g., FeO, $FeO_2$, $Fe_2O_3$, $Fe_3O_4$, etc.), silicon oxides (e.g., $SiO_2$), aluminum oxides (e.g., $Al_2O_3$, etc.), or the like.

The pigmented layers described herein may be created so as to avoid inhibiting interlaminate bonding between adjacent laminated fiber cement layers, and may in some embodiments promote interlaminate bonding. The pigment particles within the pigmented layers may be suspended within a material adhering the adjacent laminated layers of fiber cement, or may be contained with adjacent portions of the adjacent laminated layers themselves. The pigment particles preferably have a relatively small particle size so as to prevent causing delamination or otherwise interfering with the adherence between the adjacent laminated layers of fiber cement. For example, in some embodiments the pigment particles have an average particle size of less than 50 micron, less than 20 micron, etc. In some embodiments, the pigment particles have a particle size of between 1 micron and 20 micron, between 2 micron and 10 micron, etc. In some embodiments, the pigment particles have a size of approximately 5 micron, such as between about 2.5 micron and about 7.5 micron.

Testing performed on example fiber cement articles, including the pigmented layers disclosed herein, indicated that a suitably small particle size may be critical to acceptable performance. For example, pigment particles having sizes of about 50 micron or smaller provided a relatively thin pigmented layer having a consistent thickness across the full extent of the article. However, pigmented layers produced with larger pigment particles were found to have uneven thicknesses in different regions of the same article and may even detrimentally affect the structural integrity of the article. In addition, larger pigment particles resulted in layers that were prone to smearing or bleeding at the location of a saw cut, obscuring the pigmented stripes intended to be visible at the side surface of a cut article when visually inspecting the cut article to confirm authenticity. In contrast, articles produced with smaller pigment particles as described herein, when saw-cut for inspection, yielded consistently contrasting and sharply defined stripes at the sawn side surfaces.

The pigment particles may be applied within a liquid carrier, which may be dried or otherwise removed during the curing process of the fiber cement articles. The liquid carrier may be, for example, water or any other suitable solvent or suspension medium. In one example, the pigment may be applied in an aqueous suspension including between 1 wt % and 10 wt %, such as approximately 2.5 wt %, of pigment. Other components may be included in the suspension or solution to enhance adhesion between adjacent laminate layers of fiber cement. The pigment solids may be treated with a high-shear dispersion process prior to application to ensure consistent color and thickness of the pigmented layers. The amount of pigment and carrier deposited may be metered so as to produce a desired thickness within the layer. For example, the suspension or solution may be applied at a dose of, for example, 6 to 9 dry grams per square foot of the fiber cement layer.

A fiber cement article may be produced by various manufacturing processes that produce layers of fiber cement material. In some examples, a fiber cement article may be produced by the Hatschek process. In the Hatschek process, a fiber cement slurry is formed, which may comprise a hydraulic binder, aggregates, water, and cellulose and/or polypropylene fibers. The slurry is deposited on a plurality of sieve cylinders that are rotated through the fiber cement slurry such that the fibers filter the fiber cement slurry to form a thin fiber cement film on a belt passing in contact with the sieve cylinders. A region of the belt containing a layer of fiber cement film may be passed over the sieve cylinders again to form an additional layer of fiber cement film against the first layer, and the process may be repeated until enough layers of fiber cement film are present to form an article having a desired thickness. For example, in some embodiments the article may be formed with two, three, four, five, or more layers. In the example article of FIG. 13, a total of four laminated layers of fiber cement are included. When all desired laminated layers are formed, water is removed and the layered article can be cured, such as in an autoclave, to produce a dry finished fiber cement article.

In the Hatschek process described above, the counterfeit detection features disclosed herein may be added by applying a layer of a pigment suspension, such as any of the pigment suspensions described herein, over one or more layers, or each layer of the fiber cement, after the layer is formed and before the next layer is formed in a subsequent pass over the sieve cylinders. For example, the pigment suspension may be applied by spraying or dripping the pigment suspension onto the formed layer, passing the formed layer through a container of the pigment suspension, passing the formed layer under a slot die applying the pigment suspension, or any other suitable means of applying the pigment suspension to the surface of the fiber cement. It may be preferable to apply the pigment suspension by a method that provides a thin and even coat over substantially the entire surface of each fiber cement layer such that, after curing, the pigmented layers are present throughout the full area of the finished fiber cement article, and any portion of the article may be tested to confirm authenticity.

Example Fiber Cement Composite Material Compositions

As described above, the counterfeit detection features disclosed herein may be implemented in conjunction with any fiber cement formulation that can be used to form an article including two or more layers. Various example fiber cement composite material formulations compatible with the disclosed counterfeit detection features will now be described. It will be understood that the following example formulations are merely examples of the formulations that may be used, and that the scope of the present disclosure is not limited to the following formulations.

Embodiments of fiber cement composite material compositions generally include a cementitious hydraulic binder, such as Portland cement or any other suitable cement, silica, and fibers, such as cellulose or other suitable fibers. The fiber may include a blend of two or more types of fibers, and may include recycled fiber materials. In some embodiments, the fiber is added in the form of a pulp, such as wood pulp or the like. The fiber cement composite materials may further include additional components such as silica, alumina, coloring additives, or the like. One or more density modifiers, such as low density additives, may further be included. Coloring additives may include, for example, pigments such as red or pink clay, or the like. Density modifiers may include, for example, low-density additives such as calcium silicate, perlite, or the like. The components of a fiber cement composite material formulation may be mixed in a slurry form including water, and may be formed into fiber cement composite materials by any of various processes such as a Hatschek process or the like. Water content may be removed from the fiber cement composite materials by various curing methods including autoclaving or the like, to form solid fiber cement composite materials.

In example fiber cement formulations including coloring additives, the pigment in the pigmented layers between the laminated fiber cement layers may be selected to be a contrasting color relative to the colored fiber cement material. For example, fiber cement composite material including red or pink clay as a coloring additive may be manufactured with black or green pigmented layers to provide counterfeit detection, as red or pink pigmented layers may be difficult to identify visual due to their similarity or lightness relative to the color of the laminated fiber cement layers that form the majority of the thickness of the article.

In various formulations, the cement may comprise between 20% and 45% of the dry weight of the slurry. For example, the cement may comprise between 25% and 39% of dry weight, between 25% and 29% of dry weight, between 35% and 39% of dry weight, or any percentage within the preceding ranges. Cement content less than 20% or greater than 45% is similarly possible. In some embodiments, a relatively lower cement content, such as between 25% and 29% of dry weight, may be desirable for interior cladding articles, interior board, or the like. In some embodiments, a relatively higher cement content, such as between 35% and 39% of dry weight, may be desirable for exterior cladding articles. In some embodiments, the fiber cement material may be a water resistant or waterproof fiber cement including silica fume. In such embodiments, it will be understood that each of the cement contents or cement content ranges disclosed herein may be reduced by an amount of silica fume added to the formulation. For example, a baseline cement content of between 25% and 39% of dry weight may correspond to an actual cement content of between 23% and 37% of dry weight if 2% by weight of silica fume is included in the formulation.

In various formulations, cellulose fibers may comprise between 3% and 15% of dry weight of the slurry. For example, the cellulose fibers may comprise between 5% and 10% of dry weight, between 6% and 9% of dry weight, between 6.5% and 7.5% of dry weight, between 7.75% and 8.75% of dry weight, or any percentage within the preceding ranges. Cellulose fiber content less than 3% or greater than 15% is similarly possible. In some embodiments, a relatively lower cellulose fiber content, such as between 6.5% and 7.5%, or approximately 7% of dry weight, may be desirable for interior cladding articles, interior board, or the like. In some embodiments, a relatively higher cellulose fiber content, such as between 7.75% and 8.75%, or approximately 8.25% of dry weight, may be desirable for exterior cladding articles.

In various formulations, the silica may comprise any percentage between 50% and 60% of dry weight. For example, the silica may comprise approximately 50% of dry weight, 54% of dry weight, 56% of dry weight, 58% of dry weight, etc. In various formulations, the alumina may comprise any percentage between 2% and 5% of dry weight. For example, the alumina may comprise approximately 3% of dry weight, approximately 3.5% of dry weight, etc. In various formulations, the density modifier may comprise any percentage between 0% and 7% of dry weight. For example, some formulations may include no density modifier, or may include approximately 2% of dry weight, approximately 3% of dry weight, approximately 4% of dry weight, approximately 5% of dry weight, approximately 5.5% of dry weight, approximately 7% of dry weight, etc.

Common density modifiers present in these quantities may include calcium silicate, perlite, or the like.

In some embodiments, additional components may be included as components in a fiber cement composite material, in addition to the components described above. For example, in some embodiments a fiber cement composite material formulation may include one or more components that cause water resistance or waterproofness of the finished fiber cement composite material. One example component is a hydrophobic agent such as a silanol solution, which may include silanol and water or another suitable solvent. Without being bound by theory, it is understood that silanols increase water resistance because they act as hydrophobic agents making the surfaces of the fibers hydrophobic and, when used to treat fiber cement fibers, prevent water from traveling through the fiber cement matrix along the edges of the fibers. In some embodiments, a silanol solution may be mixed with the fiber component of the fiber cement formulation. The silanol solution may be added to the fibers at the time the fiber is mixed with the remaining components of the fiber cement formulation, or may be pre-mixed with the fiber (e.g., for 1 minutes, 5 minutes, 10 minutes, 20 minutes, or more) prior to adding the remaining components of the fiber cement formulation. Quantities of silanol solution to be added to the fibers may be determined such that the silanol have a dry weight of approximately 0.25% of fiber dry weight, approximately 0.5% of fiber dry weight, approximately 1% of fiber dry weight, approximately 2% of fiber dry weight, approximately 3% of fiber dry weight, approximately 4% of fiber dry weight, approximately 5% of fiber dry weight, or more. The dry weight of the silanol may be in any suitable range such as between 0.25% and 3% of fiber dry weight, between 0.25% and 2% of fiber dry weight, between 0.25% and 1% of fiber dry weight, or any sub-range therebetween.

Silica fume is another example component that may be included in some fiber cement composite material formulations. Silica fume is a fine pozzolanic material comprising amorphous silica. Silica fume may be produced, for example, as a byproduct of the production of elemental silicon or ferro-silicon alloys in electric arc furnaces. Silica fume may be included in a variety of concrete and cementitious products, but is not typically used for waterproofing implementations. However, it has been discovered that silica fume may enhance the water resistance of fiber cement composite materials and may yield integrally waterproof fiber cement composite materials when included in conjunction with silanol. Without being bound by theory, it is believed that the relatively fine size of silica fume, relative to the other components of a fiber cement article, may reduce porosity of the cementitious matrix between fibers. Moreover, silica fume can conveniently be added to fiber cement formulations as a replacement for a portion of the cement. For example, in some embodiments the cement component of the fiber cement may be reduced by an equal weight to the weight of silica fume added to the formulation, without undesirably affecting other physical properties of the fiber cement articles such as dimensional stability, flexural strength, or the like. In various formulations, the amount of silica fume in a fiber cement article may be, for example, between 0.25% and 5% of dry weight, between 0.25% and 4% of dry weight, between 0.25% and 3% of dry weight, between 0.25% and 2% of dry weight, between 0.25% and 1% of dry weight, or any sub-range or percentage therebetween. For example, in some embodiments, the silica fume content is approximately 0.5% of dry weight, approximately 1% of dry weight, approximately 1.5% of dry weight, approximately 2% of dry weight, etc. However, relatively large quantities of silica fume (e.g., above 2-3% of dry weight) may interfere with commercial-scale production of fiber cement composite materials.

The foregoing description of the preferred embodiments of the present disclosure has shown, described and pointed out the fundamental novel features of the inventions. The various devices, methods, procedures, and techniques described above provide a number of ways to carry out the described embodiments and arrangements. Of course, it is to be understood that not necessarily all features, objectives or advantages described are required and/or achieved in accordance with any particular embodiment described herein. Also, although the invention has been disclosed in the context of certain embodiments, arrangements and examples, it will be understood by those skilled in the art that the invention extends beyond the specifically disclosed embodiments to other alternative embodiments, combinations, sub-combinations and/or uses and obvious modifications and equivalents thereof. Accordingly, the invention is not intended to be limited by the specific disclosures of the embodiments herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used in conjunction with fastening building panel support profiles to substrates, and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A building system comprising:

a building substrate;

a first fiber cement building article comprising a front face, a rear face opposite the front face, and an edge member disposed contiguously between the front face and the rear face, wherein the first fiber cement building article is secured to the building substrate such that the rear face is positioned closer to the building substrate than the front face, and wherein at least one of the front and rear faces comprises a plurality of integrally formed drainage channels and a plurality of spacer sections disposed between the drainage channels, each of the plurality of drainage channels defining an air gap comprising a liquid flow path;

a second fiber cement building article comprising a front face, a rear face opposite the front face, and an edge member disposed contiguously between the front face and the rear face, wherein the second fiber cement building article is secured to the building substrate such that the rear face is positioned closer to the building substrate than the front face, and wherein at least one of the front and rear faces comprises a plurality of integrally formed drainage channels and a plurality of spacer sections disposed between the drainage channels, each of the plurality of drainage channels defining an air gap comprising a liquid flow path;

a first fiber cement building panel secured to the first fiber cement building article and the building substrate such that the first fiber cement building panel contacts the front face of the first fiber cement building article;

a second fiber cement building panel secured to the second fiber cement building article and the building substrate such that the second fiber cement building panel contacts the front face of the second fiber cement building article, wherein adjacent edges of the first and second fiber cement building panels are separated from one another by a gap, and wherein said gap includes a metal strip extending therewithin;

a plurality of fasteners configured to secure the first fiber cement building article, the second fiber cement building article, the first fiber cement building panel, and the second fiber cement building panel to the building substrate; and a first coating layer disposed along an exterior surface of the first fiber cement building panel and a second coating layer disposed along an exterior surface of the second fiber cement building panel.

2. The building system of claim 1, wherein the plurality of drainage channels and the plurality of spacer sections are located on the front faces of the first and second fiber cement building articles.

3. The building system of claim 1, wherein the first and second coating layers comprise a render finish.

4. The building system of claim 1, wherein said building substrate comprises wood studs, and wherein said rear faces of the first and second fiber cement building articles contact surfaces of the wood studs.

5. The building system of claim 4, wherein the first and second fiber cement building panels are secured to the wood studs such that the gap separating the adjacent edges of the first and second fiber cement building panels is aligned with one of said wood studs.

6. The building system of claim 1, wherein said building substrate does not include wood sheathing.

7. A building system comprising:

a building substrate;

a first fiber cement building article comprising a front face, a rear face opposite the front face, and an edge member disposed contiguously between the front face and the rear face, wherein the first fiber cement building article is secured to the building substrate such that the rear face is positioned closer to the building substrate than the front face, and wherein at least one of the front and rear faces comprises a plurality of integrally formed drainage channels and a plurality of spacer sections disposed between the drainage channels, each of the plurality of drainage channels defining an air gap comprising a liquid flow path;

a second fiber cement building article comprising a front face, a rear face opposite the front face, and an edge member disposed contiguously between the front face and the rear face, wherein the second fiber cement building article is secured to the building substrate such that the rear face is positioned closer to the building substrate than the front face, and wherein at least one of the front and rear faces comprises a plurality of integrally formed drainage channels and a plurality of spacer sections disposed between the drainage channels, each of the plurality of drainage channels defining an air gap comprising a liquid flow path;

an insulation panel secured to and extending along the front faces of the first and second fiber cement building articles;

a plurality of fasteners configured to secure the first and second fiber cement building articles and the insulation panel to the building substrate;

a mesh layer secured to and extending along an exterior surface of the insulation panel, said mesh layer comprising a wire reinforcing mesh; and one or more coating layers covering the mesh layer and secured to the exterior surface of the insulation panel.

8. The building system of claim 7, wherein said one or more coating layers comprises a cementitious coating.

9. The building system of claim 7, wherein said one or more coating layers comprises a polymeric coating.

10. The building system of claim 7, wherein said one or more coating layers comprises an acrylic basecoat and an acrylic topcoat.

11. The building system of claim 7, wherein said one or more coating layers comprises a stucco exterior finish.

12. The building system of claim 7, wherein the plurality of drainage channels and the plurality of spacer sections are located on the front faces of the first and second fiber cement building articles.

13. The building system of claim 7, wherein said building substrate does not include wood sheathing.

14. The building system of claim 7, wherein said building substrate comprises wood studs, and wherein said rear faces of the first and second fiber cement building articles contact surfaces of the wood studs.

* * * * *